US011730243B2

(12) United States Patent
Yap

(10) Patent No.: US 11,730,243 B2
(45) Date of Patent: Aug. 22, 2023

(54) DEVICE FOR HOLDING OBJECTS

(71) Applicant: RIVEFORT PTE. LTD., Singapore (SG)

(72) Inventor: Xong Sing Yap, Singapore (SG)

(73) Assignee: RIVEFORT PTE. LTD., Singapore (SG)

( * ) Notice: Subject to any disclaimer, the term of this patent is extended or adjusted under 35 U.S.C. 154(b) by 1127 days.

(21) Appl. No.: 16/461,317

(22) PCT Filed: Nov. 20, 2017

(86) PCT No.: PCT/SG2017/050574
§ 371 (c)(1),
(2) Date: May 15, 2019

(87) PCT Pub. No.: WO2018/093334
PCT Pub. Date: May 24, 2018

(65) Prior Publication Data

US 2020/0069017 A1 Mar. 5, 2020

(30) Foreign Application Priority Data

Nov. 21, 2016 (SG) ..... 10201609746P

(51) Int. Cl.
*A45C 11/18* (2006.01)
*A45C 1/06* (2006.01)
*A45C 11/32* (2006.01)

(52) U.S. Cl.
CPC ..... *A45C 11/182* (2013.01); *A45C 1/06* (2013.01); *A45C 11/32* (2013.01); *A45C 2001/062* (2013.01); *A45C 2001/065* (2013.01)

(58) Field of Classification Search
CPC ..... A45C 1/06; A45C 2001/062; A45C 11/82; A45C 2001/065
See application file for complete search history.

(56) References Cited

U.S. PATENT DOCUMENTS 3,369,585 A * 2/1968 Martinsen ..... A45C 11/182 150/147
4,056,139 A * 11/1977 Murt ..... A45C 1/06 24/329

(Continued)

FOREIGN PATENT DOCUMENTS

CN 102762123 A 10/2012
CN 203137351 U 8/2013
EP 1164584 A1 12/2001

OTHER PUBLICATIONS

Communication pursuant to Article 94(3) EPC dated Apr. 5, 2022 from the European Patent Office for European Application No. 17871567.8.

(Continued)

*Primary Examiner* — Sue A Weaver
(74) *Attorney, Agent, or Firm* — JCIP; Joseph G. Chu; Jeremy I. Maynard

(57) ABSTRACT

A device for holding at least one object, the device comprising at least two planar frames located adjacent one another, each planar frame comprising an opening leading to a space for receiving an object in a respective planar frame; and an object retaining member for maintaining an object in a space of an adjacent planar frame; wherein the object retaining member is formed of a side of the respective planar frame and is adjacent to the space of the adjacent planar frame; and wherein the opening of the respective planar frame is aligned in a different direction from an opening of the adjacent planar frame is disclosed. The device is suitable for, but not limited to, storing cards, coins and bank notes.

11 Claims, 39 Drawing Sheets

(56) References Cited

U.S. PATENT DOCUMENTS

| | | | | |
|---|---|---|---|---|
| 4,817,253 | A * | 4/1989 | Harmatuik | A45C 11/182 24/328 |
| 5,069,333 | A | 12/1991 | Chen | |
| 7,830,672 | B1 | 11/2010 | Kitchen | |
| 2006/0249234 | A1 | 11/2006 | Lin | |
| 2007/0101552 | A1* | 5/2007 | Dolas | A45C 1/06 24/67 R |
| 2009/0199940 | A1 | 8/2009 | Toner | |
| 2010/0139138 | A1 | 6/2010 | Miadich | |
| 2011/0277892 | A1 | 11/2011 | Black | |
| 2013/0025750 | A1 | 1/2013 | Wingerter et al. | |
| 2015/0208778 | A1 | 7/2015 | Velentzas et al. | |
| 2016/0345697 | A1 | 12/2016 | Purwanto | |

OTHER PUBLICATIONS

International Search Report dated Jan. 29, 2018, Written Opinion of International Search Authority dated Jan. 29, 2018, and IPRP with completion date of Jul. 10, 2018 for International Patent Application No. PCT/SG2017/050574.

Extended European Search Report with date of completion being Jun. 10, 2020 for European Application No. EP17871567.8.

First Office Action with Search Report dated Nov. 20, 2020 from China National Intellectual Property Administration for Patent Application No. 201780082013X.

* cited by examiner

DEVICE FOR HOLDING OBJECTS

TECHNICAL FIELD

The present invention generally relates to a device for holding objects. In particular, the invention relates to a device suitable for (but not limited to) storing cards, coins and bank notes and will be described in this context. The present invention also relates to a method of making the same.

BACKGROUND

The following discussion of the background to the invention is intended to facilitate an understanding of the present invention only. It should be appreciated that the discussion is not an acknowledgement or admission that any of the material referred to was published, known or part of the common general knowledge of the person skilled in the art in any jurisdiction as at the priority date of the invention.

Card holders are typically configured such that the cards are kept in staggered compartments. This configuration is illustrated by device P1000 in FIG. 1, wherein the plurality of openings P100 are aligned parallel to each other and the cards received in the plurality of openings P100 are aligned in the same direction. A staggered configuration along the direction of arrow X1 facilitates easy visualization of each card as well as easy insertion and removal of a card from an opening P100. As the openings P100 are aligned in the same direction, the growth in thickness of the card holder occurs in the same dimension as cards are inserted into the openings P100. To accommodate more cards, the height of device P1000 can be extended along the direction indicated by arrow X1.

Typical card holders also tend to have a layer of fabric or leather material between each card, which can add to the thickness of the card holder. An example is the card holder is disclosed in U.S. 2015/0208778 A1. In said card holder, each card is stored in a cavity that has an object between another card stored in an adjacent cavity. This object takes the form of, for instance a storage element, a storage feature, a base body, a storage feature or a storage element. As these components are made up of a rigid material or combination of materials, they may contribute significantly to the thickness of the device. Furthermore, the thickness of the card holder can further increase when the compartments are filled. These card holders can be incorporated into a wallet, and consequently contribute to the thickness of the wallet.

Wallets are commonly constructed using fabric or leather material. In many instances, wallets comprise multiple folded over layers of the fabric or leather material, which contribute to the thickness of the wallet. Furthermore, the thickness of the wallet can increase substantially when objects such as cards, coins and bank notes are inserted into the wallet. Due to the thickness of such wallets, the user tends to have an unsightly large bulge in the back pocket or simply avoid carrying the wallet.

Furthermore, some wallets are unable to securely retain cards or provide ease in retrieval of the cards.

Some wallets can be constructed using metal and can retain personal items such as credit cards and money within a relatively low profile. However, these metal wallets may not securely retain personal items, may be too heavy, lack aesthetic appeal, and may be difficult to operate.

In light of the above, there exists a need to develop a device for holding cards, coins and bank notes that ameliorates or overcomes the above disadvantages.

The present invention seeks to provide a device for holding objects that addresses the aforementioned need at least in part. The present invention also seeks to provide a method of making the same.

SUMMARY OF THE INVENTION

According to a first aspect of the present invention, there is provided a device for holding at least one object, the device comprising at least two planar frames located adjacent one another, each planar frame comprising an opening leading to a space for receiving an object in a respective planar frame; and an object retaining member for maintaining an object in a space of an adjacent planar frame; wherein the object retaining member is formed of a side of the respective planar frame and is adjacent to the space of the adjacent planar frame; wherein the opening of the respective planar frame is aligned in a different direction from an opening of the adjacent planar frame; and wherein each planar frame is configured such that at least a portion of the object in the space of the respective planar frame is in direct contact with at least a portion of the object in the space of the adjacent planar frame.

Preferably, the opening of the respective planar frame is substantially orthogonal to the opening of the adjacent planar frame.

Preferably, each planar frame is configured such that when an object is received in the space of each planar frame, at least a portion of the object in the space of each planar frame is visible.

Preferably, each planar frame contacts only the periphery of the object in the space of the respective planar frame.

Preferably, the thickness of the object retaining member of the respective planar frame is different from the thickness of an object retaining member of the adjacent planar frame.

Preferably, each planar frame further comprises a second side and a third side.

Preferably, the thickness of the second side of the respective planar frame is different from the thickness of the second side of the adjacent planar frame.

Preferably, the thickness of the third side of the respective planar frame is different from the thickness of the third side of the adjacent planar frame.

Preferably, the device further comprises a front frame.

Preferably, the device further comprises a backing.

Preferably, the device further comprises a locking mechanism between the front frame and the backing capable of maintaining the object in the space of each planar frame.

Preferably, the locking mechanism comprises at least one lever between the front frame and the backing.

Preferably, the locking mechanism comprises two levers between the front frame and the backing. Advantageously, two levers are sufficient to maintain the object in the space of each planar frame. As such, there is a savings in material used, which consequently results in a savings in cost.

Preferably, the device comprises four planar frames.

Preferably, each planar frame further comprises four corners and an eyelet is located at each corner.

Preferably, the device is releasably attached to a first shell cover and a second shell cover.

Preferably, the second shell cover forms a compartment with the device.

Preferably, the first shell cover further comprises a locking means.

Preferably, the first shell cover further comprises a first barrier connected to the first shell cover.

Preferably, the first shell cover further comprises a second barrier connected to the first shell cover.

Preferably, the device further comprises an object retaining means capable of pressing an object against a side of the second barrier.

Preferably, the object retaining means is a hinged clip or a fixed clip.

Preferably, the first barrier and the second barrier form a compartment, wherein the compartment comprises padding along the edges of the compartment.

Preferably, the first barrier and the first shell cover form a compartment.

Preferably, the first barrier further comprises a tab capable of allowing a user to raise the first barrier.

Preferably, the first shell cover and the second shell cover is made of aluminium.

Preferably, the first barrier is made of aluminium.

Preferably, the second barrier is made of aluminium.

Preferably, the device is a wallet.

BRIEF DESCRIPTION OF DRAWINGS

The present invention will now be described, by way of example only, with reference to the accompanying drawings, in which:

FIG. 7(*b*) is a sectional view of FIG. 5 viewed from $V_b$, showing that second planar object 202*b* and fourth planar object 202*d* would come out from the direction Y2.

FIG. 9(*b*) illustrates a cross-sectional view of a wallet in accordance with an embodiment of the invention.

FIG. 18(*b*) illustrates a view of a hinged clip in accordance with an embodiment of the invention pressed against a stack of bank notes having thickness $A_2$; FIG. 18(*c*) illustrates a view of a hinged clip in accordance with another embodiment of the invention pressed against a stack of bank notes having thickness $A_2$.

FIG. 24(*b*) illustrates a cross-sectional view of a wallet in accordance with an embodiment of the invention; FIG. 24(*c*) illustrates a cross-sectional view of a wallet in accordance with an embodiment of the invention; FIG. 24(*d*) illustrates a cross-sectional view of a wallet in accordance with an embodiment of the invention.

FIG. 26(*b*) illustrates a perspective view of another embodiment of the wallet of FIG. 24 in an open position containing a card, showing one of the compartments between the first shell cover and the second shell cover, wherein the card is retained using a hinged clip.

FIG. 32(*b*) illustrates an exploded view of the wallet of FIG. 26(*b*) from the top.

Figure 1:
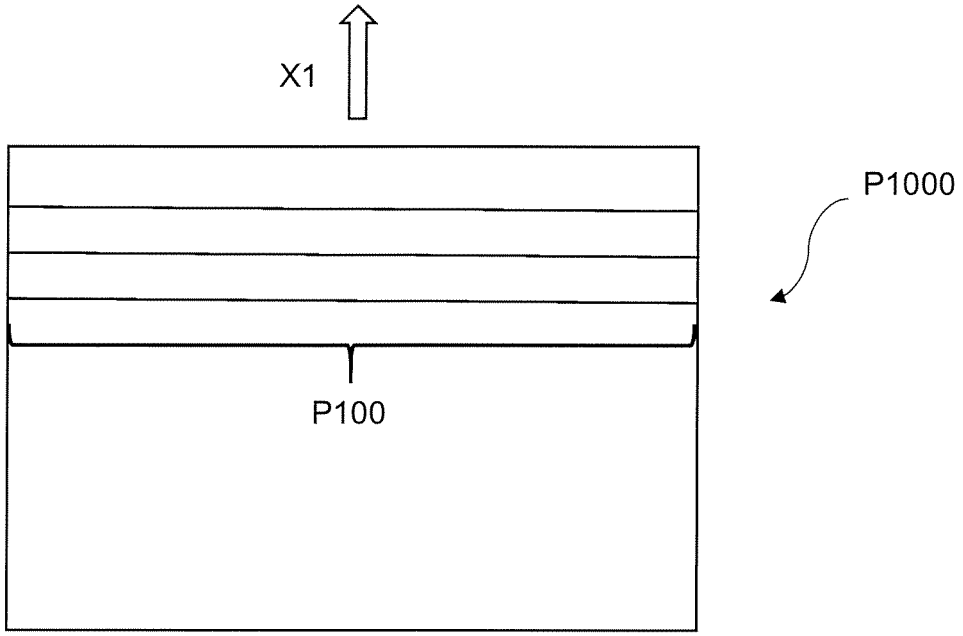
Fig. 1 (Prior Art)
FIG. 1 illustrates a device for holding cards that is commonly used in the art.

Other arrangements of the invention are possible and, consequently, the accompanying drawings are not to be understood as superseding the generality of the preceding description of the invention.

DISCLOSURE OF EMBODIMENTS OF THE INVENTION

Particular embodiments of the present invention will now be described with reference to the accompanying drawings. The terminology used herein is for the purpose of describing particular embodiments only and is not intended to limit the scope of the present invention. Other definitions for selected terms used herein may be found within the detailed description of the invention and apply throughout the description. Additionally, unless defined otherwise, all technical and scientific terms used herein have the same meanings as commonly understood by one or ordinary skill in the art to which this invention belongs. Where possible, the same reference numerals are used throughout the figures for clarity and consistency.

Unless specified otherwise, the terms "comprising" and "comprise", and grammatical variants thereof, are intended to represent "open" or "inclusive" language such that they include recited elements but also permit inclusion of additional, unrecited elements.

As used herein, the term "about" typically means +/−5% of the stated value, more typically +/−4% of the stated value, more typically +/−3% of the stated value, more typically +/−2% of the stated value, even more typically +/−1% of the stated value, and even more typically +/−0.5% of the stated value.

As used herein, the term "thickness" when used in reference to a side of a frame refers to the distance from the inner rim to the outer rim of the side, wherein the inner rim faces the space for receiving an object. For instance and as shown in FIG. 3(*a*), the thickness of width W2 of first frame 100*a* is measured from the inner rim of third side 113 which faces the space and the outer rim of third side 113.

Provided herein is a device for holding at least one object, in particular, planar objects. The term "planar" used throughout the specification refers to an object having a substantially level surface. However, this does not mean that a planar object cannot have any protrusions or indentations. An object may still be considered planar if a greater extent of the object has a substantially level surface.

The device may comprise at least two frames located adjacent one another, each frame may be substantially planar. Each frame may comprise an opening leading to a space capable of receiving at least one object and an object retaining member for maintaining an object in the space of an adjacent frame. The number of frames will depend on the application, such as the number of objects that a user has. Advantageously, the various embodiments of the device may play a role in achieving a slim and/or small device which takes up less space and makes use of less material than a device that is commonly used in the art. At the same time, the device facilitates easy visualization of each object as well as easy and smooth insertion and removal of an object from an opening. Exemplary, non-limiting embodiments of the device will now be disclosed using device 1000 for holding planar objects as an illustration. It should be understood that while the space of each frame of the device 1000 is described as capable for receiving one object, it is possible for the space of each frame to be adapted such that the space of a respective frame is capable of receiving more than one object.

Figure 2:
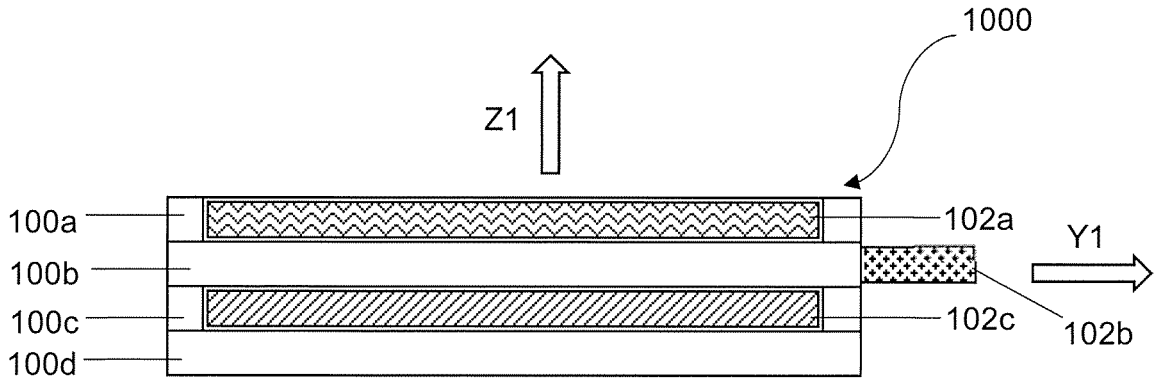
FIG. 2 illustrates a top view of a device for holding cards in accordance with an embodiment of the invention, the device having four frames placed adjacently to each other.
Figure 3A:
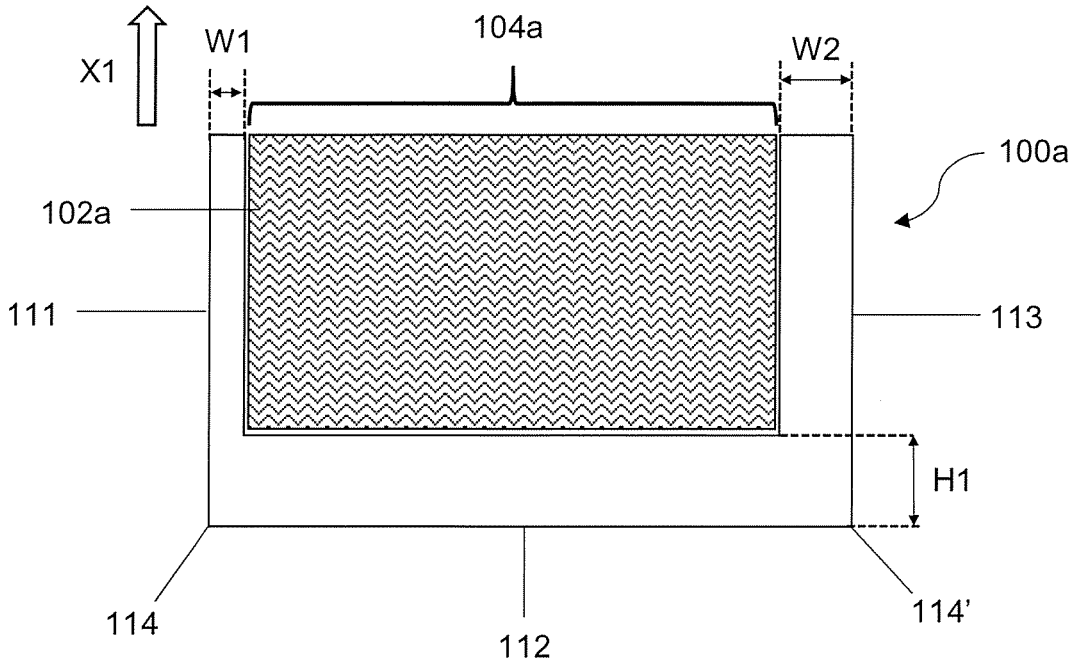
FIGS. 3(*a*) to 3(*d*) illustrate a view of the four frames of FIG. 2, each frame having an opening for the insertion of a planar object, wherein the opening of a frame is orthogonal to the opening of an adjacent frame.
Figure 3B:
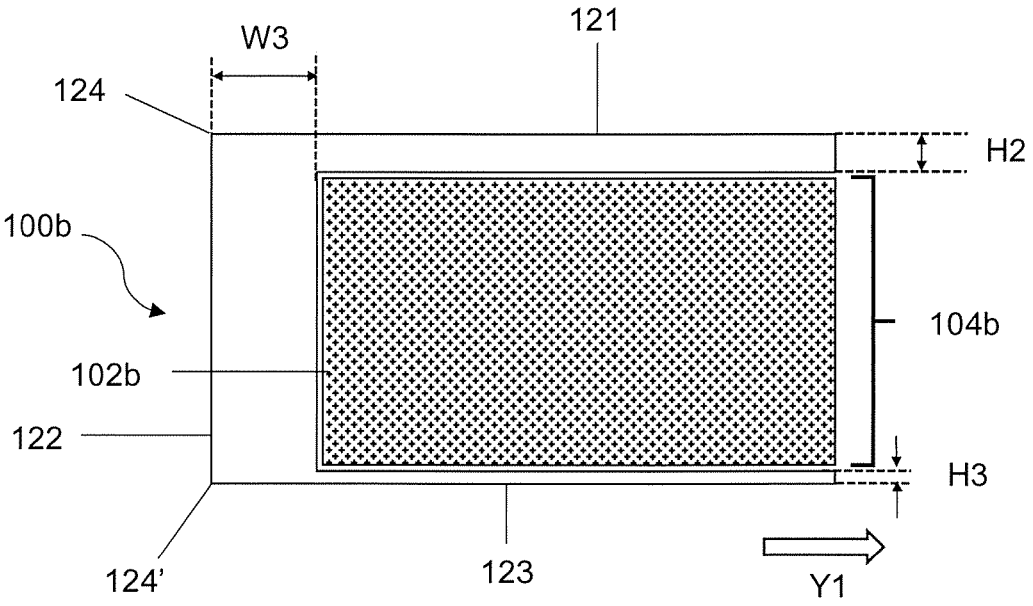
Figure 3C:
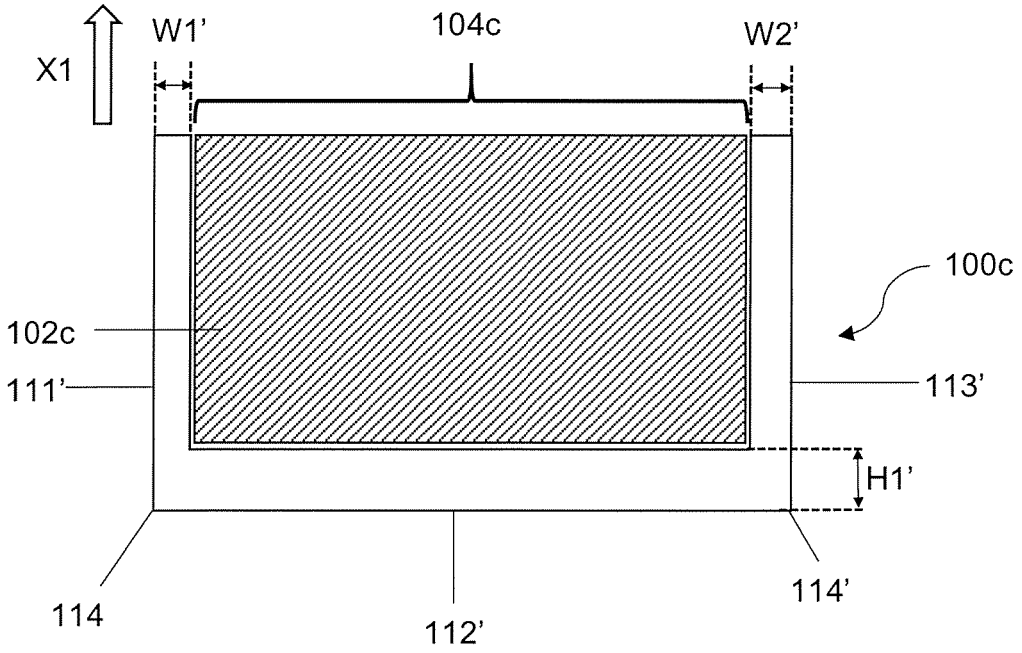
Figure 3D:
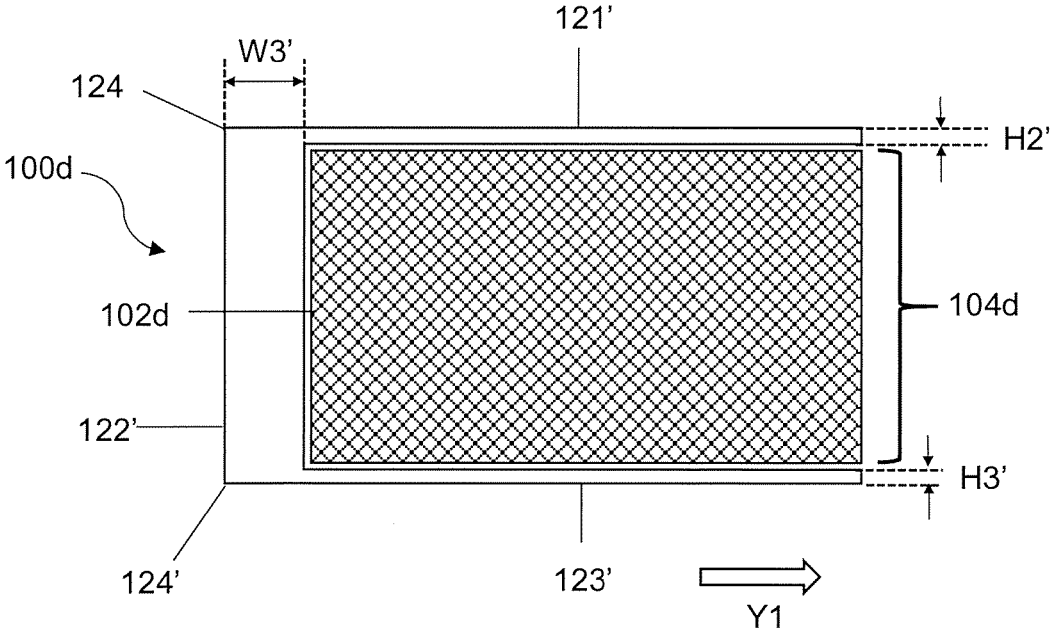

In accordance with an embodiment of the invention, a device 1000 for holding planar objects comprises at least two frames, each frame located adjacent one another and configured to receive a planar object, but the planar object is nota part of the invention. As shown in FIGS. 2 and 3, the device 1000 comprises four frames attached adjacently to each other, namely first frame 100*a*, second frame 100*b*, third frame 100*c* and fourth frame 100*d*. First frame 100*a* is configured to receive a first planar object 102*a* in a space, wherein a first opening 104*a* leads to the space, second frame 100*b* is configured to receive a second planar object 102*b* in a space, wherein a second opening 104*b* leads to the space, third frame 100*c* is configured to receive a third planar object 102*c* in a space, wherein a third opening 104*c* leads to the space and fourth frame 100*d* is configured to receive a fourth planar object 102*d* in a space, wherein a fourth opening 104*d* leads to the space.

In various embodiments, the first frame 100*a*, second frame 100*b*, third frame 100*c* and fourth frame 100*d* may be shaped and sized to receive an object that may be substantially planar, such as (but not limited to) a credit card, identification card, CD-ROM or plate.

Advantageously, each frame may be configured to contact the periphery of the planar object that it is receiving. Consequently, when a frame containing a planar object is placed adjacent to another frame containing another planar object, there would be no material or object separating the two planar objects. In other words, the two planar objects may be in direct contact with each other. This may advantageously lead to a device 1000 with a reduced thickness, as compared to a prior art device P1000 having a layer of material separating each planar object (FIG. 1). Furthermore, due to the absence of the layer of material, there may be lower costs of manufacturing.

In various embodiments and as shown in FIG. 3(*a*), the first frame 100*a* may further comprise a first side 111, a second side 112 and a third side 113 that define a space capable of accommodating a first planar object 102*a*, such that the first side 111 and the second side 112 form an edge 114, while the second side 112 and the third side 113 form another edge 114'. The first opening 104*a* leads to the space capable of accommodating the first planar object 102*a*. As shown in FIG. 3(*a*), width W1 of first frame 100*a* is the distance between the inner rim of first side 111 which faces the space and the outer rim of first side 111; height H1 of first frame 100*a* is the distance between the inner rim of second side 112 which faces the space and the outer rim of second side 112; and width W2 of first frame 100*a* is the distance between the inner rim of third side 113 which faces the space and the outer rim of third side 113.

In various embodiments and as shown in FIG. 3(*b*), the second frame 100*b* may further comprise a first side 121, a second side 122 and a third side 123 that define a space capable of accommodating a second planar object 102*b*, such that the first side 121 and the second side 122 form an edge 124, while the second side 122 and the third side 123 form another edge 124'. The second opening 104*b* leads to the space capable of accommodating the second planar object 102*b*. As shown in FIG. 3(*b*), height H2 of second frame 100*b* is the distance between the inner rim of first side 121 which faces the space and the outer rim of second side 121; width W3 of second frame 100*b* is the distance between the inner rim of second side 122 which faces the space and the outer rim of second side 122; and height H3 of second frame 100*b* is the distance between the inner rim of third side 123 which faces the space and the outer rim of third side 123.

In various embodiments, the opening of a respective frame may be aligned in a different direction from the opening of an adjacent frame. This may lead to easy visualization of each object as well as easy insertion and removal of an object from an opening. Furthermore, the growth in size of the device would be in two different dimensions as objects are inserted into the openings. This effect is illustrated in device 1000, wherein second frame 100*b* differs from first frame 100*a* in that the second opening 104*b* is substantially orthogonal to the first opening 104*a*. Consequently, when a first planar object 102*a* is received in the first opening 104*a*, the first planar object 102*a* may come out from the direction indicated by arrow X1. In contrast, when a second planar object 102*b* is received in the second opening 104*b*, the second planar object 102*b* may come out from the direction indicated by arrow Y1. As openings 104*a* and 104*b* are aligned orthogonally to each other, the growth in size of the device 1000 would be in two different dimensions as planar objects are inserted into the orthogonal openings 104*a* and 104*b*.

In various embodiments and as shown in FIG. 3(*c*), there may be a third frame 100*c* having a third opening 104*c* that is aligned in a different direction from the adjacent frame, 100*b*. Third frame 100*c* may further comprise a first side 111', a second side 112' and a third side 113' that define a space capable of accommodating a third planar object 102*c*, such that the first side 111' and the second side 112' form an edge 114, while the second side 112' and the third side 113' form another edge 114'. The third opening 104*c* leads to the space capable of accommodating the third planar object 102*c*. As shown in FIG. 3(*c*), third opening 104*c* is substantially orthogonal to the second opening 104*b*. Consequently, when a third planar object 102*c* is received in the third opening 104*c*, the third planar object 102*c* comes out from the direction indicated by arrow X1. As shown in FIG. 3(*c*), width W1' of third frame 100*c* is the distance between the inner rim of first side 111' which faces the space and the outer rim of first side 111'; height H1' of third frame 100*c* is the distance between the inner rim of second side 112' which faces the space and the outer rim of second side 112'; and width W2' of third frame 100*c* is the distance between the inner rim of third side 113' which faces the space and the outer rim of third side 113'.

In various embodiments, third opening 104*c* is aligned parallel to first opening 104*a*. In other words, third opening 104*c* may not be aligned in a different direction from first opening 104*a*. Consequently, third frame 100*c* has an identical or substantially similar arrangement as first frame 100*a*.

In various embodiments, there may be a fourth frame 100*d* having a fourth opening 104*d* that is aligned in a different direction from the adjacent frame, 100*c*. Fourth frame 100*d* may further comprise a first side 121', a second side 122' and a third side 123' that define a space capable of accommodating a fourth planar object 102*d*, such that the first side 121' and the second side 122' form an edge 124, while the second side 122' and the third side 123' form another edge 124'. The fourth opening 104*d* leads to the space capable of accommodating the fourth planar object 102*d*. As shown in FIG. 3(*d*), fourth opening 104*d* is substantially orthogonal to the third opening 104*c*. Consequently, when a fourth planar object 102*d* is received in the fourth opening 104*d*, the fourth planar object 102*d* comes out from the direction indicated by arrow Y1. As shown in FIG. 3(*d*), height H2' of fourth frame 100*d* is the distance between the inner rim of first side 121' which faces the space and the outer rim of second side 121'; width W3' of fourth frame 100*d* is the distance between the inner rim of second side 122' which faces the space and the outer rim of second side 122'; and height H3' of fourth frame 100*d* is the distance between the inner rim of third side 123' which faces the space and the outer rim of third side 123'.

In various embodiments, fourth opening 104*d* may be aligned parallel to or in a different direction from second opening 104*b*. For instance, when fourth frame 100*d* is placed adjacent to third frame 100*c* such that the third side 113' is adjacent to fourth opening 104*d* and/or the space for accommodating fourth planar object 102*d*, second frame 100*b* may be placed adjacent to third frame 100*c* such that the third side 113' is also adjacent to second opening 104*b* and/or the space for accommodating second planar object 102*b*. In such a configuration, fourth opening 104*d* is aligned parallel to second opening 104*b* and third side 113' acts as an object retaining member for maintaining second planar object 102*b* and fourth planar object 102*d* in the space of second frame 100*b* and fourth frame 100*d*, respectively. Alternatively, when fourth frame 100*d* is placed adjacent to third frame 100*c* such that the third side 113' is adjacent to fourth opening 104*d* and/or the space for accommodating fourth planar object 102*d*, second frame 100*b* may be placed adjacent to third frame 100*c* such that the first side 111' is adjacent to second opening 104*b*. In such a configuration, fourth opening 104*d* is aligned in a different direction to second opening 104*b* and both first side 111' and third side 113' act as an object retaining member for maintaining second planar object 102*b* in the space of second frame 100*b* and fourth planar object 102*d* in the space of fourth frame 100*d*, respectively. Consequently, fourth frame 100*d* may have an identical or different arrangement as second frame 100*b*.

More advantageously and in various embodiments, the device 1000 can be extended along the directions indicated by arrow X1 and Y1 to accommodate more objects. In contrast, prior art device P1000 can be extended in only one direction (X1) to accommodate more objects. It may thus be appreciated that the extension of device 1000 in multiple directions, for instance X1 and Y1, results in a more flexible arrangement with respect to how the device 1000 may be extended. In some embodiments, the extension of the device 1000 in a direction may be halved compared to prior art device P1000.

In various embodiments, the size of each frame is a matter of choice and is dependent on the size of the object. Preferably, each frame is suitably sized such that the opening of the frame can accommodate an object, such as a standard sized credit card, in a fitting manner. Each frame may be suitably sized such that the space for accommodating the object can accommodate the object in a fitting manner. Consequently, each frame may fittingly accommodate each object so that the overall dimensions of the device 1000 may be minimized and the device 1000 may be slim.

Figure 4A:
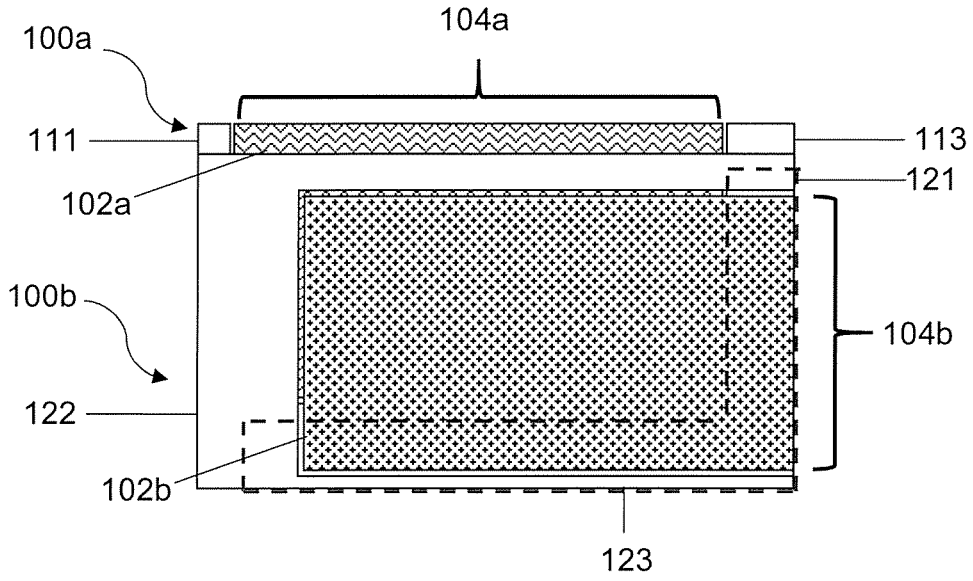
FIGS. 4(*a*) to 4(*c*) illustrate the arrangement of four frames relative to one another, in accordance with an embodiment of the invention.
Figure 4B:
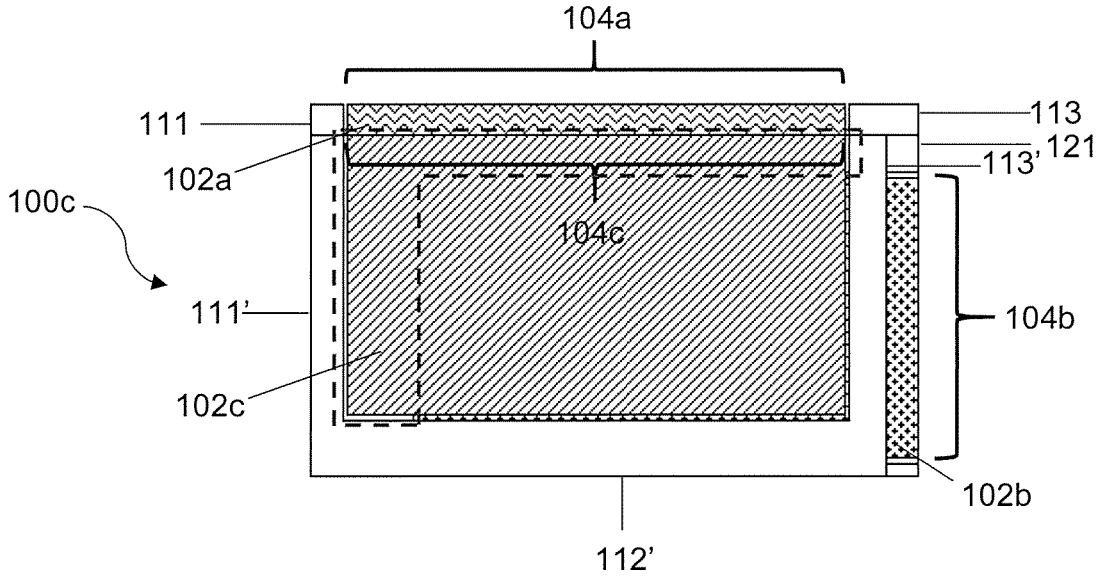
Figure 4C:
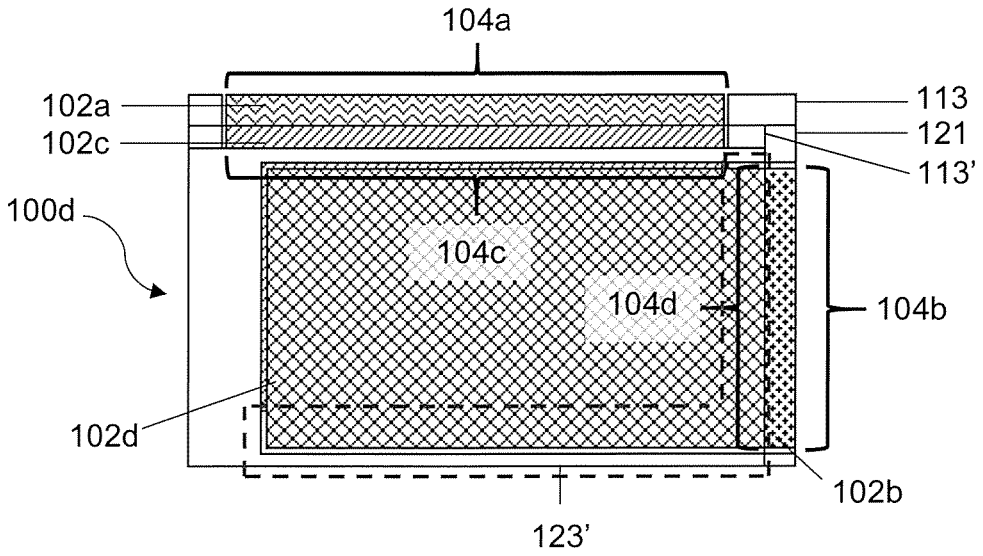

In various embodiments and as shown in FIGS. 4(*a*) to 4(*c*) and 5, the first frame 100*a*, second frame 100*b*, third frame 100*c* and fourth frame 100*d* may be sized such that the dimensions of each frame allow at least a portion of the planar object to be seen when the first frame 100*a*, second frame 100*b*, third frame 100*c* and fourth frame 100*d* are attached adjacently to each other to form device 1000. As such, when at least two frames are attached adjacently to each another to form device 1000 and an object is received in the space of the at least two frames, an object in any one of the frames is easily visible, thereby making it easy for the user to identify the object received in the space of the respective frame in a convenient and efficient manner. This advantageously allows a user to identify the planar object without removing it from the respective frame.

In various embodiments, the dimensions of each frame may differ from each other. For instance and as shown in FIG. 3(*a*), the width W1 of first frame 100*a* is different from the height H1 of first frame 100*a*, which is in turn different from the width W2 of first frame 100*a*. Similarly, the second frame 100*b*, third frame 100*c* and fourth frame 100*d* are configured such that the thickness of the first side (H2, H2'), second side (W3, H1', W3') and third side (H3, W2', H3') are different from each other.

Furthermore, the height H1 of first frame 100*a* is different from the height H3 of second frame 100*b* (FIGS. 3(*a*) and 3(*b*)). In particular, the height H1 of first frame 100*a* is greater than the height H3 of second frame 100*b*. Advantageously, this may allow at least a portion of the first planar object 102*a* to be seen when the second frame 100*b* is placed on top of the first frame 100*a*.

For instance and as shown in FIGS. 3(*a*) to 3(*c*), the height H1 of first frame 100*a* is greater than the height H1' of third frame 100*c* and the height H1' is greater than the height H3 of second frame 100*b*. Advantageously, this may allow at least a portion of the first planar object 102*a* and the second planar object 102*b* to be seen when the third frame 100*c* is placed on top of the second frame 100*b*.

For instance and as shown in FIGS. 3(*a*) to 3(*d*), the height H3' of fourth frame 100*d* is smaller than each of the height H1 of first frame 100*a*, the height H3 of second frame 100*b* and the height H1' of third frame 100*c*. Advantageously, this may allow at least a portion of the first planar object 102*a*, the second planar object 102*b* and the third planar object 102*c* to be seen when the fourth frame 100*d* is placed on top of the second frame 100*b*.

It thus follows that each frame is configured such that the thickness of the first side (W1, H2, H2'), the second side (H1, W3, H1', W3') and the third side (W2, H3, W2', H3') of the respective frame may be different from that of the first side (W1, H2, W1', H2'), the second side (H1, W3, H1', W3') and the third side (W2, H3, W2', H3') of the adjacent frame. In other words, the thickness of the first side of the respective frame may be different from the thickness of the first side of the adjacent frame, the thickness of the second side of the respective frame may be different from the thickness of the second side of the adjacent frame, and/or the thickness of the third side of the respective frame may be different from the thickness of the third side of the adjacent frame. Importantly, the dimensions of each frame may be adjusted so that a user can identify the planar object without removing it from the respective frame.

In various embodiments, each frame may be transparent, translucent or opaque. In various embodiments, each frame may be made from a material comprising at least one of plastic, plastic composite, metal or metal alloy. In a preferred embodiment, the material of each frame is lightweight and durable. Consequently, the device 1000 may be easily carried around by the user and can be used for a long period of time.

In various embodiments and as shown in FIGS. 4(*a*) to 4(*c*), the first frame 100*a*, second frame 100*b*, third frame 100*c* and fourth frame 100*d* may be attached adjacently to each other, by an adhesive, fastening or other suitable means, such that the opening of one frame is substantially orthogonal to the opening of an adjacent frame. As shown in FIG. 4(*a*), when the second frame 100*b* is placed on top of the first frame 100*a* such that the bottom face of second frame 100*b* directly contacts the top face of first frame 100*a*, the first opening 104*a* is substantially orthogonal to the second opening 104*b*. Advantageously, when a planar object is inserted into either or both the first opening 104*a* and the second opening 104*b*, the planar object may be securely held within the space defined by the frame.

In various embodiments, the planar object may be securely held within the space defined by the frame because the first opening 104*a* and/or the space for accommodating the first planar object 102*a* is adjacent to the first side 121 of second frame 100*b*, such that first side 121 acts as an object retaining member to securely hold first planar object 102*a* within the space defined by first frame 100*a*. In addition, each frame may help prevent the object in a frame from falling into the space of an adjacent frame, thereby maintaining the object in the space of the frame.

Furthermore, when a second planar object 102*b* is inserted into the second opening 104*b*, the second opening 104*b* is adjacent to the third side 113 of first frame 100*a*, such that third side 113 acts as an object retaining member to securely hold second planar object 102*b* within the space defined by second frame 100*b*. More advantageously, the second side 112 of first frame 100*a* forms a L-shape configuration (as indicated by the dotted line in FIG. 4(*a*)) with the third side 113 of first frame 100*a*. The L-shape configuration further aids in securely holding second planar object 102*b* within the space defined by second frame 100*b*. Thus, the second planar object 102*b* may be effectively maintained in the space of second frame 100*b*.

In various embodiments and as shown in FIGS. 4(*a*) and 4(*b*), the thickness of the object retaining member of a respective frame (such as first side 121 of second frame 100*b*) is different from the thickness of the object retaining member of the adjacent frame (such as third side 113 of first frame 100*a*).

In various embodiments and as shown in FIGS. 2 and 4(*b*), when the third frame 100*c* is placed on top of the second frame 100*b* such that the bottom face of third frame 100*c* directly contacts the top face of second frame 100*b*, the third opening 104*c* may be substantially orthogonal to the second opening 104*b*. Advantageously, a planar object may be securely held within the space defined by the second frame 100*b* because second opening 104*b* is adjacent to a third side 113' of third frame 100*c*, such that third side 113' acts as an object retaining member to securely hold second planar object 102*b* within the space defined by second frame 100*b*. Consequently, both sides of the second opening 104*b* is supported by at least a side of the two adjacent frames (third side 113 of first frame 100*a* and third side 113' of third frame 100*c*). More advantageously, the second side 112' of third frame 100*c* forms a L-shape configuration with the third side 113' of third frame 100*c*. The L-shape configuration further aids in securely holding second planar object 102*b* within the space defined by second frame 100*b* (as indicated by the dotted line in FIG. 4(*b*)). Consequently, both sides of the second opening 104*b* is supported by a L-shape configuration formed by each of the two adjacent frames, first frame 100*a* and third frame 100*c*. Thus, the second planar object 102*b* may be effectively maintained in the space of second frame 100*b*.

Accordingly, the L-shape configuration described above may be found in any two adjacent frames of the invention, as indicated by the dotted lines in FIGS. 4(*a*), 4(*b*) and 4(*c*). Consequently and advantageously, collision with the sides of any two adjacent frames is avoided or minimized when a planar object is inserted into the space defined by a frame.

FIGS. 4(*a*) to 4(*c*) illustrate the relative orientation of frames 100*a*, 100*b*, 100*c* and 100*d* in accordance with an embodiment of the invention. It is contemplated that the sequence of frames 100*a*, 100*b*, 100*c* and 100*d* of device 1000 may be reversed. Accordingly, exemplary, non-limiting embodiments of the device will now be disclosed using device 2000 as an illustration, wherein the sequence of the frames 200*a*, 200*b*, 200*c* and 200*d* of device 2000 is the opposite of frames 100*a*, 100*b*, 100*c* and 100*d* of device 1000. It should be understood that the embodiments of device 2000 may be present in device 1000. Similarly, the embodiments of device 1000 may be present in device 2000.

Figure 5:
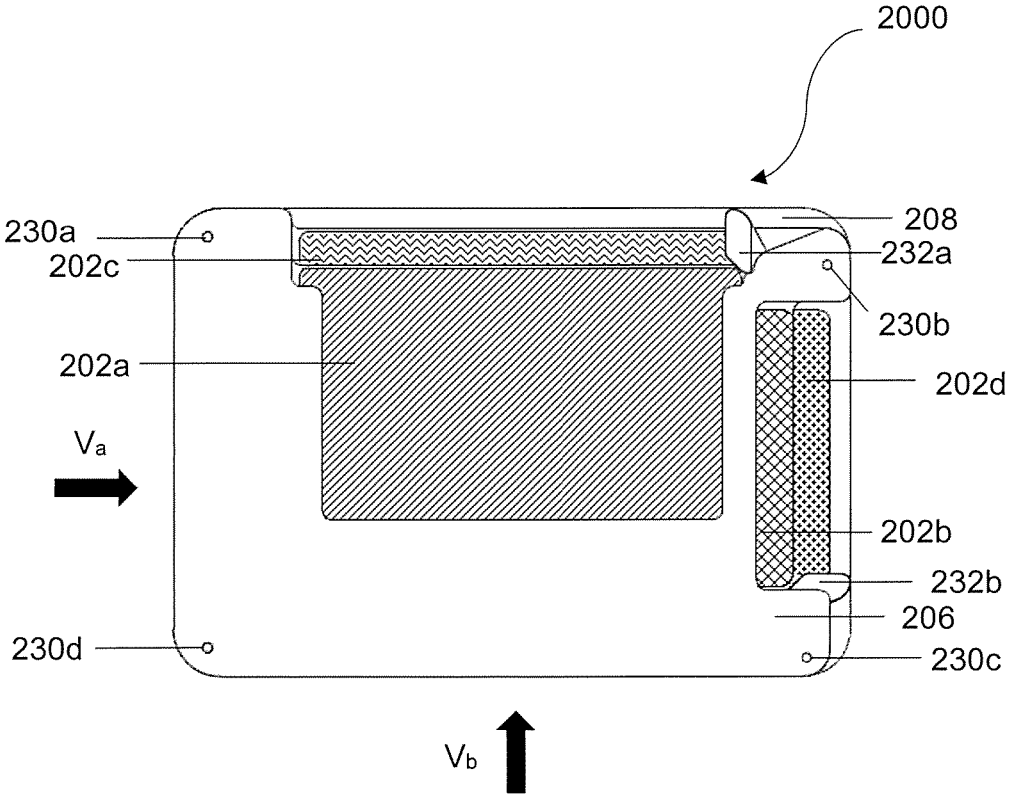
FIG. 5 illustrates a view of a device for holding cards in accordance with another embodiment of the invention, the device having a front frame, a first frame, a second frame, a third frame, a fourth frame and a backing.
Figure 6A:
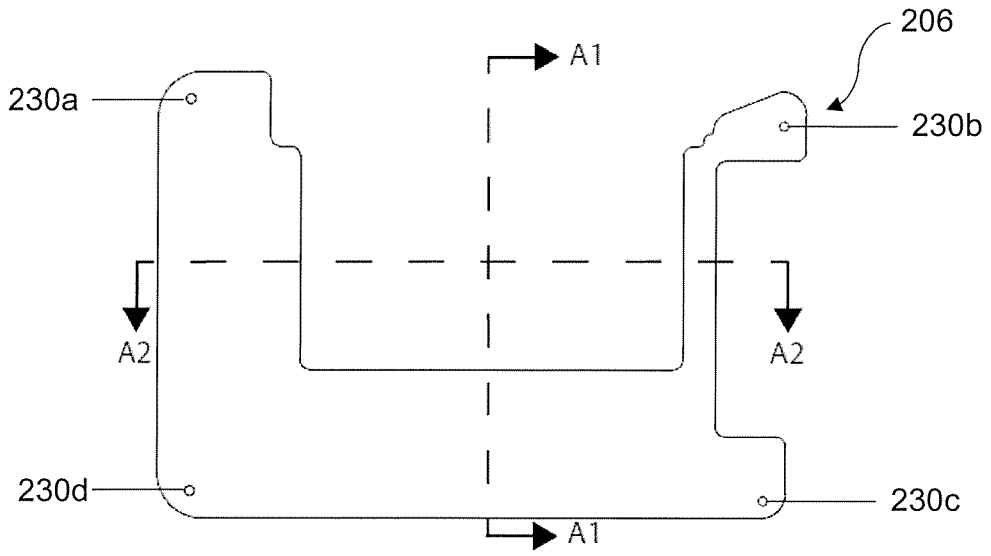
FIGS. 6(*a*) to 6(*f*) illustrate a view of the front frame, the first frame, the second frame, the third frame, the fourth frame and the backing of FIG. 5.
Figure 6B:
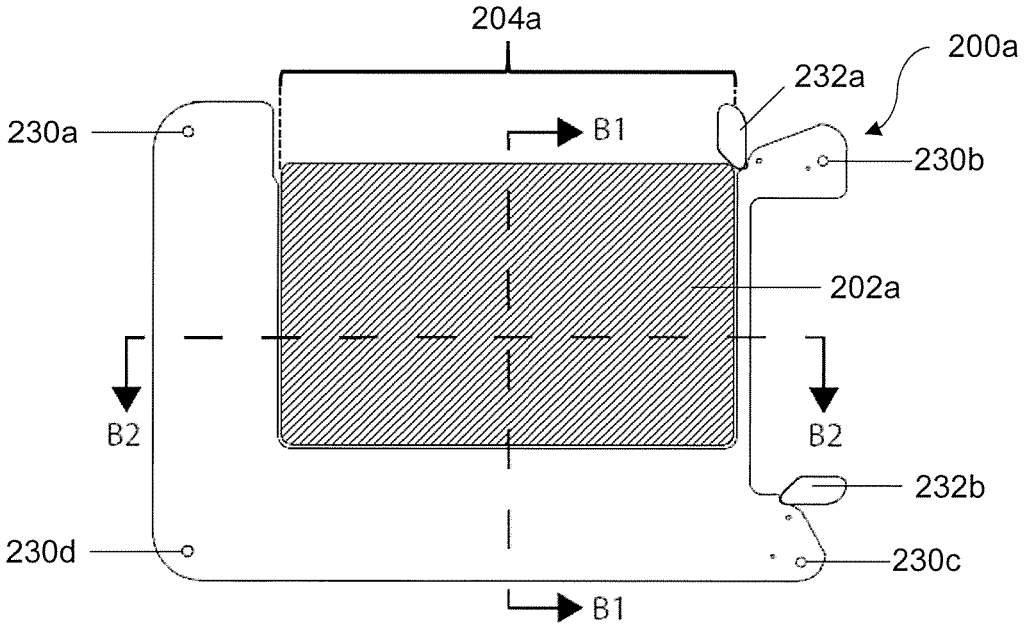
Figure 6C:
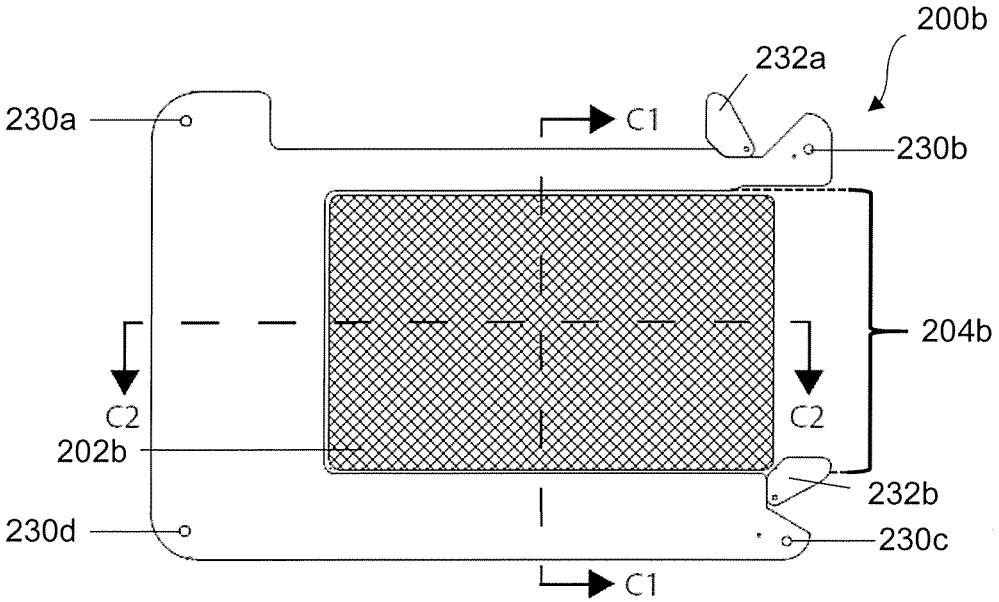
Figure 6D:
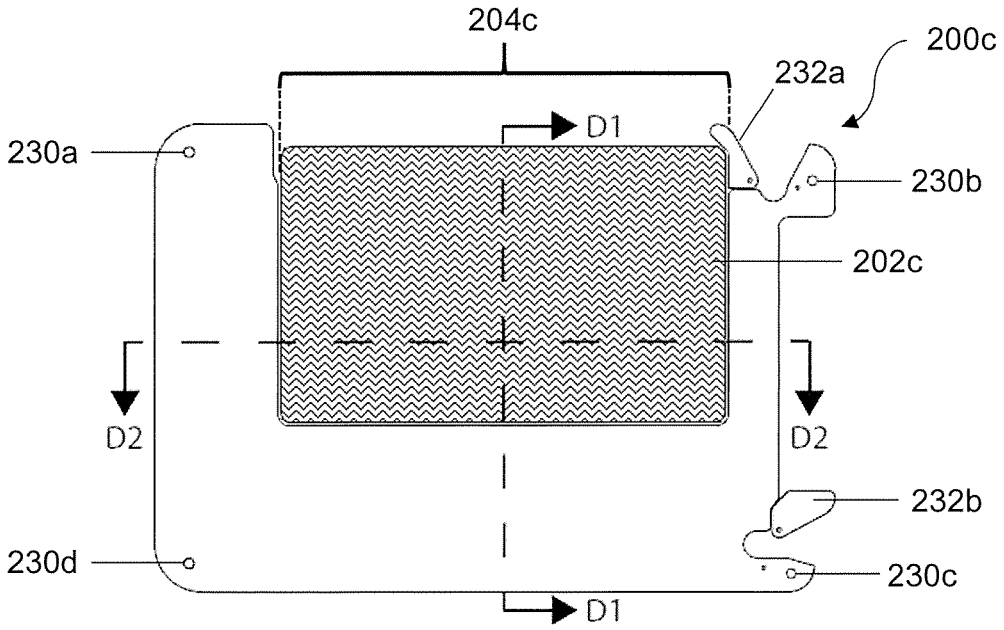
Figure 6E:
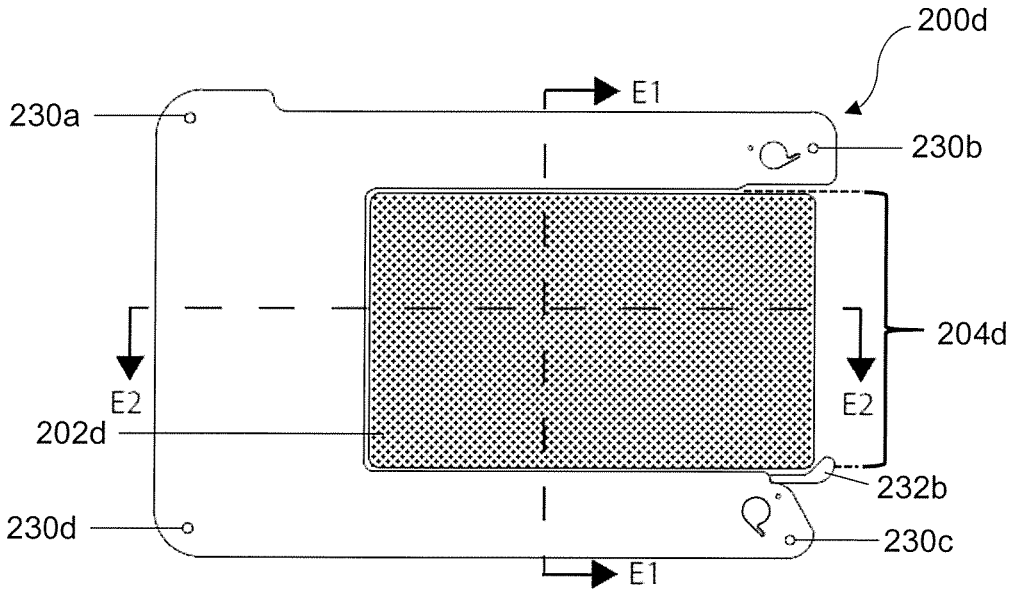
Figure 6F:
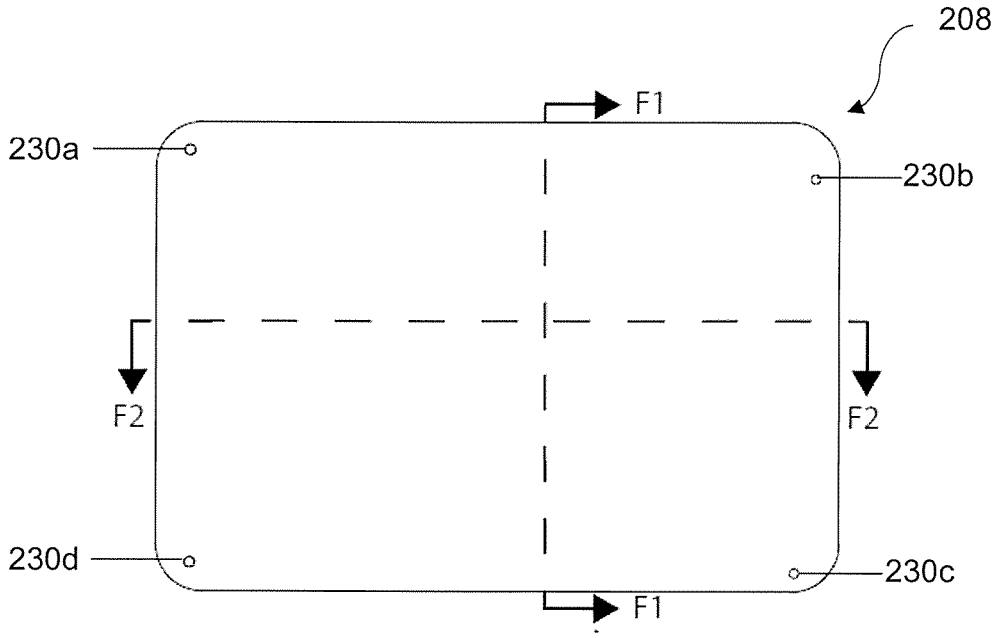
Figure 7A:
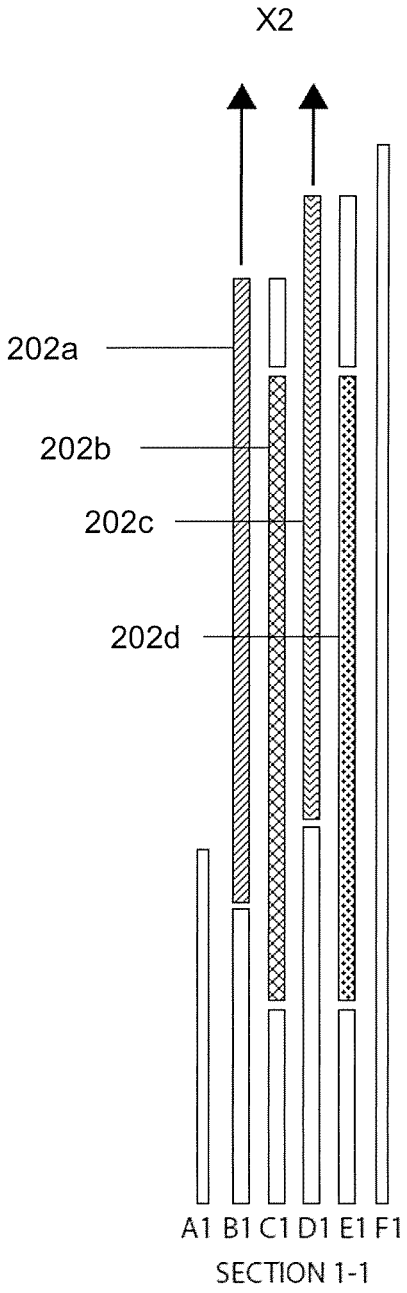
FIG. 7(*a*) is a sectional view of FIG. 5 viewed from $V_a$, showing that first planar object 202*a* and third planar object 202*c* would come out from the direction X2.
Figure 7B:
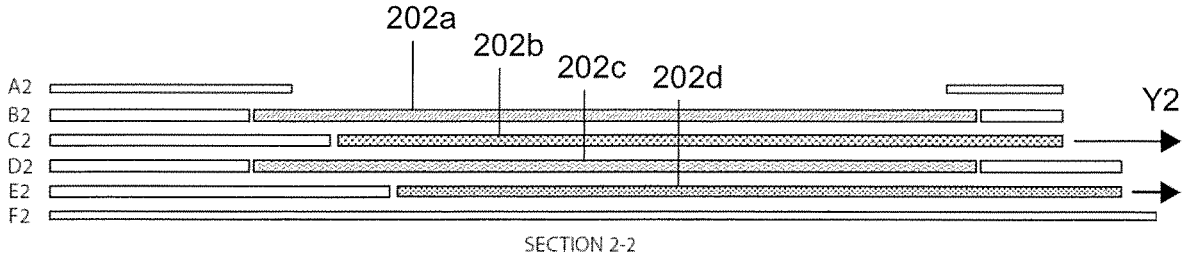

In various embodiments and as shown in FIGS. 5 to 7, the device 2000 may comprise a first frame 200*a* configured to receive a first planar object 202*a*, a second frame 200*b* configured to receive a second planar object 202*b*, a third frame 200*c* configured to receive a third planar object 202*c*, a fourth frame 200*d* configured to receive a fourth planar object 202*d*, a front frame 206, and a backing 208, such that the first frame 200*a*, the second frame 200*b*, the third frame 200*c* and the fourth frame 200*d* are placed between the front frame 206 and the backing 208.

In various embodiments and as shown in FIG. 5, each of the front frame 206, backing 208, first frame 200*a*, the second frame 200*b*, the third frame 200*c* and the fourth frame 100*d* has an eyelet 230 (230*a*, 230*b*, 230*c*, 230*d*) positioned at each of the four corners, which extends from the front side to the back side of each of the front frame 206, the backing 208, the first frame 200*a*, the second frame 200*b*, the third frame 200*c* and the fourth frame 200*d*. Eyelet 230 facilitates the assembly of the front frame 206, the first frame 200*a*, the second frame 200*b*, the third frame 200*c*, the fourth frame 200*d* and backing 208 to form a device 2000 for holding planar objects.

Figure 8:
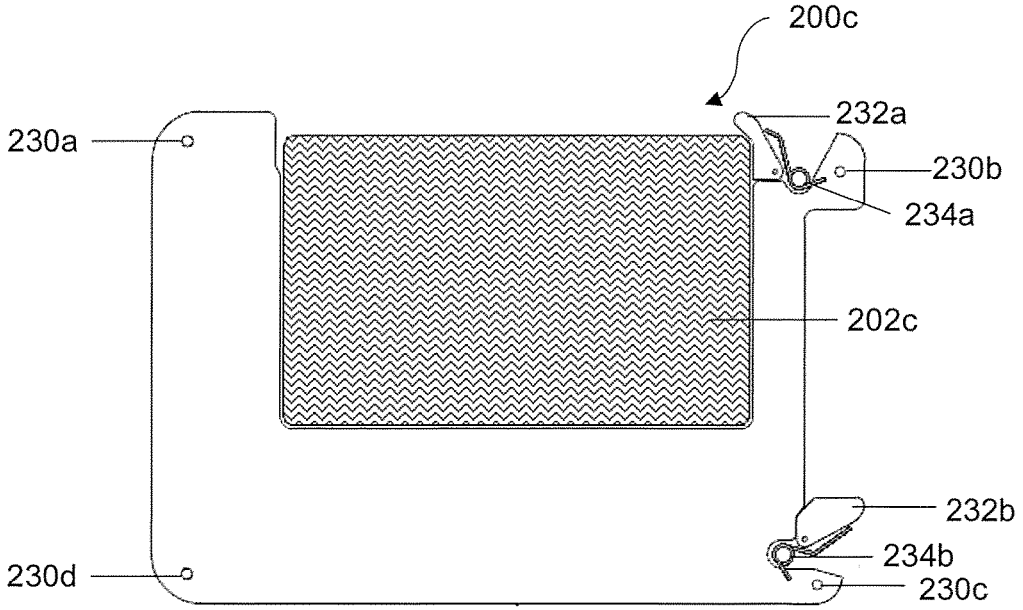
FIG. 8 illustrates a view of third frame 200*c*, showing the orientation of levers 232*a* and 232*b* and springs 234*a* and 234*b*.

In various embodiments, the device 2000 may further comprise a locking mechanism between the front frame and the backing capable of maintaining the object in the space of each frame. In a preferred embodiment, the locking mechanism comprises at least one lever, for instance lever 232*a* (or an equivalent means) at an edge, such that the lever 232*a* acts as an object retaining means for maintaining a planar object in the space of a frame. For instance, and as shown in FIGS. 5, 6 and 8, lever 232*a* is capable of contacting the first planar object 202*a* at an angle, preferably an angle of about 45°, thereby abutting the first planar object 202*a* within the space defined by first frame 200*a*. In various embodiments, the lever 232*a* may simultaneously contact the third planar object 202*c* at an angle, preferably an angle of about 45°, thereby abutting the third planar object 202*c* within the space defined by third frame 200*c*.

Advantageously, the lever 232*a* may allow the user to manually release planar objects 202*a* and/or 202*c* by pushing the lever 232*a* in a direction away from the planar object, for instance, towards eyelet 230*b*. Consequently, the lever 232*a* would no longer abut the planar objects (202*a* and 202*c*) at an angle, and the planar objects (202*a* and 202*c*) may easily slide out from the confines of the respective frame. Alternatively, the user may conveniently pull the planar object directly out through the respective opening, thereby pushing against the lever 232*a* and in a direction away from the planar object, for instance, towards eyelet 230*b*.

In various embodiments, the locking mechanism of device 2000 may further comprise a lever 232*b* (or an equivalent means) at an edge, such that the lever 232*b* acts as an object retaining means for maintaining a planar object in the space of a frame. For instance, and as shown in FIGS. 5, 6 and 8, lever 232*b* is capable of contacting the second planar object 202*b* at an angle, preferably an angle of about 45°, thereby abutting the second planar object 202*b* within the space defined by second frame 200*b*. In various embodiments, the lever 232*b* may simultaneously contact the fourth planar object 202*d* at an angle, preferably an angle of about 45°, thereby abutting the fourth planar object 202*d* within the space defined by fourth frame 200*d*.

Advantageously, the lever 232*b* may allow the user to manually release planar objects 202*b* and/or 202*d* by pushing the lever 232*b* in a direction away from the planar object, for instance, towards eyelet 230*c*. Consequently, the lever 232*b* would no longer abut the planar objects (202*b* and 202*d*) at an angle of about 45°, and the planar objects (202*b* and 202*d*) may easily slide out from the confines of the respective frame. Alternatively, the user may conveniently pull the planar object directly out through the respective opening, thereby pushing against the lever 232*b* and in a direction away from the planar object, for instance, towards eyelet 230*c*.

Advantageously, the levers 232*a* and 232*b* do not increase the overall thickness of the device 2000.

In various embodiments and as an alternative to levers 232*a* and 232*b*, the locking mechanism of device 2000 may be a spring mechanism capable of holding the side of a planar object by friction (not illustrated). However, the frictional force sufficient to hold the planar object from falling out of the device 2000 due to vigorous movement may result in damage of the planar object when the planar object is repeatedly removed and inserted. As such, the use of a spring mechanism is not as advantageous as levers 232*a* and 232*b*.

In various embodiments and as an alternative to levers 232*a* and 232*b*, each of the front frame 206, backing 208, first frame 200*a*, the second frame 200*b*, the third frame 200*c* and the fourth frame 100*d* may be independently lined with a layer of material, such as a thin, elastic material. Consequently, the layer of material may increase the amount of friction and aid in holding the planar object within the confines of the frame (not illustrated). Alternatively, the surface of each of the front frame 206, backing 208, first frame 200*a*, the second frame 200*b*, the third frame 200*c* and the fourth frame 100*d* may be roughened to increase the amount of friction and aid in holding the planar object within the confines of the frame (not illustrated). However, the surface of the planar object may be scratched overtime due to the increased friction. As such, the use of a lining of material or roughening of the frame(s) is not as advantageous as levers 232*a* and 232*b*.

In various embodiments and as shown in FIGS. 7(*a*) and 7(*b*), the first opening 204*a*, the second opening 204*b*, the third opening 204*c* and the fourth opening 204*d* are adapted to receive a planar object each, such that the opening of one frame is orthogonal to the opening of another frame. As an illustrative example, when a first planar object 202*a* and a third planar object 202*c* are received in the first opening 204*a* and the third opening 204*c* respectively, the first planar object 202*a* and the third planar object 202*c* may come out from the direction indicated by arrow X2 (FIG. 7(*a*)). In contrast and as shown in FIG. 7(*b*), when a second planar object 202*b* and a fourth planar object 202*d* are received in the second opening 204*b* and the fourth opening 204*d* respectively, the second planar object 202*b* and the fourth planar object 202*d* may come out from the direction indicated by arrow Y2. Thus, the growth in size of the device 2000 would be in two different dimensions as objects are inserted into the openings. This is because as the planar objects are inserted into the openings of device 2000, the increase in dimensions of device 2000 is in two different directions, i.e. along the direction of arrows X2 and Y2. Consequently, compared to prior art device P1000, when planar objects are received in the openings (204*a*, 204*b*, 204*c*, 204*d*) of device 2000, the growth in dimensions of the device 2000 is halved.

In various embodiments and as shown in FIG. 8, the third frame 200*c* (or any one of the frames) may further comprise a spring 234*a* (or an equivalent means), which may be attached to the lever 232*a* at one end and a part of the frame 200*c* at another end, such that the spring 234*a* is capable of being compressed by the lever 232*a*, which consequently results in the release of the planar object from the frame 200*c*. Third frame 200*c* may further comprise another spring 234*b* (or an equivalent means), which may be attached to the lever 232*b* at one end and a part of the frame 200*c* at another end, such that the spring 234*b* is capable of being compressed by the lever 232*b*, which consequently results in the release of a planar object from an adjacent frame. Advantageously, the springs 234*a* and 234*b* do not increase the overall thickness of the device 2000. In addition, the springs 234*a* and 234*b* may secure each planar object from sliding out of the respective opening without scratching or damaging any of the objects.

In various embodiments, the device for holding objects may comprise a wallet. Exemplary, non-limiting embodiments of a wallet will now be disclosed using wallet 3000 as an illustration. The wallet 3000 may comprise a device for holding planar objects, such as device 2000 described above, wherein the device for holding planar objects is releasably attachable to a first shell cover, such as first shell cover 300, and/or a second shell cover, such as second shell cover 302.

In various embodiments and as shown in FIGS. 9 to 17, wallet 3000 may comprise a first shell cover 300, a central piece 301 and a second shell cover 302, a joint 304*a* pivotally connecting the first shell cover 300 to the central piece 301 and a joint 304*b* pivotally connecting the second shell cover 302 to the central piece 301 at the edges. The wallet 3000 may further comprise a device for holding planar objects, such as device 2000 described above, which may be connected to the second shell cover 302 via the joint 304*b*. In various embodiments, the device 2000 may be connected to the second shell cover 302 by another means such as an adhesive means like glue or an attachment means like screws. Consequently, the wallet 3000 may have at least one compartment for coins 309*a*, keys 309*b*, bank notes 309*c* and other objects between the device 2000 and the first shell cover 300. In addition, the wallet 3000 may have at least one compartment for coins 309*a*, keys 309*b*, bank notes 309*c* and other objects between the device 2000 and the second shell cover 302.

In various embodiments, the wallet 3000 may further comprise a first barrier 306 and a second barrier 307 connected to the first shell cover 300 and extending from the joint 304*a*. Consequently, the first barrier 306 and the second barrier 307 are capable of pivoting about joint 304*a*. The first barrier 306 and the second barrier 307 are capable of introducing two compartments (308, 310) into the space between the device 2000 and the first shell cover 300. The compartment 308 may be suitable for objects such as (but not limited to) coins 309*a* and keys 309*b*, while the compartment 310 may be suitable for other objects such as (but not limited to) receipts. The number of barriers may vary depending on the number of compartments that are desired. In a preferred embodiment, each barrier, for instance, first barrier 306 and second barrier 307, is thin so that the thickness of the wallet 3000 is minimized.

In various embodiments, the central piece 301 may be optional. This embodiment will be described in further detail in FIGS. 24 to 33. Consequently, the first barrier 306 may be connected to the first shell cover 300 by another means, such as a hinge. In addition, the second barrier 307 may be connected to the first shell cover 300 by another means, such as a hinge.

The size of each compartment, for instance, compartments 308 and 310, may be adjusted as desired, independently of each other. In a preferred embodiment, the compartment 308 may be adapted to be just slightly thicker than a British pound coin so that the wallet 3000 may be kept thin. In another preferred embodiment, each compartment may have stiff and thin walls.

In various embodiments and as shown in FIGS. 9 to 17, the wallet 3000 may further comprise a locking means 312 connected to the first shell cover 300, which is capable of allowing the user to access any one of the two compartments 308 and 310. Advantageously, the locking means 312 may help secure the objects within the compartments 308 and 310, preferably securing the objects in a horizontal position, such that the objects would not fall out. More advantageously, the objects may be laid out in one single layer within the confines of the compartment 308. As such, a user may easily view and access any one object in the compartment 308. In contrast, some prior art wallets may have objects stacked above one another, such that a user is unable to easily view and access all the objects. Furthermore, such prior art wallets may be thicker than the invention, or have more dead space. Dead space may refer to any space between two objects/components or within one object/component that is not being utilized.

In various embodiments and as shown in FIGS. 9 to 17, there may be a compartment 314 between the device 2000 and the second shell cover 302. The compartment 314 may be capable of receiving objects, such as (but not limited to) bank notes 309*c*, such that one end of the bank notes 309*c* may rest in the compartment 314, while the other end of the bank notes 309*c* may be held between the device 2000 and the second barrier 307 (FIG. 9(*a*)).

Advantageously, the bank notes 309*c* may be secured on all sides and fully unfolded when wallet 3000 is in an open position. This may allow the user to easily access the bank notes 309*c* in a neat and organized manner. Furthermore, there would not be any risk of the bank notes 309*c* falling out of the wallet 3000 when it is opened by the user.

Figure 9A:
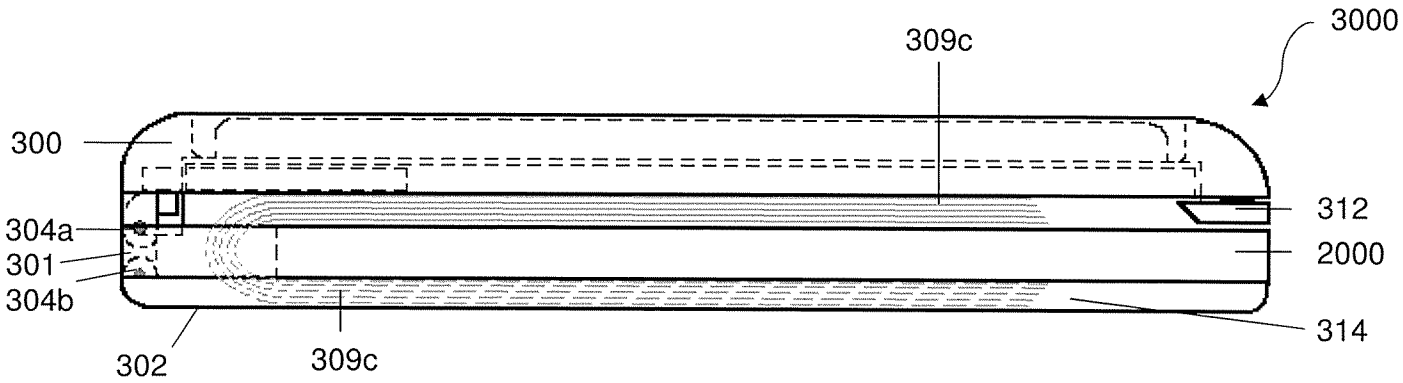
FIG. 9(*a*) illustrates a cross-sectional view of a wallet in accordance with an embodiment of the invention.
Figure 9B:
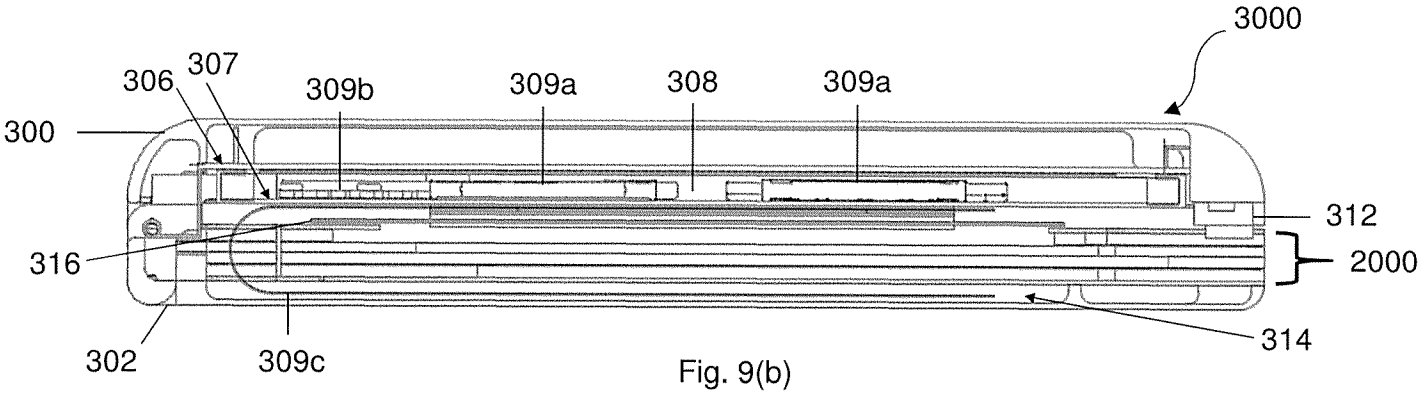

In various embodiments and as shown in FIGS. 9(*a*) and 9(*b*) (collectively known as FIG. 9), the bank notes 309*c* may wrap around the device 2000 in one position. As such, the bank notes 309*c* are secured on all sides and may be unfolded when wallet 3000 is in an open position. Furthermore, dead space in the wallet 3000 may be minimized because the space generated when the bank notes 309*c* are folded is taken up by the device 2000. Without the presence of the device 2000, when the bank notes 309*c* rest in the compartment 314 and the wallet 3000 is in the closed position, there may be dead space between the opposite folded faces of the bank notes 309*c*. In particular, when folded and pressed together, the banknotes 309*c* may structurally resist the sharp change in curvature. As a result a space, i.e. dead space, develops on the inside of the fold. This means that truly packing as many banknotes 309*c* as possible into compartment 314 may create an uneven loading on the surrounding components of the wallet 3000. For instance, there may be difficulty closing the wallet 3000. Furthermore, the inner banknotes 309*c* may also be folded to the point where a crease appears. Thus, the wrapping of the bank notes 309*c* around the device 2000 may ameliorate the afore-mentioned disadvantages.

In various embodiments, the bank notes 309*c* may be held against the second barrier 307 using an object retaining means, such as a hinged clip 316 or another means, which is capable of pressing the bank notes 309*c* against the second barrier 307. As such, the bank notes 309*c* are secured and may be unfolded when wallet 3000 is in an open position. Consequently, any space generated between each of the bank notes may be minimized. The hinged clip 316 may be located on one side of the compartment 307. Advantageously, the hinged clip 316 may be positioned such that dead space within the wallet 3000 is minimized. For instance, the hinged clip 316 may be positioned such that it is adjacent to the device 2000 when the wallet 3000 is in a closed position.

Figure 11:
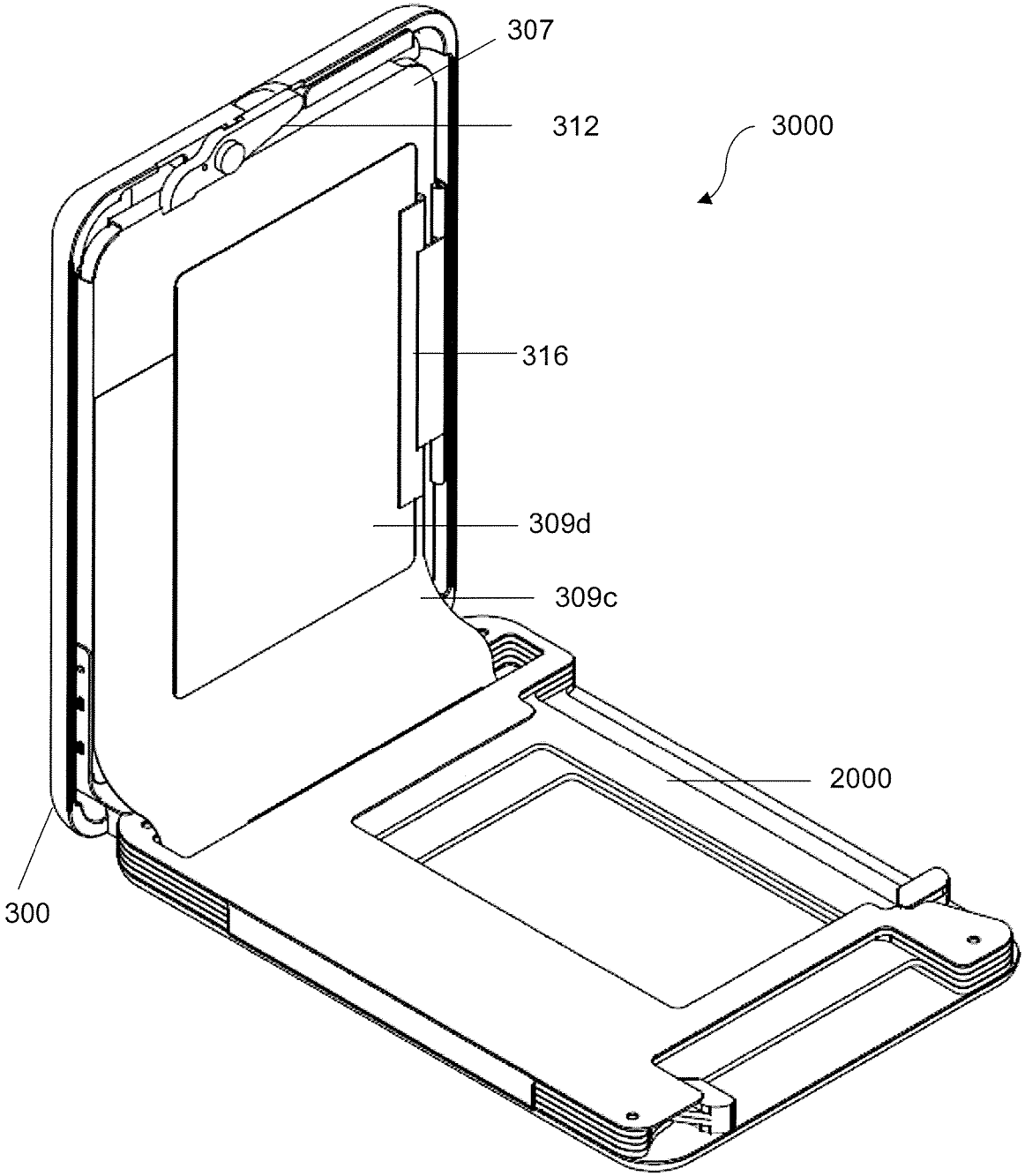
FIG. 11 illustrates a perspective view of the wallet of FIG. 9 in an open position, showing one of the compartments between the first shell cover and the second shell cover.

In various embodiments and as shown in FIG. 11, the hinged clip 316 may be capable of receiving an object, such as (but not limited to) a RFID card 309*d* or any suitably sized card. RFID card users can have trouble scanning multiple RFID cards that are stacked together. This limitation may be overcome because wallet 3000 may comprise a hinged clip 316 that is capable of pressing a RFID card 309*d* against the second barrier 307 and a device 2000 that is capable of receiving a RFID card. Another RFID card may be inserted into any one of the frames (200*a*, 200*b*, 200*c*, 200*d*) of the device 2000. Consequently, the hinged clip 316 advantageously allows a RFID card to be placed on both halves of the wallet 3000. As not all the RFID cards are stacked together, RFID card users may selectively scan a RFID card placed on either half of the wallet 3000 without having any trouble scanning.

RFID card users can have trouble scanning a RFID card that is adjacent to a sizeable piece of material, such as a metallic piece. This limitation may be overcome by the hinged clip 316 that can swing the RFID card away from, for instance, a sizeable metallic piece that is part of the device 2000 or second barrier 307. A sizeable metallic piece may refer to a metallic piece that is sufficiently large to cause a RFID card reader to have trouble scanning a RFID card.

Advantageously, the hinged clip 316 and RFID card 309*d* may synergistically work together and advantageously press against an object, such as (but not limited to) bank notes 309*c* or receipts.

Figure 18A:
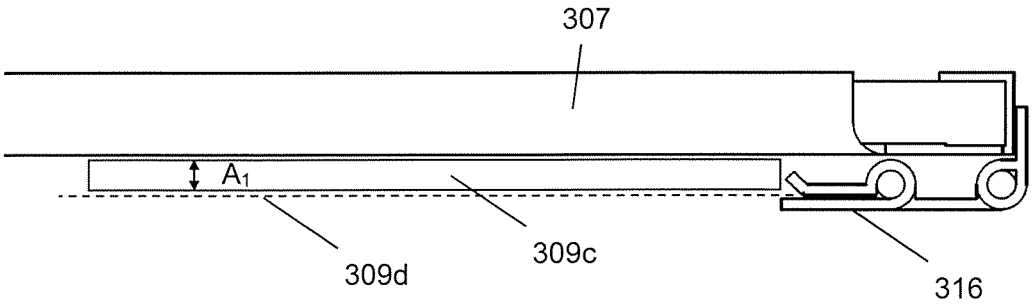
FIG. 18(*a*) illustrates a view of a hinged clip in accordance with an embodiment of the invention pressed against a stack of bank notes having thickness $A_1$.
Figure 18B:
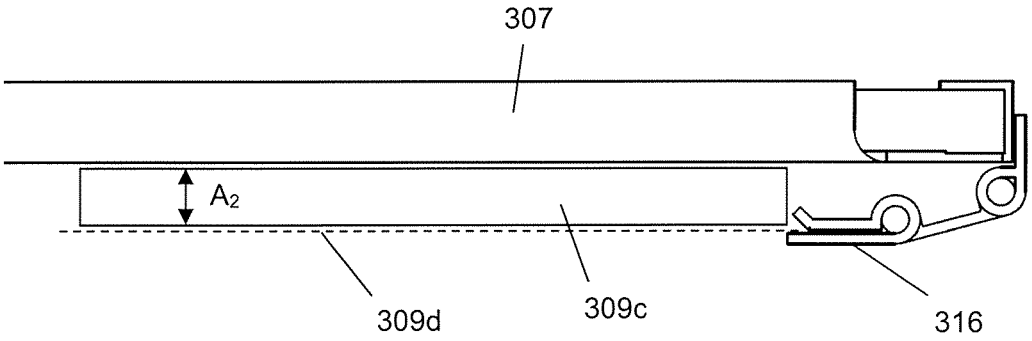
Figure 18C:
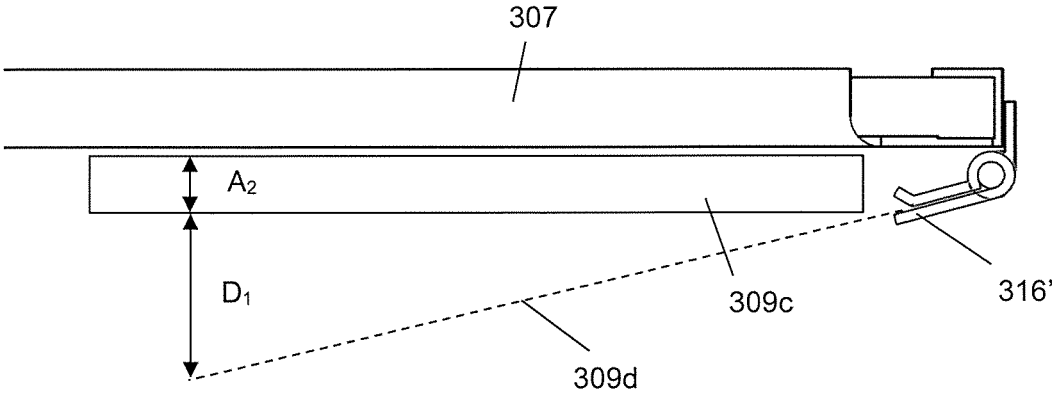
Figure 19:
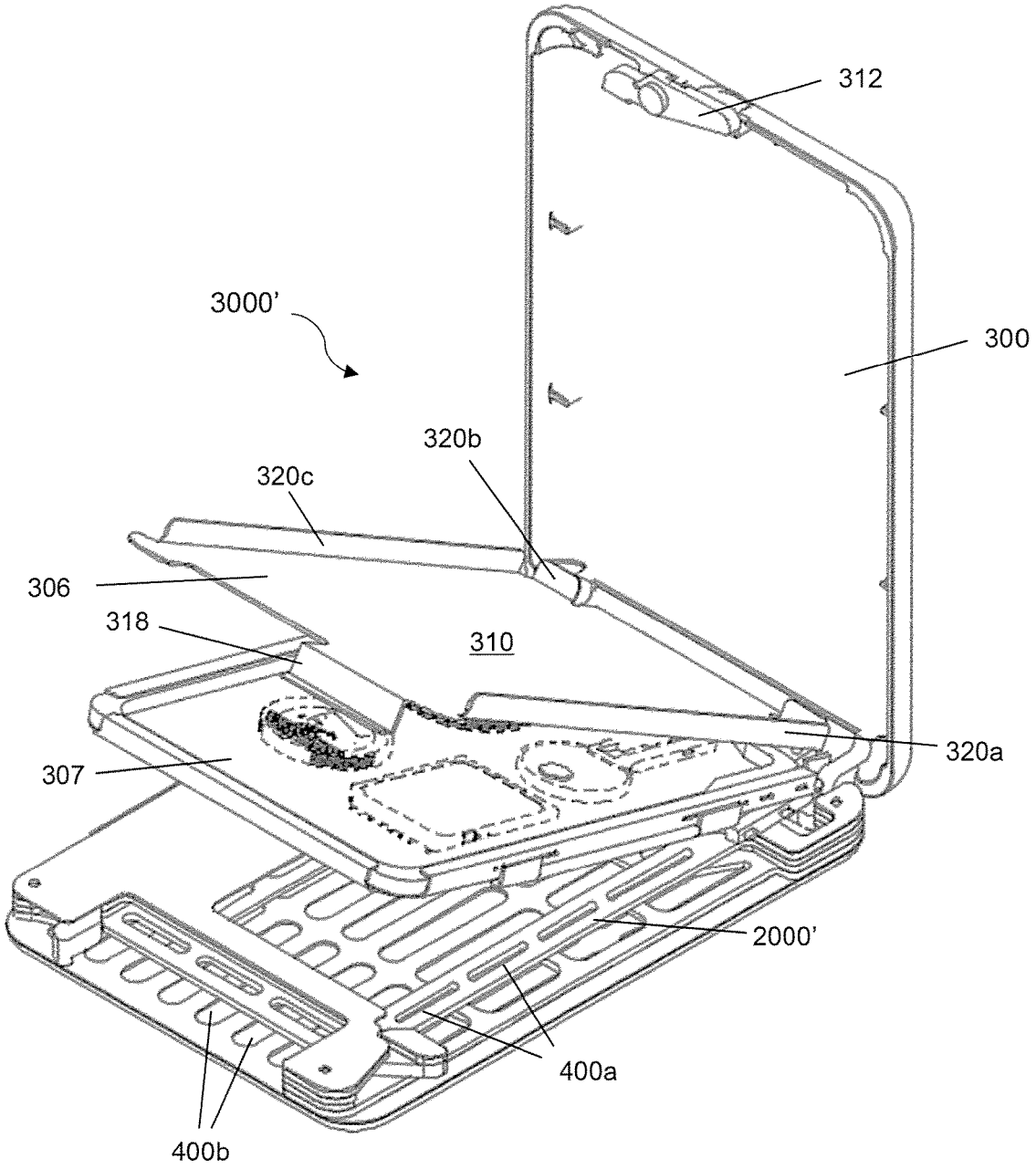
FIG. 19 illustrates a perspective view of a wallet in accordance with another embodiment of the invention in an open position, showing the various compartments between the first shell cover and the second shell cover.
Figure 20:
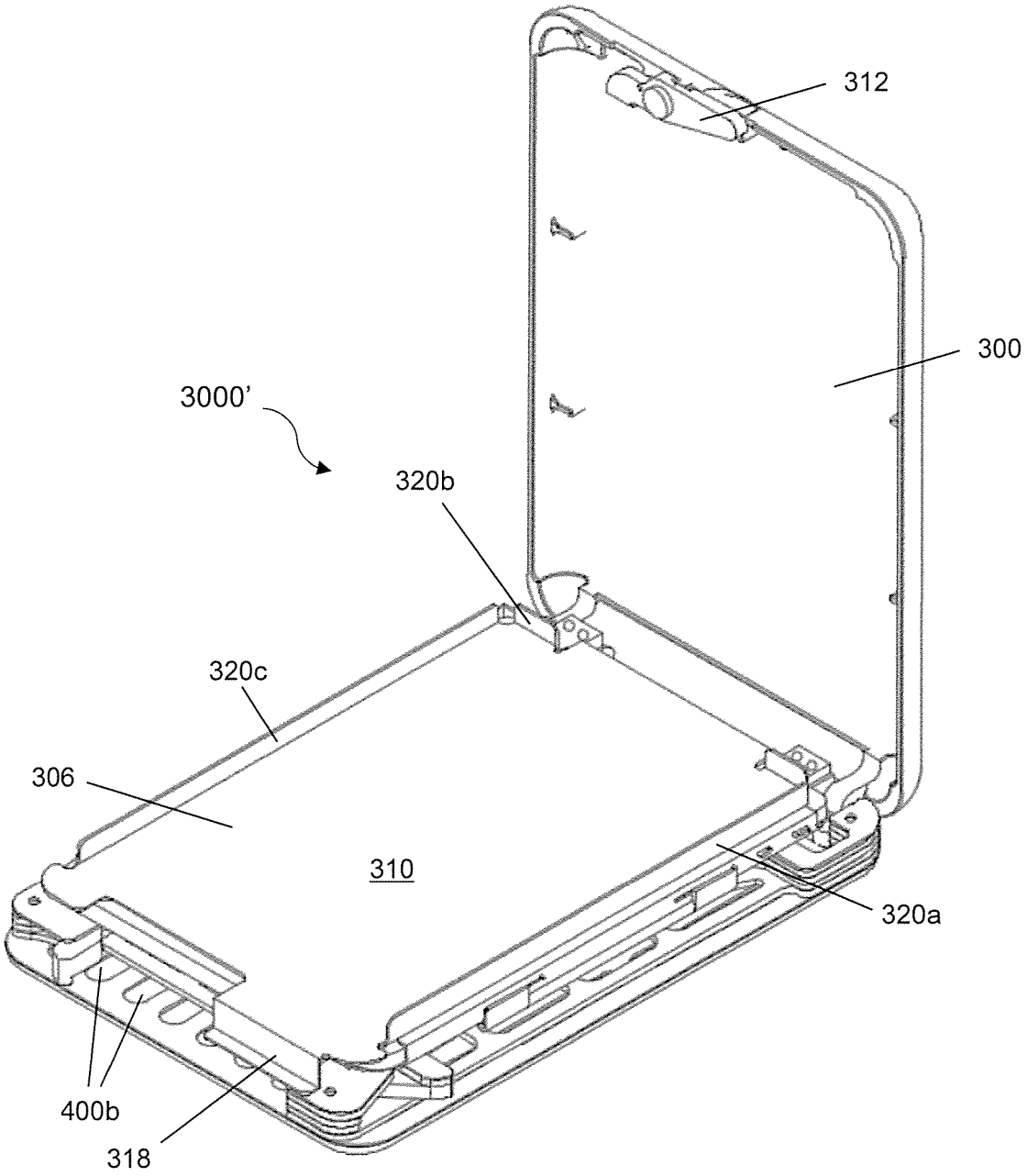
FIG. 20 illustrates a perspective view of the wallet of FIG. 19 in an open position, showing one of the compartments between the first shell cover and the second shell cover.
Figure 21:
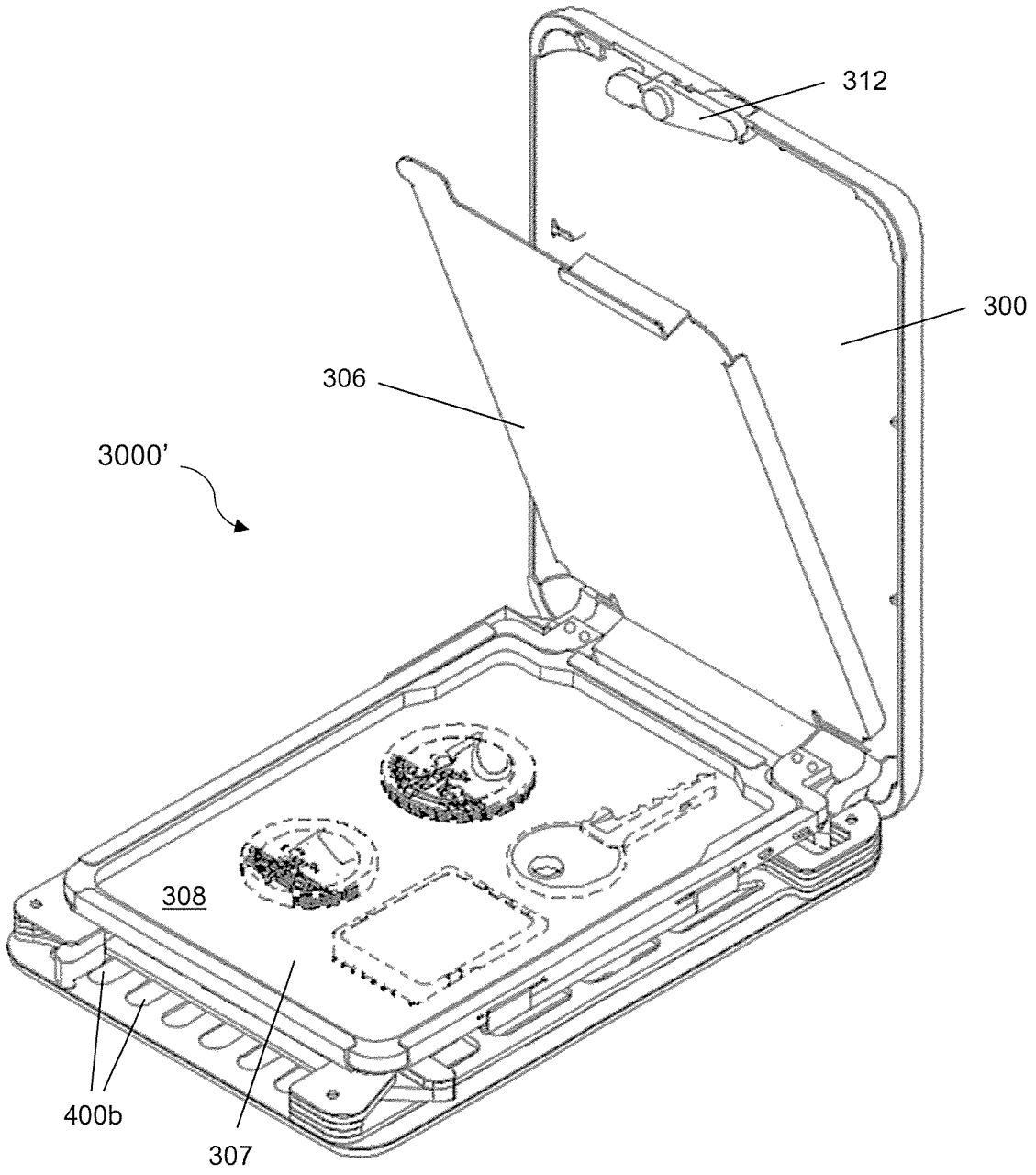
FIG. 21 illustrates a perspective view of the wallet of FIG. 19 in another open position, showing one of the compartments between the first shell cover and the second shell cover.
Figure 22:
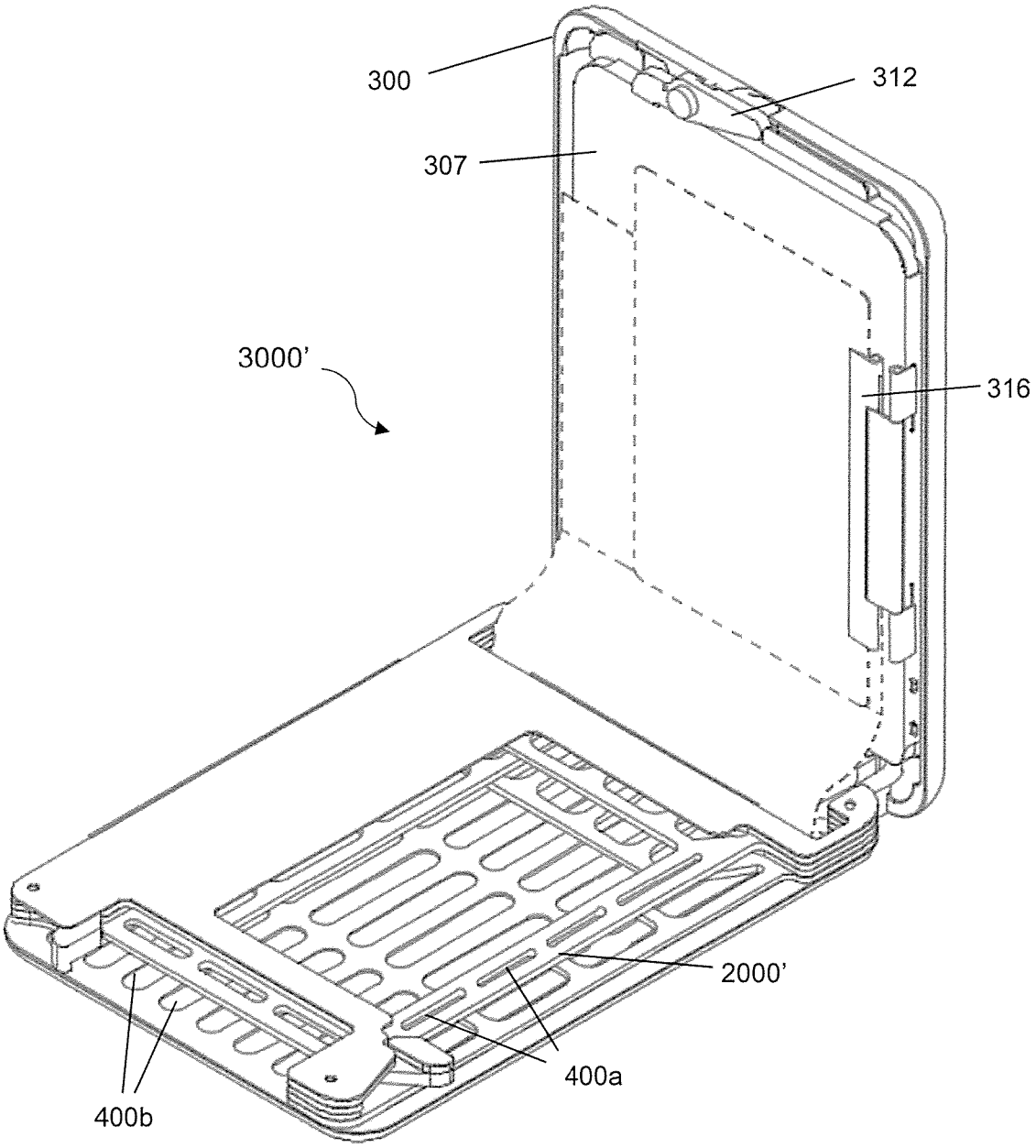
FIG. 22 illustrates a perspective view of the wallet of FIG. 19 in another open position, showing one of the compartments between the first shell cover and the second shell cover.
Figure 23:
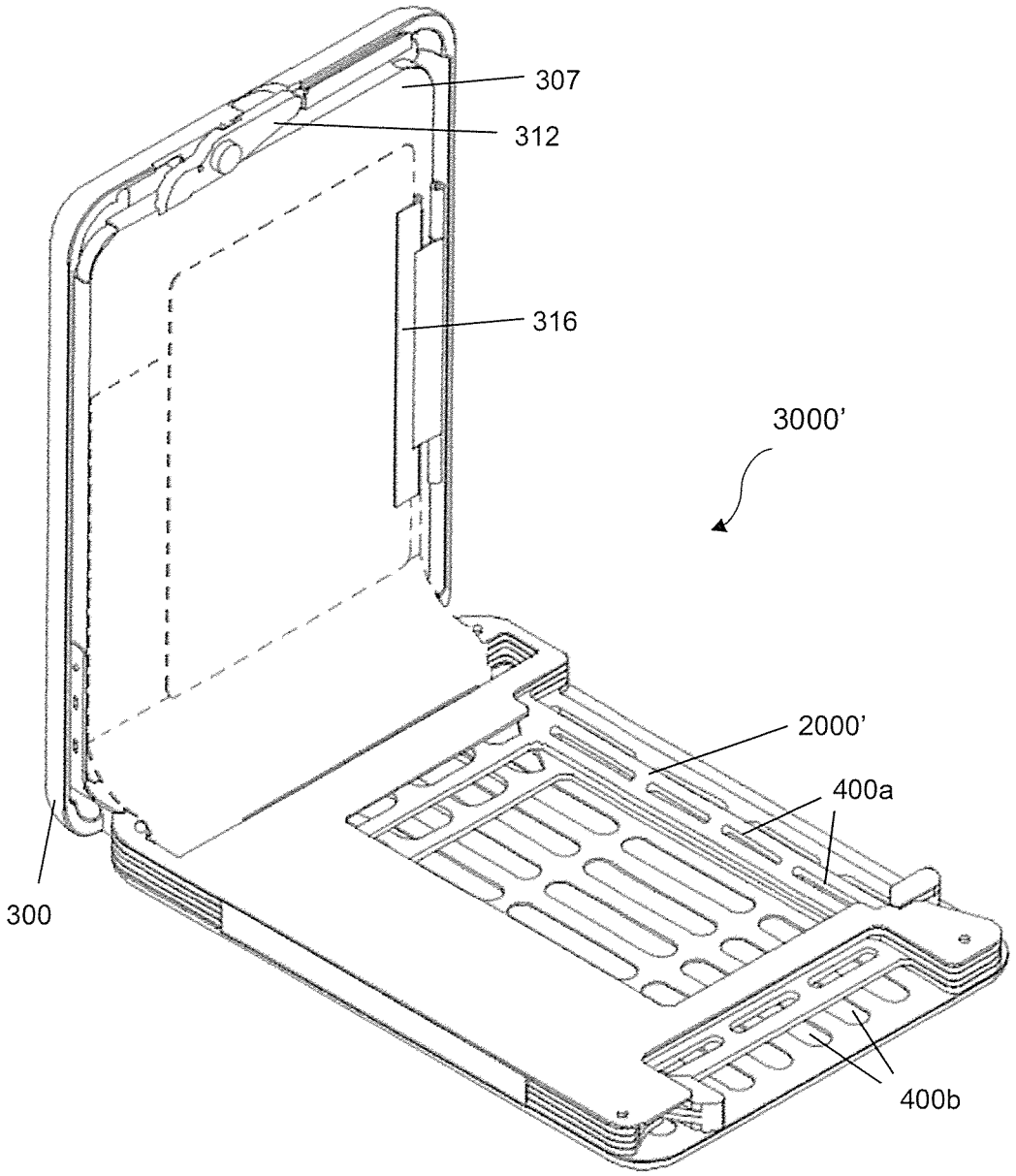
FIG. 23 illustrates a perspective view of FIG. 22.
Figure 24A:
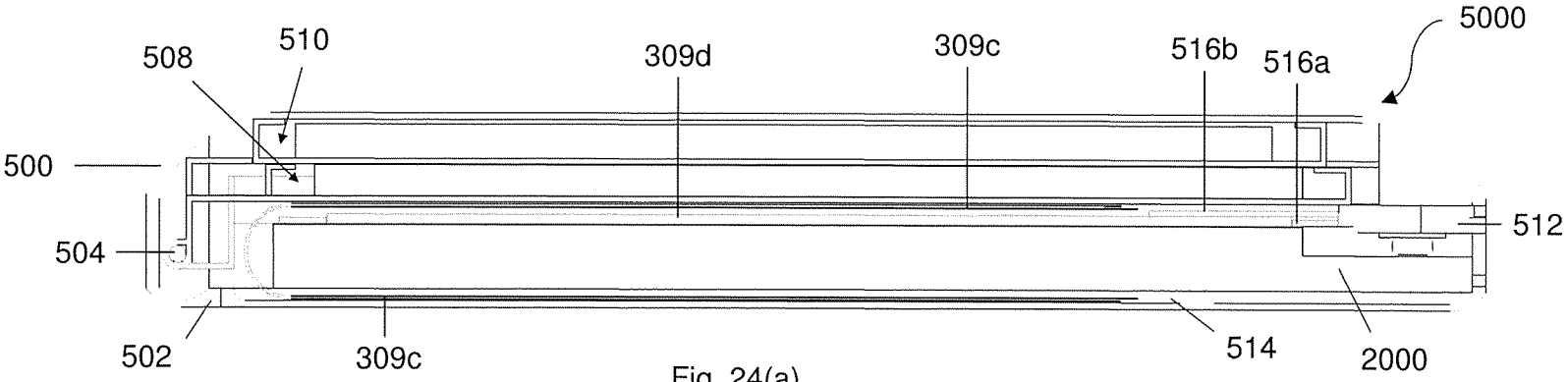
FIG. 24(*a*) illustrates a cross-sectional view of a wallet in accordance with another embodiment of the invention.
Figure 24B:
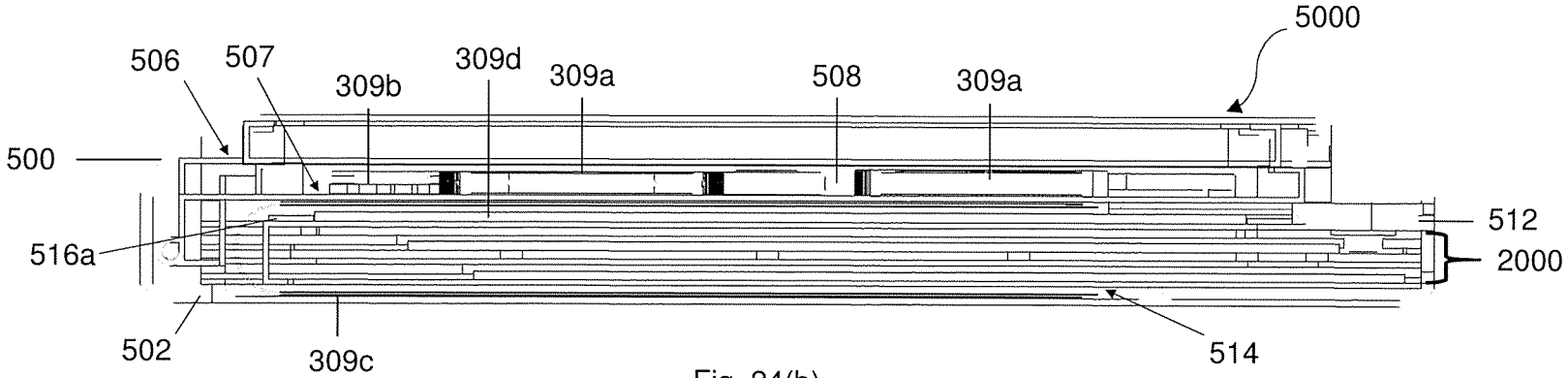
Figure 24C:
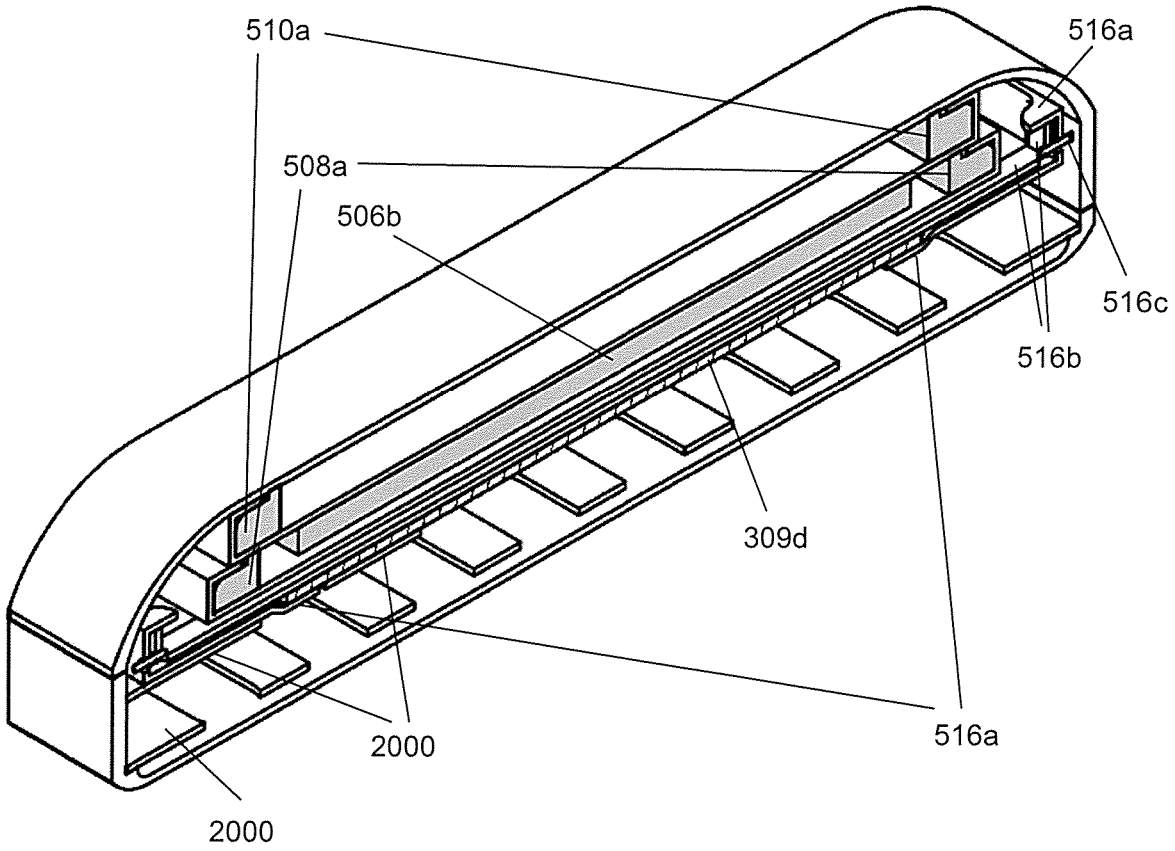
Figure 24D:
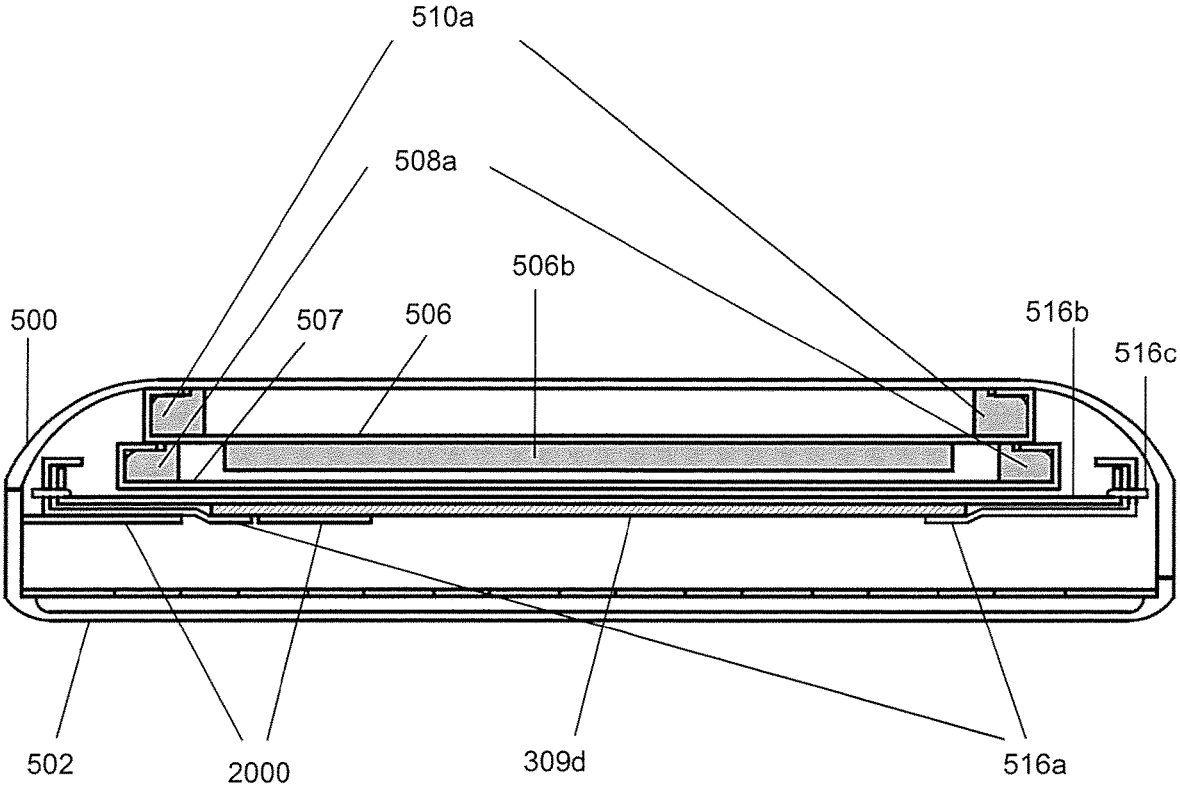

In various embodiments and as shown in FIG. 18, the hinged clip may be a one hinge system (hinged clip 316') or two hinge system (hinged clip 316). In a preferred embodiment and as shown in FIGS. 9, 11, 12, 16, 18(*a*) and 18(*b*), the hinged clip is a two hinge system (hinged clip 316) which is capable of allowing an object, such as (but not limited to) RFID card 309*d*, to shift and remain substantially pressed against the bank notes 309*c* extending from the compartment 314. The two hinge system may also allow the RFID card 309*d* to be rotated. Consequently, the RFID card 309*d* may be substantially pressed against the bank notes 309*c* having a thickness $A_1$ or $A_2$, wherein $A_1<A_2$, and the RFID card 309*d* does not increase the total thickness of the wallet 3000 (FIGS. 18(*a*) and 18(*b*)). In addition, a two hinge system (hinged clip 316) is more advantageous than a one hinge system (hinged clip 316', FIG. 18(*c*)) because dead space is preferably not introduced or is minimally introduced, even when there is a thick pile of bank notes 309*c* (FIG. 18(*b*)). This allows the wallet 3000 to expand slightly in a proportional manner with a few more bank notes 309*c* added beyond the compartment 314. In contrast, there may be dead space $D_1$ for a one hinge system (hinged clip 316') when there is a thick pile of bank notes 309*c* (FIG. 18(*c*)). Due to the presence of the dead space $D_1$, closing of the wallet 3000 may be difficult.

Figure 12:
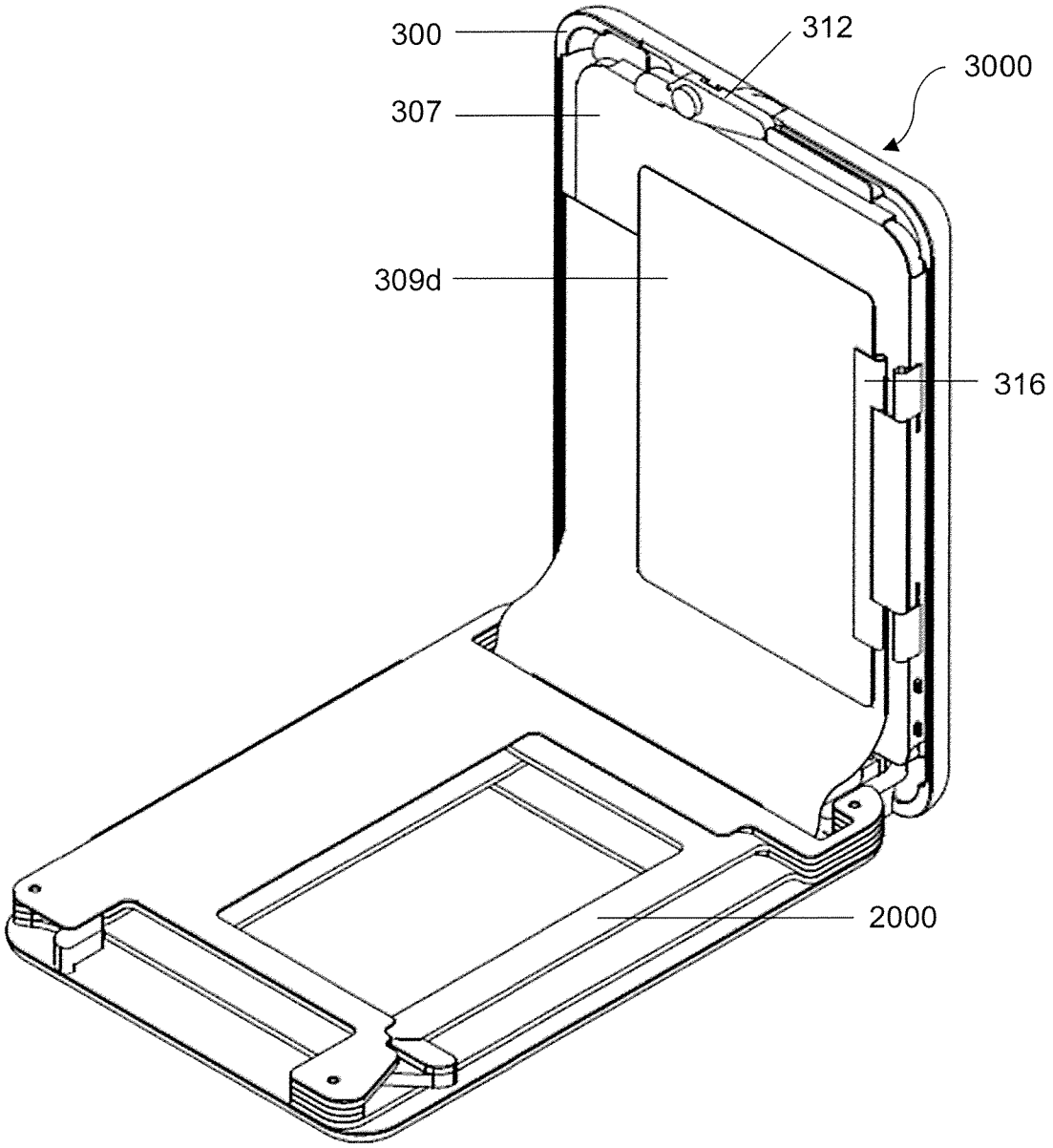
FIG. 12 illustrates a perspective view of FIG. 11.
Figure 13:
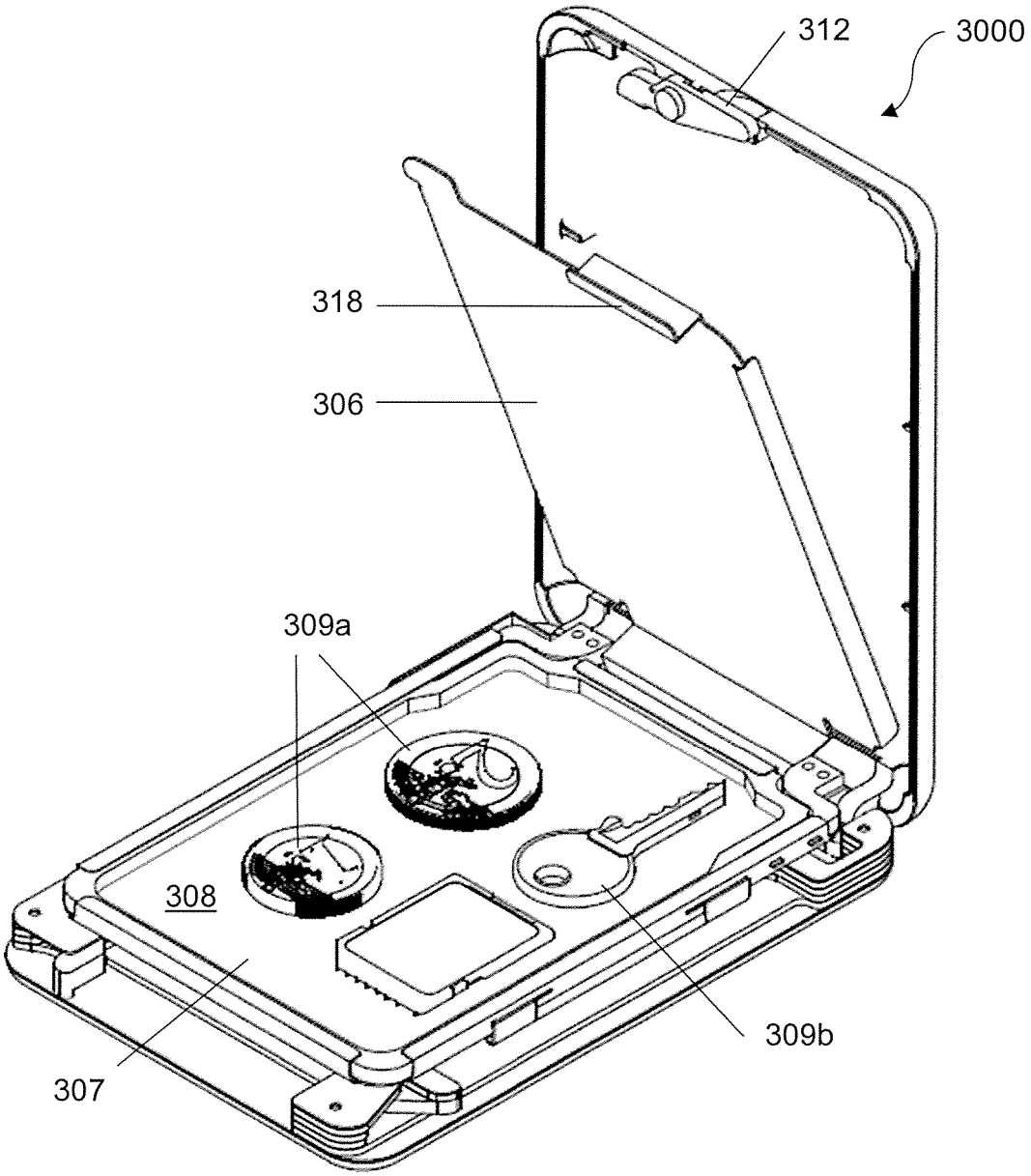
FIG. 13 illustrates a perspective view of the wallet of FIG. 9 in an open position, showing one of the compartments between the first shell cover and the second shell cover.
Figure 14:
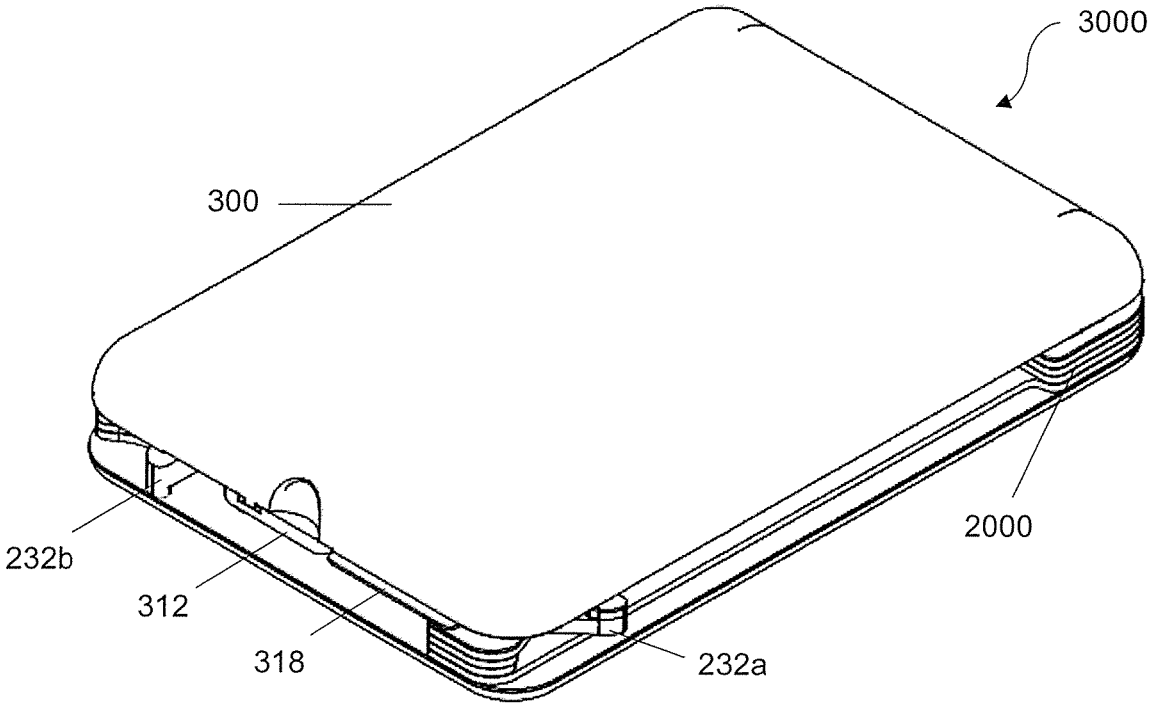
FIG. 14 illustrates a perspective view of the wallet of FIG. 9 in a closed position.
Figure 15:
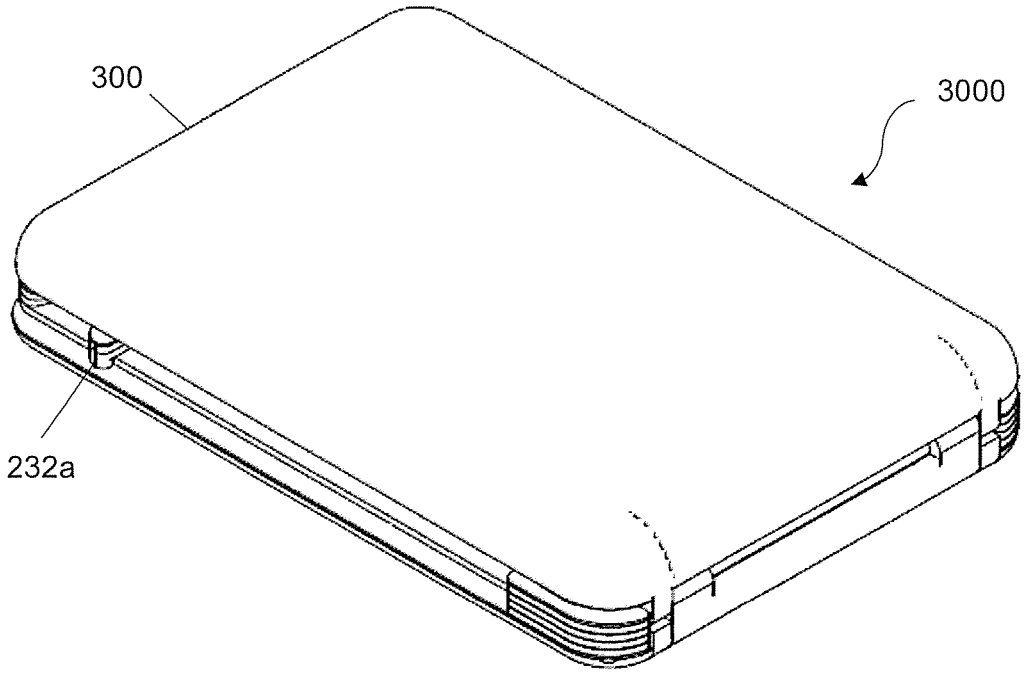
FIG. 15 illustrates another perspective view of the wallet of FIG. 9 in a closed position.
Figure 16:
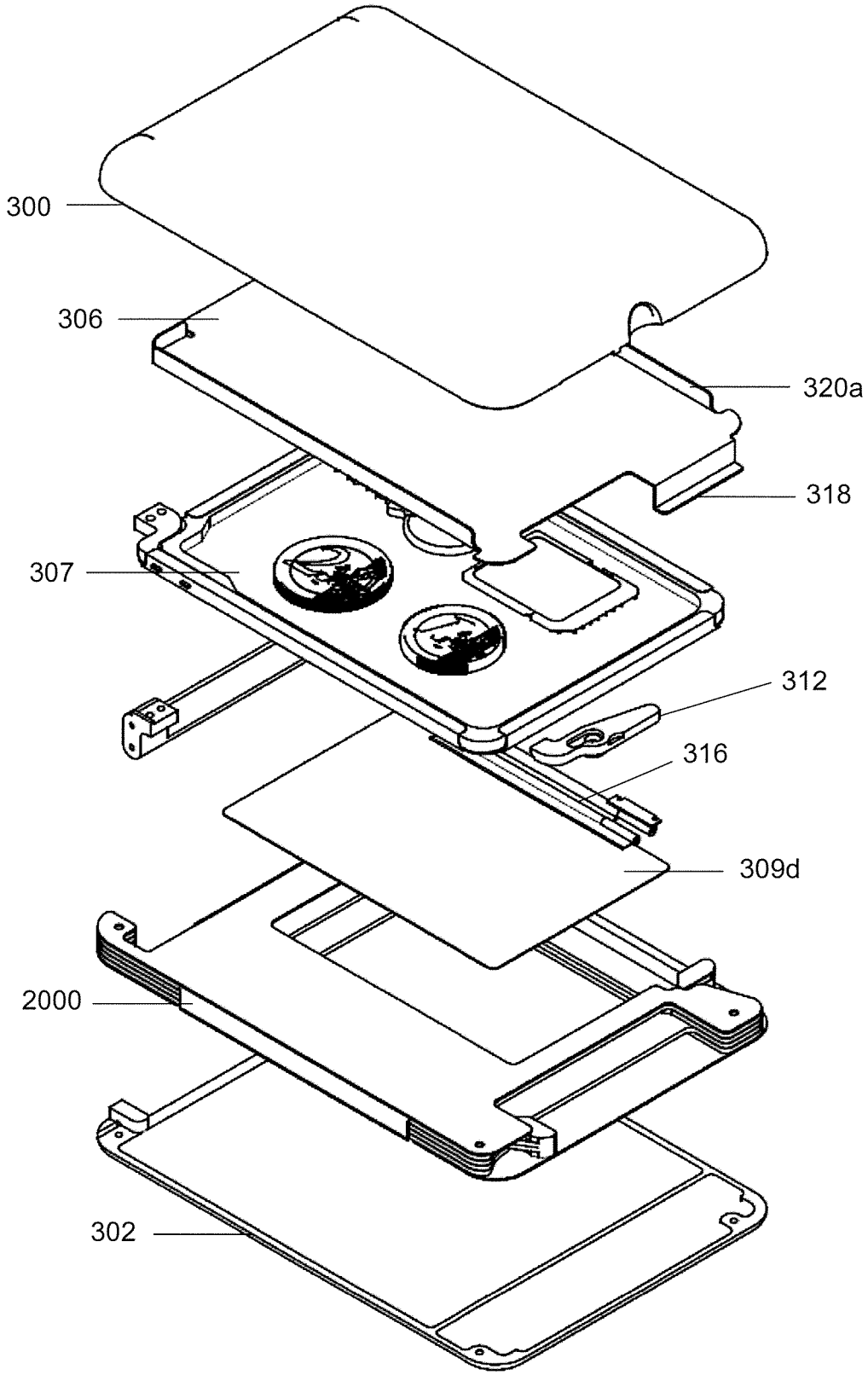
FIG. 16 illustrates an exploded view of the wallet of FIG. 9 from the top.
Figure 17:
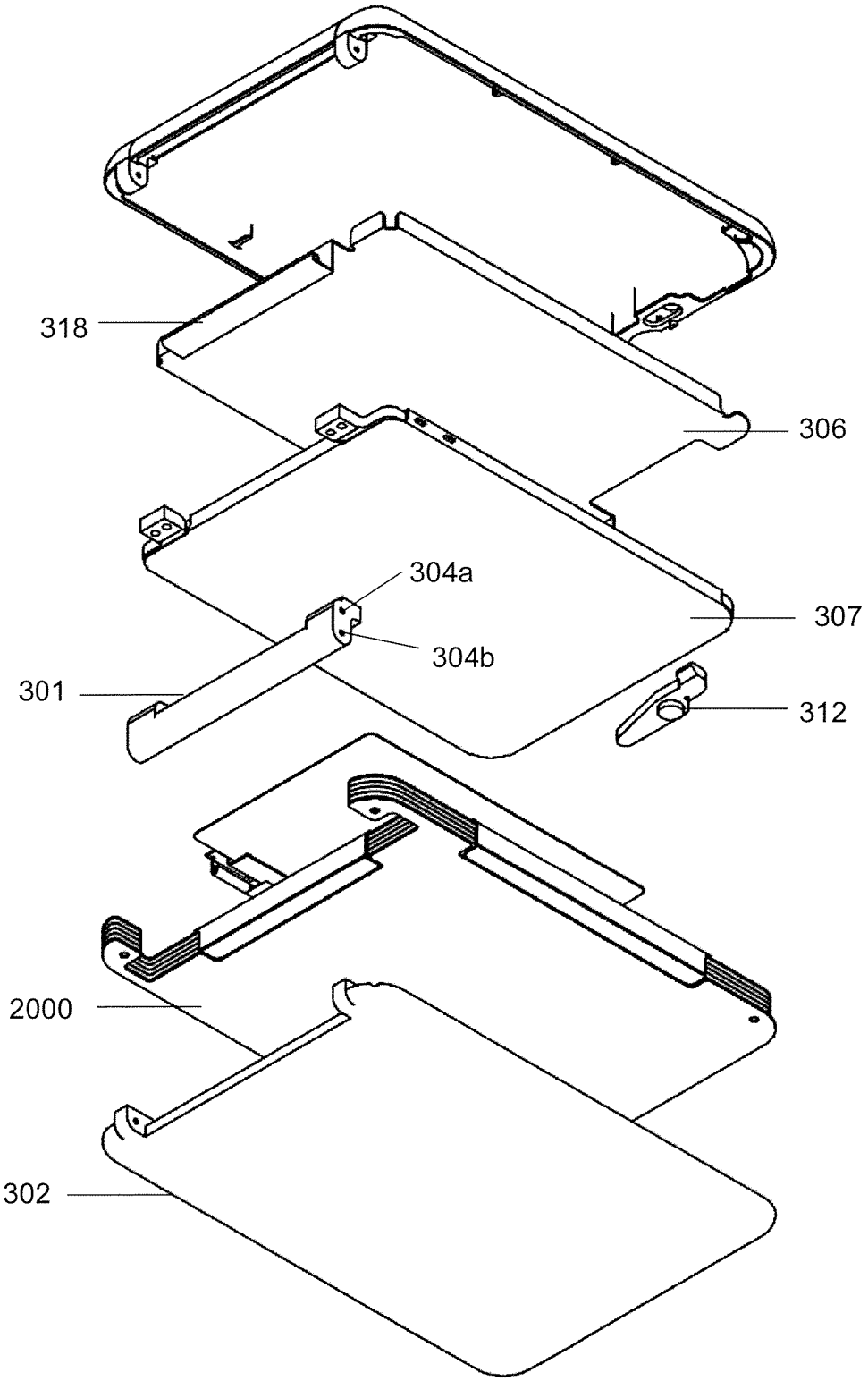
FIG. 17 illustrates an exploded view of the wallet of FIG. 9 from the bottom.

In various embodiments and as shown in FIGS. 11 and 12, the hinged clip 316 may be positioned on a side of the wallet 3000, such that the RFID card 309*d* effectively presses against the bank notes 309*c* extending from the compartment 314 when the wallet 3000 is opened. Alternatively, the hinged clip 316 may be positioned on another side of the wallet 3000, such that it is on the same side as the locking means 312. It would be understood by a person skilled in the art that when the hinged clip 316 is positioned on the same side as the locking means 312, the length of the hinged clip 316 would be adapted to fit within the second barrier 307.

In various embodiments, the compartments 308, 310 may further comprise padding along the sides, top, base or a combination thereof of the compartments 308, 310, such that rattling of the objects contained in compartment 308, 310 may be reduced. The padding may comprise a soft elastic material such as foam, rubber, silicon or a mixture thereof. The padding may comprise padding feet, such as a pair of padding feet, which press against second barrier 307. When padding feet is used, the padding feet may dampen the impact between the hinged clip 316 and the device 2000 when the wallet 3000 is closed and advantageously prevent surface damage to parts of the wallet 3000. In various embodiments, the padding may extend from the base of the compartments 308, 310 to above the edge of the compartment sidewalls, thereby sealing the compartments 308, 310 and preventing water from entering the compartments 308, 310 when the wallet 3000 is in the closed position.

In various embodiments, the first barrier 306 may further comprise a tab 318 that is capable of allowing the first barrier 306 to be raised together with the first shell cover 300. Consequently, the user may access the compartment 308. In a preferred embodiment, the tab 318 extends towards the compartment 308, such as down a side face of compartment 308 to the bottom edge of compartment 308 (FIGS. 13 and 16), and out to just beneath, but not beyond the edge, such as the outer edge (FIGS. 13 and 16), of the first shell cover 300. Advantageously, the tab 318 may be positioned such that it does not take up significant space in the wallet 3000. Additional tabs may be added depending on the number of barriers, and accordingly, the number of compartments. In a preferred embodiment, each tab does not overlap another and occupies only a portion of the edge of a barrier. The tab(s) may allow the user to selectively access the various compartments.

Figure 10:
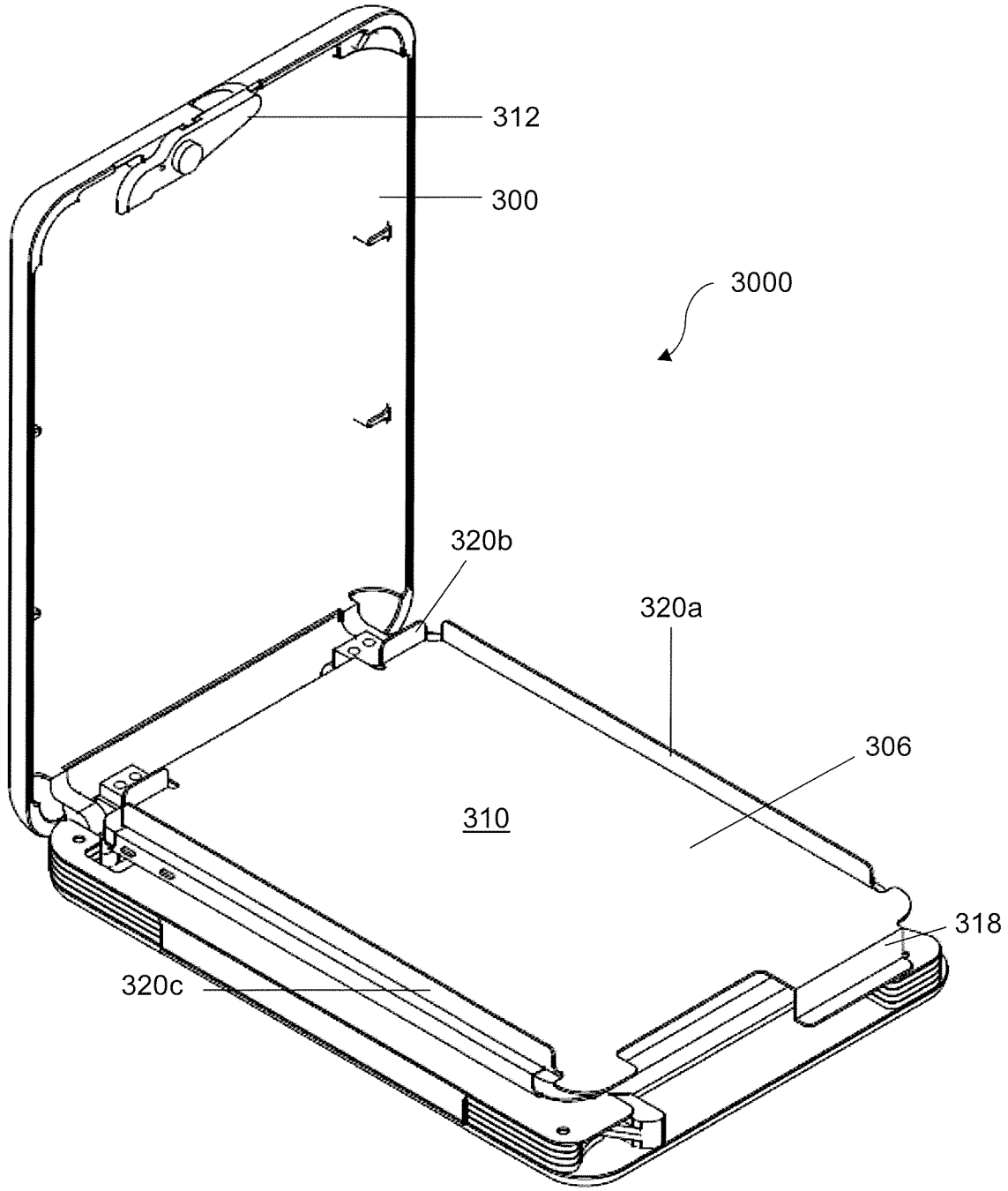
FIG. 10 illustrates a perspective view of the wallet of FIG. 9 in an open position, showing one of the compartments between the first shell cover and the second shell cover.

In a preferred embodiment and as shown in FIG. 10, compartment 310 may have partially raised walls 320*a*, 320*b* and 320*c* extending from first barrier 306, which are capable of securing the contents of compartment 310. The absence of a partially raised wall on a fourth side may allow the user to slide the contents of compartment 310 with ease and improved accessibility.

In a preferred embodiment and as shown in FIGS. 9(*a*) and 9(*b*), the first shell cover 300 may have rounded edges, which may advantageously reduce wear and tear of a material in direct contact with the wallet 3000. For instance, the material may be a cloth used to make the back pocket or any other pocket containing the wallet 3000. Furthermore, the rounded edges may facilitate the insertion of the wallet 3000 into a back pocket or any other pocket. The first shell cover 300 may have one or more rounded edges.

In various embodiments, each component of the wallet 3000 may be made from a material that is independent of each other. Such a material may comprise at least one of plastic, plastic composite, metal, metal alloy, wood, leather or fabric. In a preferred embodiment, the metal is aluminium. In particular, the first shell cover 300, the second shell cover 302, the first barrier 306 and the second barrier 307 are made of aluminium. When aluminium is used to make, for instance, barriers 306 and 307, there would be minimal or no radiofrequency interference between cards with embedded RF devices that have the aluminium barriers (306, 307) between them. Advantageously, an aluminium shell cover (such as first shell cover 300 and second shell cover 302) would also protect RF devices in a closed wallet 3000 from being scanned by an external RF device against the user's will or knowledge. Depending on the material used for the particular component, the component may have desirable characteristics such as being lightweight, durable and/or stiff. Consequently, the wallet 3000 may have desirable characteristics such as being lightweight, durable and slim. Advantageously, the user can use the wallet 3000 for a prolonged period of time and can carry objects such as cards, coins and bank notes in a convenient and comfortable manner.

In various embodiments, at least one component of the wallet may comprise a plurality of holes or a plurality of perforations. This is illustrated, for instance, in wallet 3000'. It should be understood that the plurality of holes or plurality of perforations of wallet 3000' may be combined with wallet 3000 to form yet other embodiments (not shown). Similarly, various features of wallet 3000 may be present or combined with wallet 3000' to form yet other embodiments. As shown in FIGS. 19 to 23, wallet 3000' may comprise a first shell cover 300, a second shell cover 302, a first barrier 306 and a second barrier 307 connected to the first shell cover 300. The first barrier 306 and the second barrier 307 is connected to the first shell cover 300 such that two compartments (308, 310) are introduced into the space between a device 2000' and the first shell cover 300. A plurality of holes or plurality of perforations (400*a*) may be found on at least one surface of a device 2000', such that less material is used to make the device 2000'. Device 2000' may comprise the embodiments of device 1000 or device 2000, and will not be elaborated further. In various embodiments, a plurality of holes or a plurality of perforations (400*b*) may be introduced to the second shell cover 302. In various embodiments, a plurality of holes or a plurality of perforations may be introduced to the first shell cover 300 (not shown). The presence of the holes or perforations (e.g. 400*a*, 400*b*) may result in the use of less material, and consequently reduce the weight and/or cost to manufacture wallet 3000'. In addition, the plurality of holes or the plurality of perforations may increase the surface area of the component of the wallet, which may advantageously lead to better grip.

In various embodiments and as shown in FIGS. 24 to 33, the wallet 5000 may comprise a first shell cover 500 and a second shell cover 502, the first shell cover 500 connected to the second shell 502 at an edge via a hinge 504. As such, the central piece 301 of wallet 3000 may be optional. The first shell cover 500 may be shaped such that the first shell cover 500 extends over at least one of the edges of the wallet 5000 and contacts the second shell cover 502. Alternatively, the second shell cover 502 may be shaped such that the second shell cover 502 extends over at least one of the edges of the wallet 5000 and contacts the first shell cover 500. The wallet 5000 may further comprise a device for holding planar objects, such as device 2000 described above, which may be connected to the second shell cover 502 via the hinge 504. The device 2000 may further comprise a plurality of holes or a plurality of perforations 400*c*. As the first shell cover 500 or the second shell cover 502 may be shaped such that the first shell cover 500 or the second shell cover 502 extends over at least one of the edges of the wallet 5000, thereby contacting the second shell cover 502 or the first shell cover 500 respectively, at least one component of the device 2000, such as the lever 232*a* may be covered by the first shell cover 500 or the second shell cover 502 when the wallet 5000 is in a closed position. This is illustrated in for instance, FIGS. 30 and 31 whereby the lever 232*a* of the device 2000 is hidden from view by the first shell cover 500 when the wallet 5000 is in a closed position, whereas the lever 232*a* of the device 2000 is visible in FIGS. 14 and 15 when the wallet 3000 is in a closed position. In various embodiments, the device 2000 may be connected to the second shell cover 502 by another means such as an adhesive means like glue or an attachment means like screws. Consequently, the wallet 5000 may have at least one compartment for coins 309*a*, keys 309*b*, bank notes 309*c* and other objects between the device 2000 and the first shell cover 500. In addition, the wallet 5000 may have at least one compartment for coins 309*a*, keys 309*b*, bank notes 309*c* and other objects between the device 2000 and the second shell cover 502.

In various embodiments, the wallet 5000 may further comprise a first barrier 506 and a second barrier 507 connected to the first shell cover 500 and extending from the hinge 504. Consequently, the first barrier 506 and the second barrier 507 are capable of pivoting about hinge 504. The first barrier 506 and the second barrier 507 are capable of introducing two compartments (508, 510) into the space between the device 2000 and the first shell cover 500. The compartment 508 may be suitable for objects such as (but not limited to) coins 309*a* and keys 309*b*, while the compartment 510 may be suitable for other objects such as (but not limited to) receipts. The number of barriers may vary depending on the number of compartments that are desired. In a preferred embodiment, each barrier, for instance, first barrier 506 and second barrier 507, is thin so that the thickness of the wallet 5000 is minimized.

The size of each compartment, for instance, compartments 508 and 510, may be adjusted as desired, independently of each other. In a preferred embodiment, the compartment 508 may be adapted to be just slightly thicker than a British pound coin so that the wallet 5000 may be kept thin. In another preferred embodiment, each compartment may have stiff and thin walls.

In various embodiments and as shown in FIGS. 24 to 33, the wallet 5000 may further comprise a locking means 512 connected to the first shell cover 500, which is capable of allowing the user to access any one of the two compartments 508 and 510. Advantageously, the locking means 512 may help secure the objects within the compartments 508 and 510, preferably securing the objects in a horizontal position, such that the objects would not fall out. More advantageously, the objects may be laid out in one single layer within the confines of the compartment 508. As such, a user may easily view and access any one object in the compartment 508. In contrast, some prior art wallets may have objects stacked above one another, such that a user is unable to easily view and access all the objects. Furthermore, such prior art wallets may be thicker than the invention, or have more dead space. Dead space may refer to any space between two objects or within one object that is not being utilized.

In various embodiments and as shown in FIGS. 24 to 33, there may be a compartment 514 between the device 2000 and the second shell cover 502. The compartment 514 may be capable of receiving objects, such as (but not limited to) bank notes 309*c*, such that one end of the bank notes 309*c* may rest in the compartment 514, while the other end of the bank notes 309*c* may be held between the device 2000 and the second barrier 507 (FIG. 24(*a*)).

Advantageously, the bank notes 309*c* may be secured on all sides and fully unfolded when wallet 5000 is in an open position. This may allow the user to easily access the bank notes 309*c* in a neat and organized manner. Furthermore, there would not be any risk of the bank notes 309*c* falling out of the wallet 5000 when it is opened by the user.

In various embodiments and as shown in FIGS. 24(*a*) and 24(*b*) (collectively known as FIG. 24), the bank notes 309*c* may wrap around the device 2000 in one position. As such, the bank notes 309*c* are secured on all sides and may be unfolded when wallet 5000 is in an open position. Furthermore, dead space in the wallet 5000 may be minimized because the space generated when the bank notes 309*c* are folded is taken up by the device 2000. Without the presence of the device 2000, when the bank notes 309*c* rest in the compartment 514 and the wallet 5000 is in the closed position, there may be dead space between the opposite folded faces of the bank notes 309*c*. In particular, when folded and pressed together, the banknotes 309*c* may structurally resist the sharp change in curvature. As a result a space, i.e. dead space, develops on the inside of the fold. This means that truly packing as many banknotes 309*c* as possible into compartment 514 may create an uneven loading on the surrounding components of the wallet 5000. For instance, there may be difficulty closing the wallet 5000. Furthermore, the inner banknotes 309*c* may also be folded to the point where a crease appears. Thus, the wrapping of the bank notes 309*c* around the device 2000 may ameliorate the afore-mentioned disadvantages.

Figure 26A:
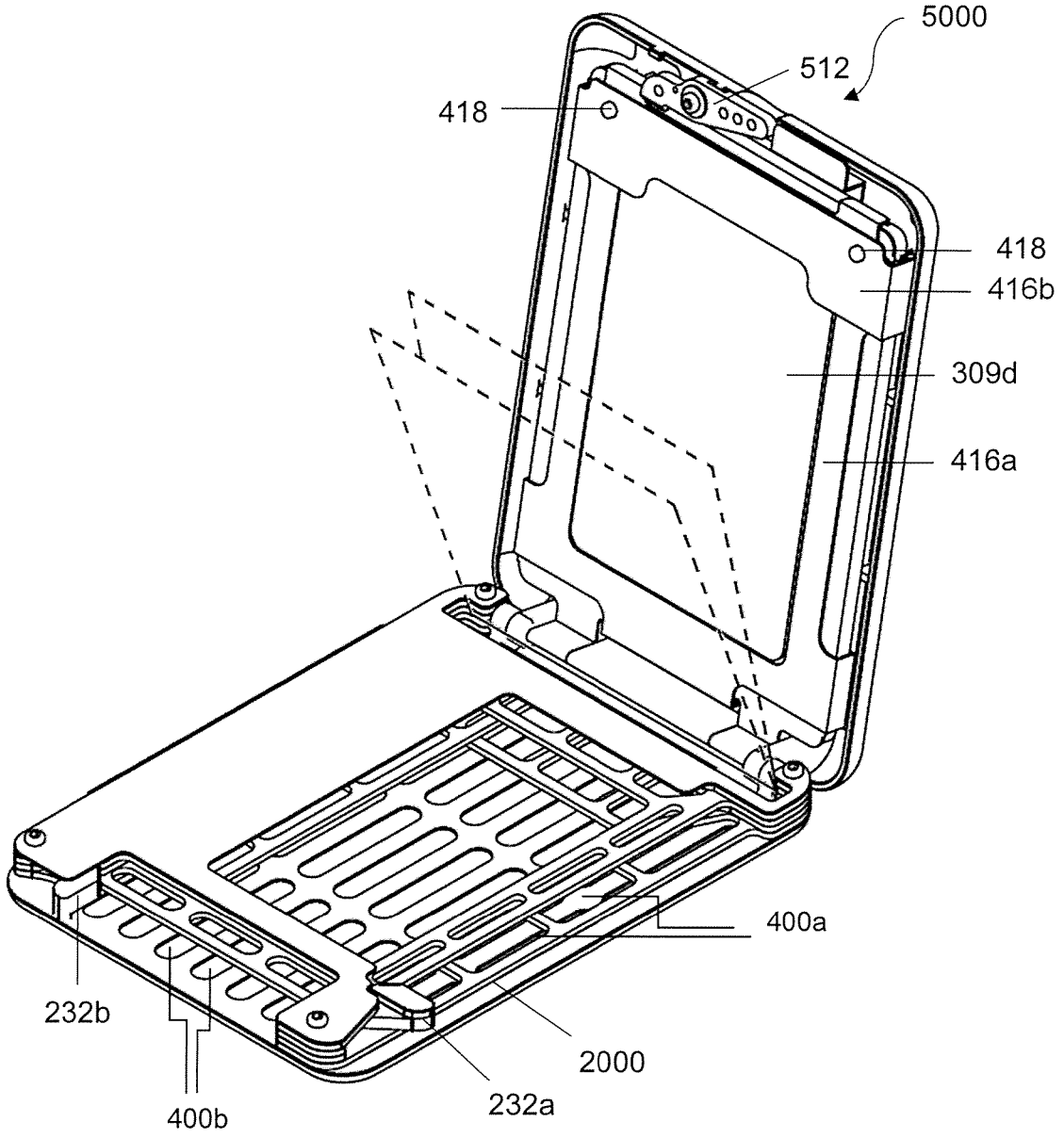
FIG. 26(*a*) illustrates a perspective view of an embodiment of the wallet of FIG. 24 in an open position containing a card, showing one of the compartments between the first shell cover and the second shell cover, wherein the card is retained using a fixed clip.
Figure 26B:
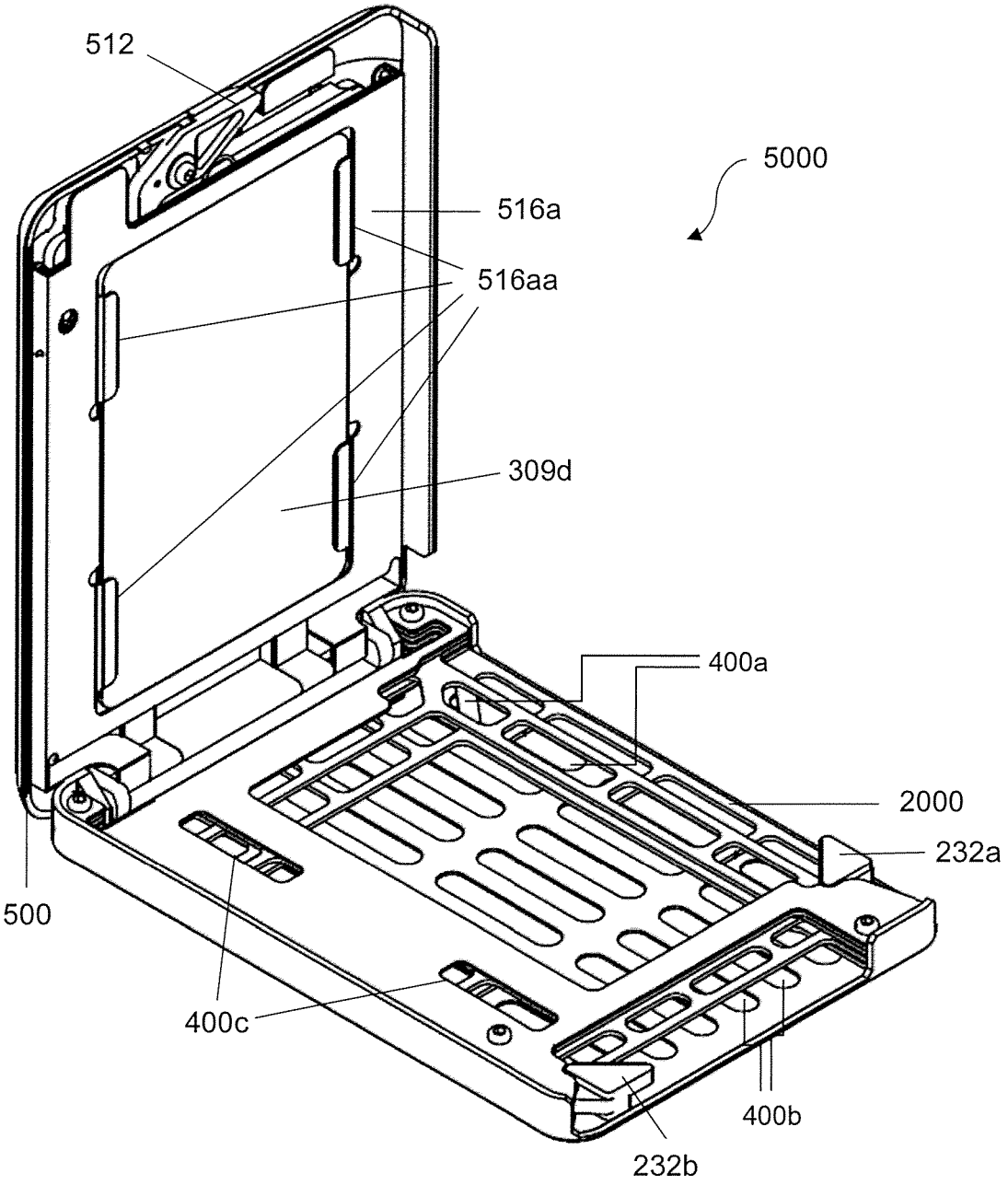
Figure 27:
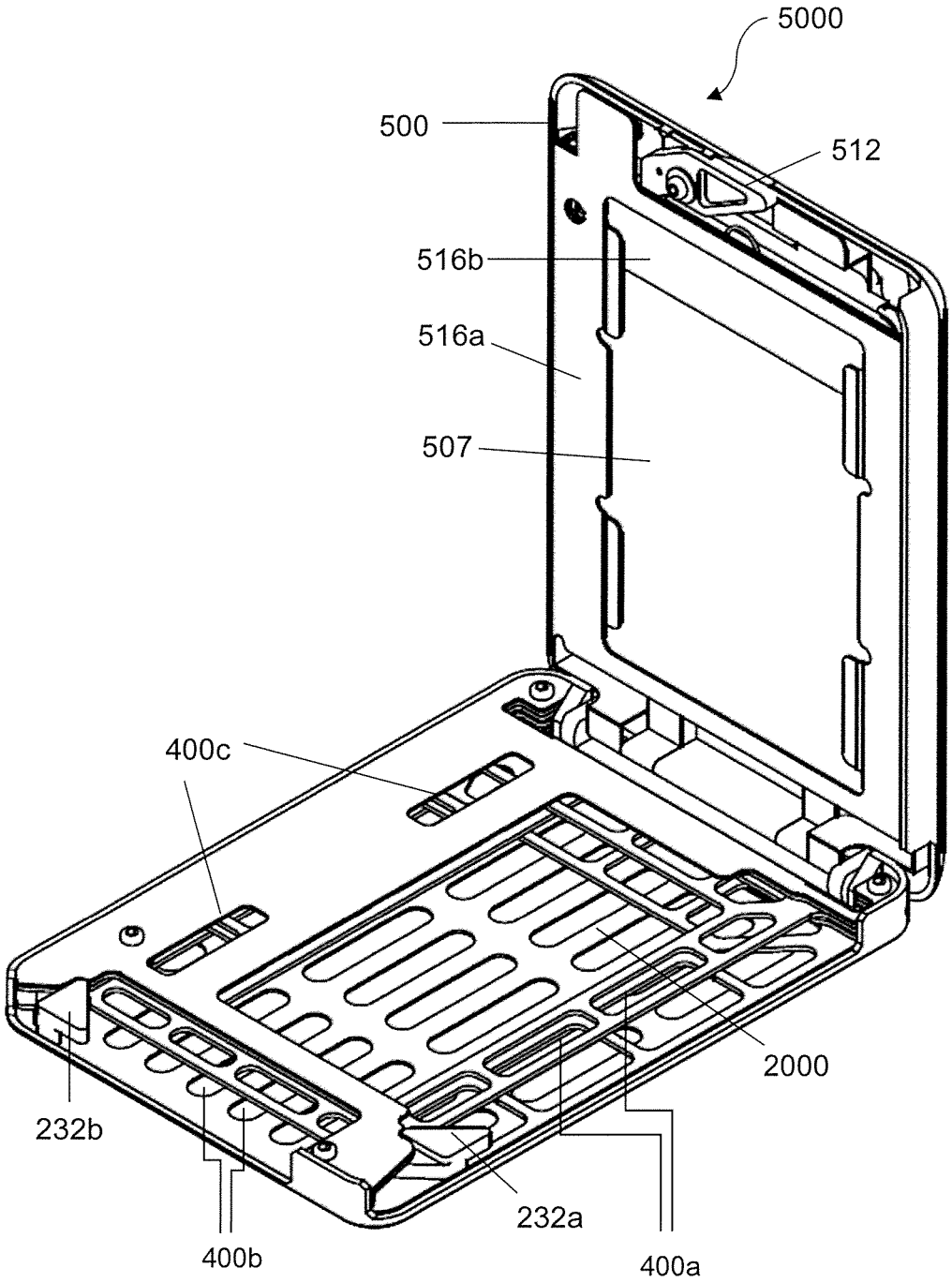
FIG. 27 illustrates a perspective view of FIG. 26(*b*), without containing a card.
Figure 28:
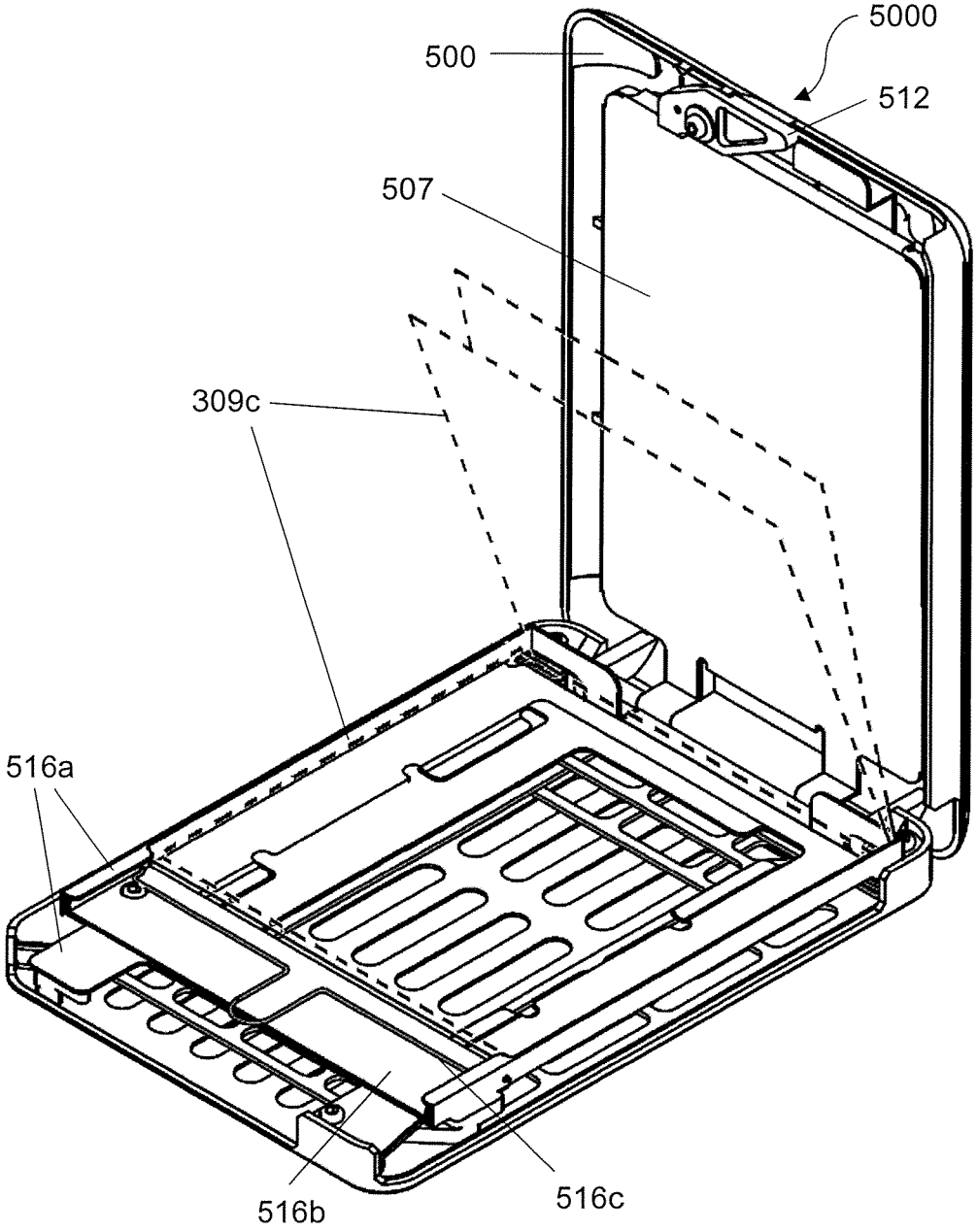
FIG. 28 illustrates a perspective view of the wallet of FIG. 24 in an open position, showing one of the compartments between the first shell cover and the second shell cover, without containing a card.
Figure 29:
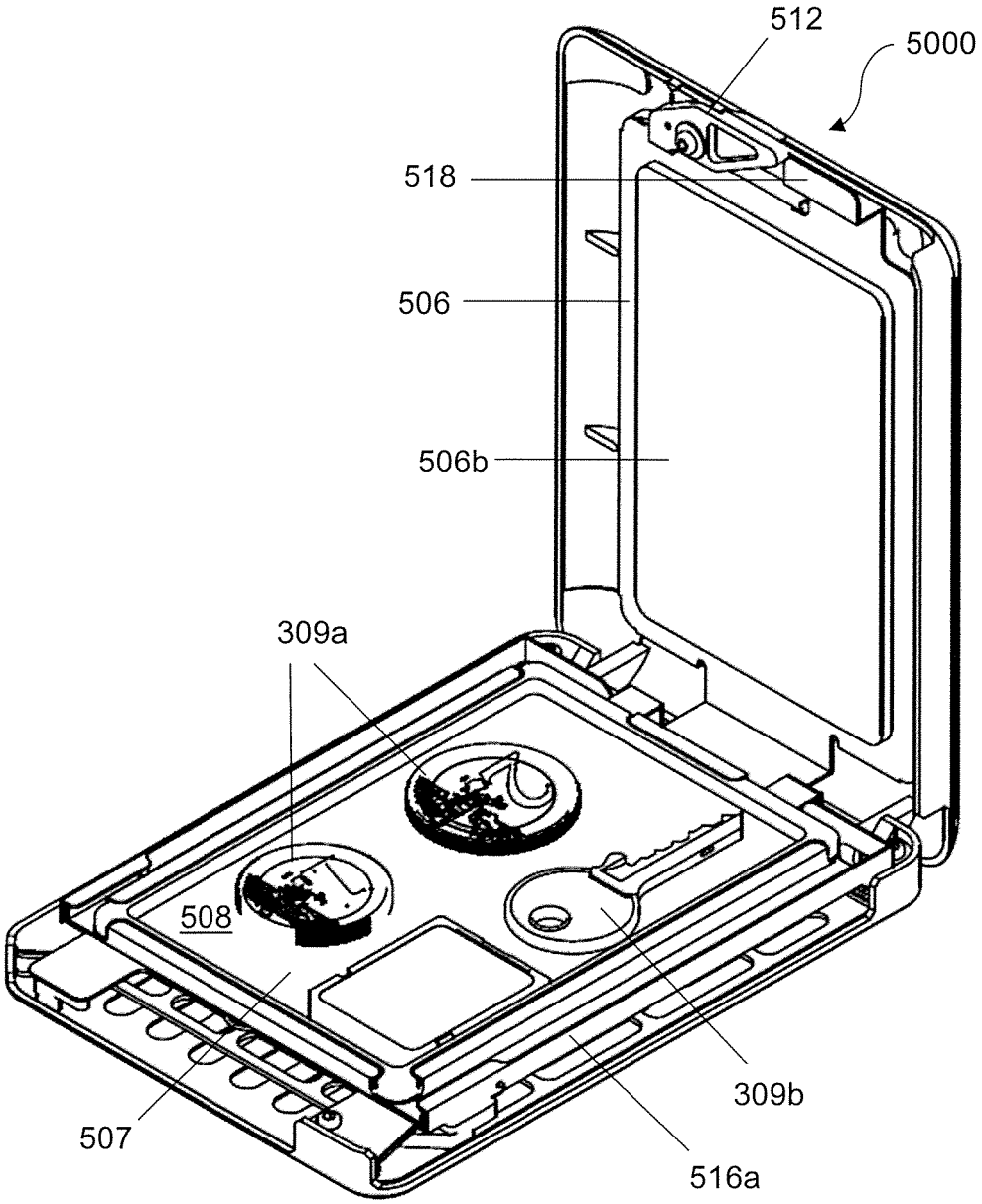
FIG. 29 illustrates a perspective view of the wallet of FIG. 24 in an open position, showing one of the compartments between the first shell cover and the second shell cover.
Figure 30:
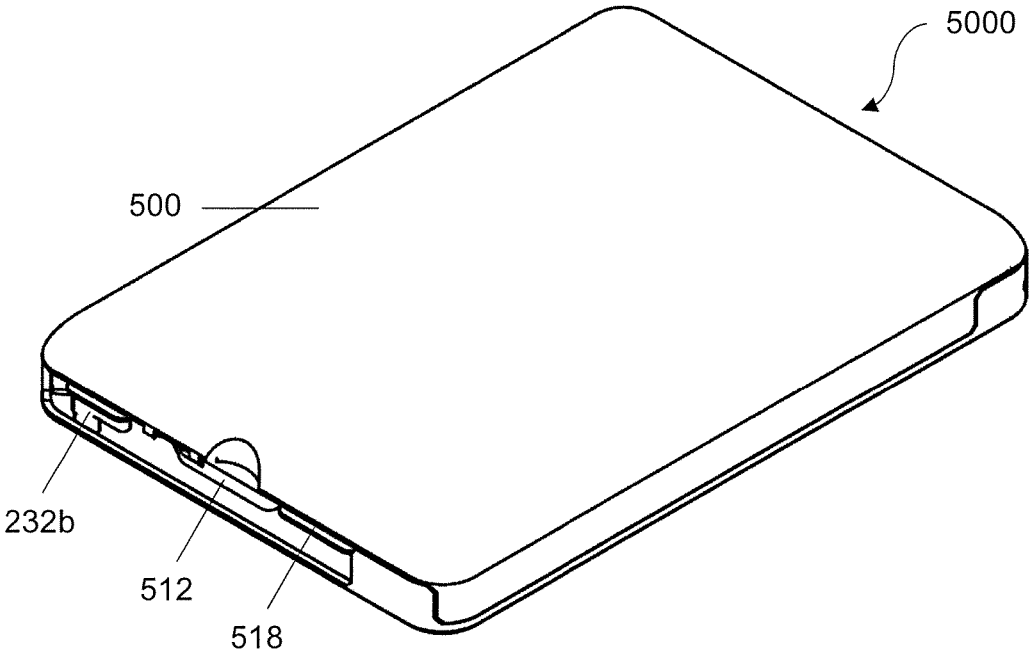
FIG. 30 illustrates a perspective view of the wallet of FIG. 24 in a closed position.
Figure 31:
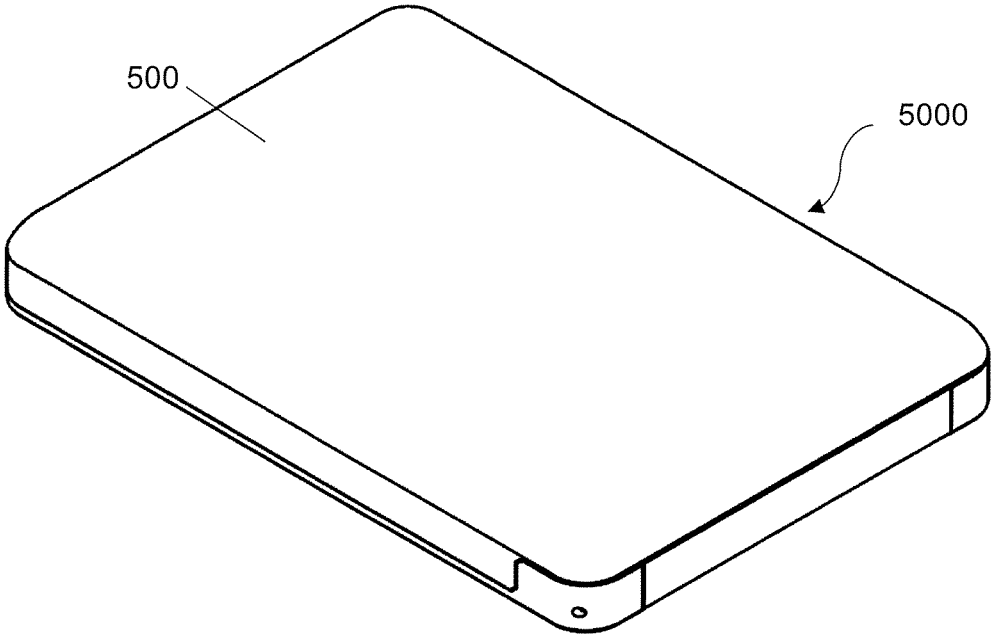
FIG. 31 illustrates another perspective view of the wallet of FIG. 24 in a closed position.

In various embodiments and as illustrated in FIG. 26(*a*) and FIG. 26(*b*) (collectively known as FIG. 26), the bank notes 309*c* may be held against the second barrier 507 using an object retaining means, such as a hinged clip 516 or another means, which is capable of pressing the bank notes 309*c* against the second barrier 507. As such, the bank notes 309*c* are secured and may be unfolded when wallet 5000 is in an open position. Consequently, any space generated between each of the bank notes 309*c* may be minimized.

In various embodiments and as illustrated in FIGS. 26(*a*) and 32(*a*), the wallet 5000 may further comprise a fixed clip 416 which is capable of receiving an object, such as (but not limited to) a RFID card 309*d* or any suitably sized card. In various embodiments, the fixed clip 416 may comprise a retaining means 416*a* capable of securing the RFID card 309*d* against lateral movement and a clip 416*b* that is capable of retaining the RFID card 309*d* against the second barrier 507. Advantageously, the fixed clip 416 may be positioned such that it does not take up space between the device 2000 and the second barrier 507 which is meant for bank notes 309*c*. In particular, the retaining means 416*a* may be attached to second barrier 507 at one end and secured by the clip 416*b* at its other end, to the second barrier 507. Preferably, the thickness of the clip 416*b* may be minimized, and preferably not thicker than the RFID card 309*d*, so that it does not take up the space between the device 2000 and the second barrier 507. In various embodiments, the clip 416*b* may be positioned close to the locking means 512 and at a distance away from hinge 504 so that it does not take up the space between the device 2000 and the second barrier 507, which is meant for the bank notes 309*c*.

In various embodiments and as illustrated in FIGS. 26(*b*) and 32(*b*), the hinged clip 516 may be capable of receiving an object, such as (but not limited to) a RFID card 309*d* or any suitably sized card. In various embodiments, the hinged clip 516 may comprise a retaining means 516*a* capable of securing the RFID card 309*d* against lateral movement. The retaining means 516*a* is adapted to retain the RFID card 309*d* on at least one edge, preferably all four edges, of the RFID card 309*d*. In addition, the retaining means 516*a* may comprise at least one extension 516*aa* that acts as a lip and retains at least one side of the RFID card 309*d*, thereby securing the RFID card 309*d*. Advantageously, the at least one extension 516*aa* may be positioned to occupy any dead space created when the wallet 5000 is closed, such as dead space generated by the device 2000 when the wallet 5000 is in a closed position. The at least one extension 516*aa* may also be positioned to insert into the hole or perforation 400*c* of the device 2000. Consequently, the at least one extension 516*aa* does not contribute to the thickness of the wallet 5000. In various embodiments, the hinged clip 516 further comprises a clip 516*b* that is capable of retaining the RFID card 309*d* against the retaining means 516*a*. The clip 516*b* may be integral with the retaining means 516*a* or may be a separate component. A portion of the clip 516*b* extends from an edge of the slot 516*ac* as a retaining means for a RFID card 309*d* when in operation. When a RFID card 309*d* is retained in the slot 516*ac*, the clip 516*b* and the at least one extension 516*aa* exert opposing forces on opposing surfaces of the RFID card 309*d* to retain the RFID card 309*d* between the clip 516*b* and the at least one extension 516*aa* and within the slot 516*ac*. The retaining means 516*a* may further comprise at least one extension 516*ab* extending from the side wall of the retaining means 516*a*, such that a part of the side wall of the retaining means 516*a* forms a C shaped side wall, in which the side walls of the clip 516*b* may rest within. In an embodiment, the retaining means 516*a* may be hinged to the hinge 504. Preferably, the thickness of the side walls of the retaining means 516*a* may be minimized, and preferably not thicker than the RFID card 309*d*, so that it does not contribute to the thickness of the wallet 5000. Furthermore, the thickness of the clip 516*b* may be minimized, and preferably not thicker than the RFID card 309*d*, so that it does not take up the space between the device 2000 and the second barrier 507. In various embodiments, the clip 516*b* may be positioned close to the locking means 512 and at a distance away from hinge 504 so that it does not take up the space between the device 2000 and the second barrier 507, which is meant for the bank notes 309*c*.

Accordingly, the clip 516*b* does not take up space in the wallet 5000 that may be occupied by the bank notes 309*c*. Instead, the clip 516*b* occupies dead space and therefore does not contribute to the thickness of the wallet 5000.

Figure 34:
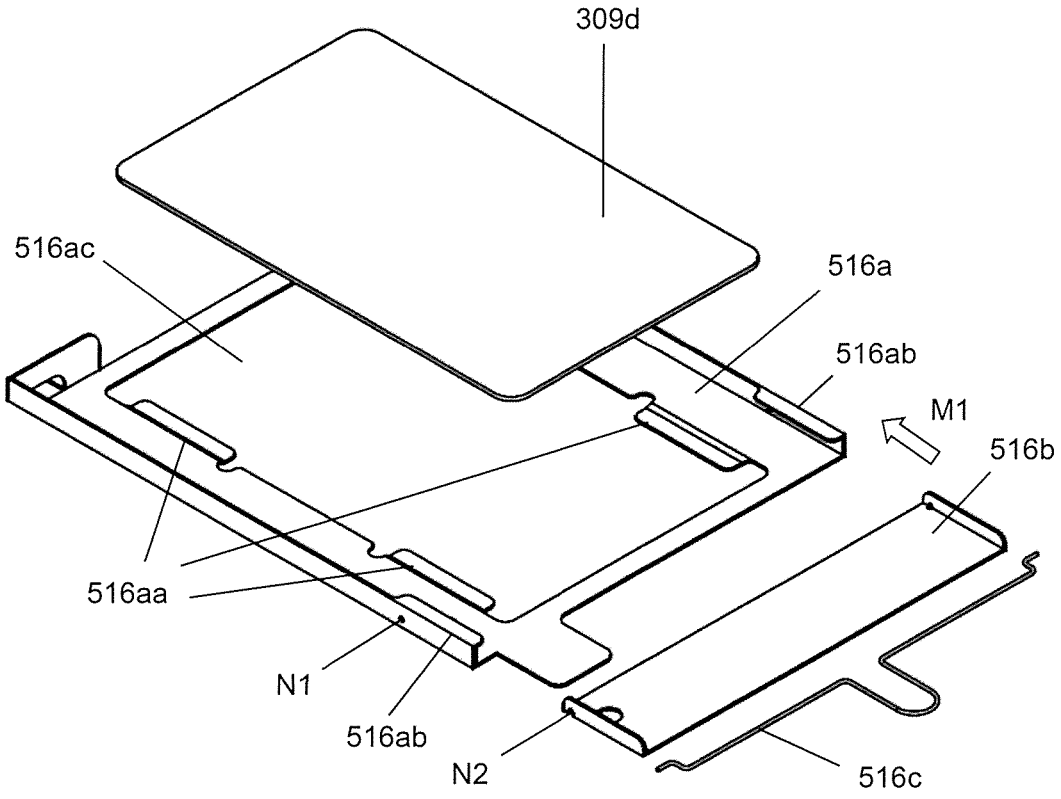
FIG. 34 illustrates an exploded view of a hinged clip in accordance with an embodiment of the invention.

In various embodiments and as illustrated in FIG. 34, the hinged clip 516 comprises a spring wire 516*c* that is capable of exerting a biasing and resilient force against the clip 516*b* to hold the clip 516*b* in position. In the absence of the spring wire 516*c*, the clip 516*b* may dislodge. Other means known in the art that are capable of holding the clip 516*b* in position will also be suitable, for example, rivets and pins. Ends of the spring wire 516*c* are capable of fitting through holes N1 on the side walls of the retaining means 516*a* and holes N2 on the side walls of the clip 516*b*. To install the clip 516*b* on the retaining means 516*a*, the clip 516*b* is moved in the direction M1 so that the sides of the clip 516*b* is received within the C shaped side walls of the retaining means 516*a*. The ends of the spring wire 516*c* are fitted through holes N1 on the side walls of the retaining means 516*a* and holes N2 on the side walls of the clip 516*b* to prevent the clip 516*b* from sliding out of the retaining means 516*a*.

In various embodiments, the compartments 508, 510 may further comprise padding 508*a*, 510*a* along the sides, top, base or a combination thereof of the compartments 508, 510, such that rattling of the objects contained in compartments 508, 510 may be reduced. The padding 508*a*, 510*a* may comprise a soft elastic material such as foam, rubber, silicon or a mixture thereof. In various embodiments and as illustrated in FIG. 26(*a*), the wallet 5000 may comprise one or more padding feet 418, such as a pair of padding feet, wherein each padding feet 418 comprises a portion that presses against second barrier 507 and another portion that extends through apertures in retaining means 416*a* and fixed clip 416*b*. Each padding feet 418 may be a unitary piece or formed from more than one portions. The padding feet dampens any impact between the clip 416*b* and the device 2000 when the wallet 5000 is closed and advantageously prevent surface damage to parts of the wallet 5000. In a preferred embodiment, padding feet 418 is used with the fixed clip 416*b* so that the portion of the padding feet 418 that extends through apertures in retaining means 416*a* and fixed clip 416*b*, acts as a barrier between the fixed clip 416*b* and the device 2000 when the wallet 5000 is closed. The thickness of the padding feet 418 preferably does not contribute to the thickness of the wallet 5000 as it does not exceed the dead space adjacent to the space meant to be occupied by bank notes 309*c*. In various embodiments, the padding 508*a*, 510*a* may extend from the base of the compartments 508, 510 to above the edge of the compartment sidewalls, thereby sealing the compartments 508, 510 and preventing water from entering the compartments 508, 510 when the wallet 5000 is in the closed position. In a preferred embodiment, the top of the compartment 508 may have a substantially flat layer of foam padding 506*b*, whereby the padding 506*b* is attached to the surface of the first barrier 506 that forms the top of the compartment 508. Advantageously, the padding 506*b* restricts free movement of the objects contained in the compartment 508.

Figure 32A:
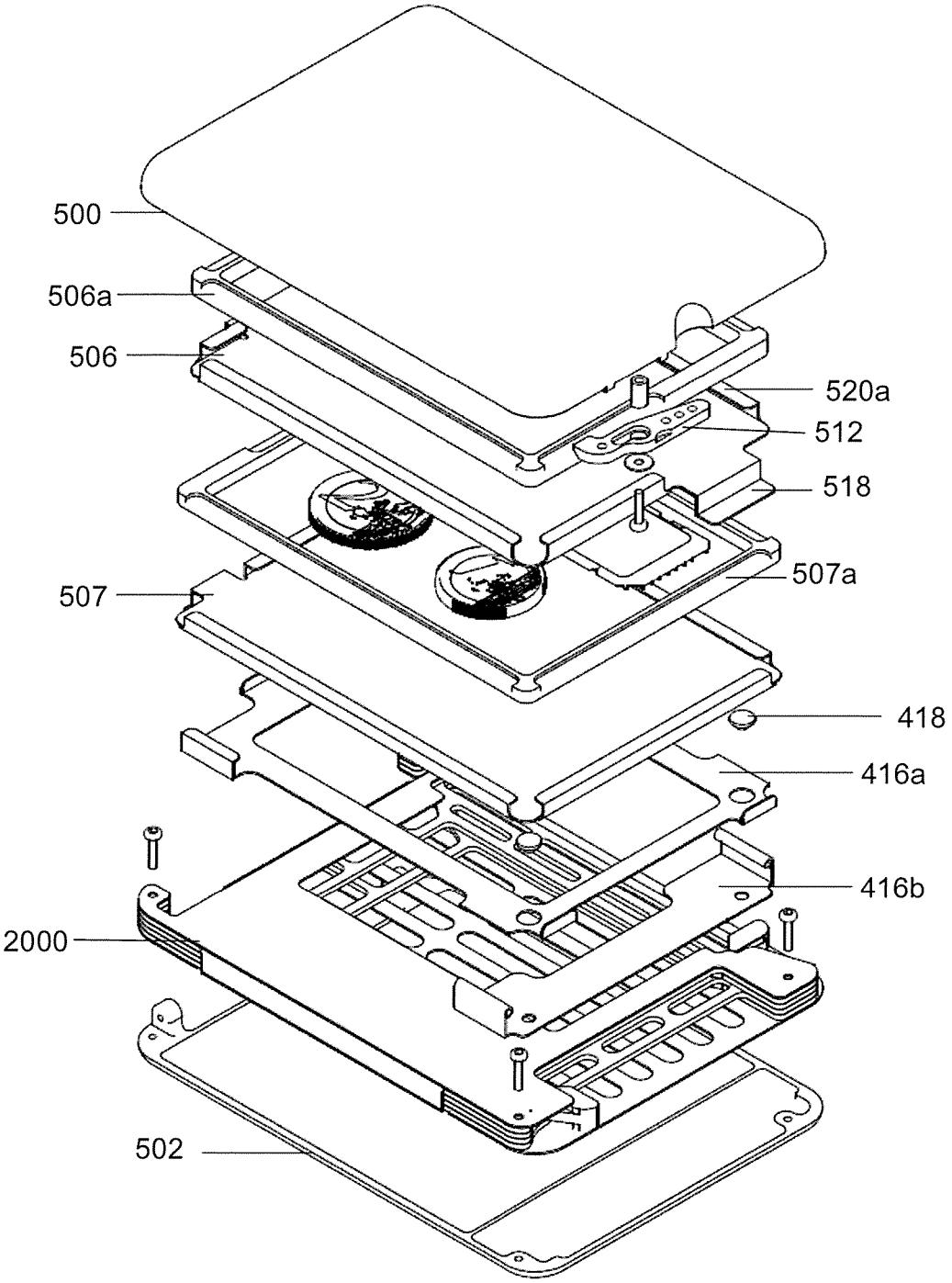
FIG. 32(*a*) illustrates an exploded view of the wallet of FIG. 26(*a*) from the top, without containing a card.
Figure 32B:
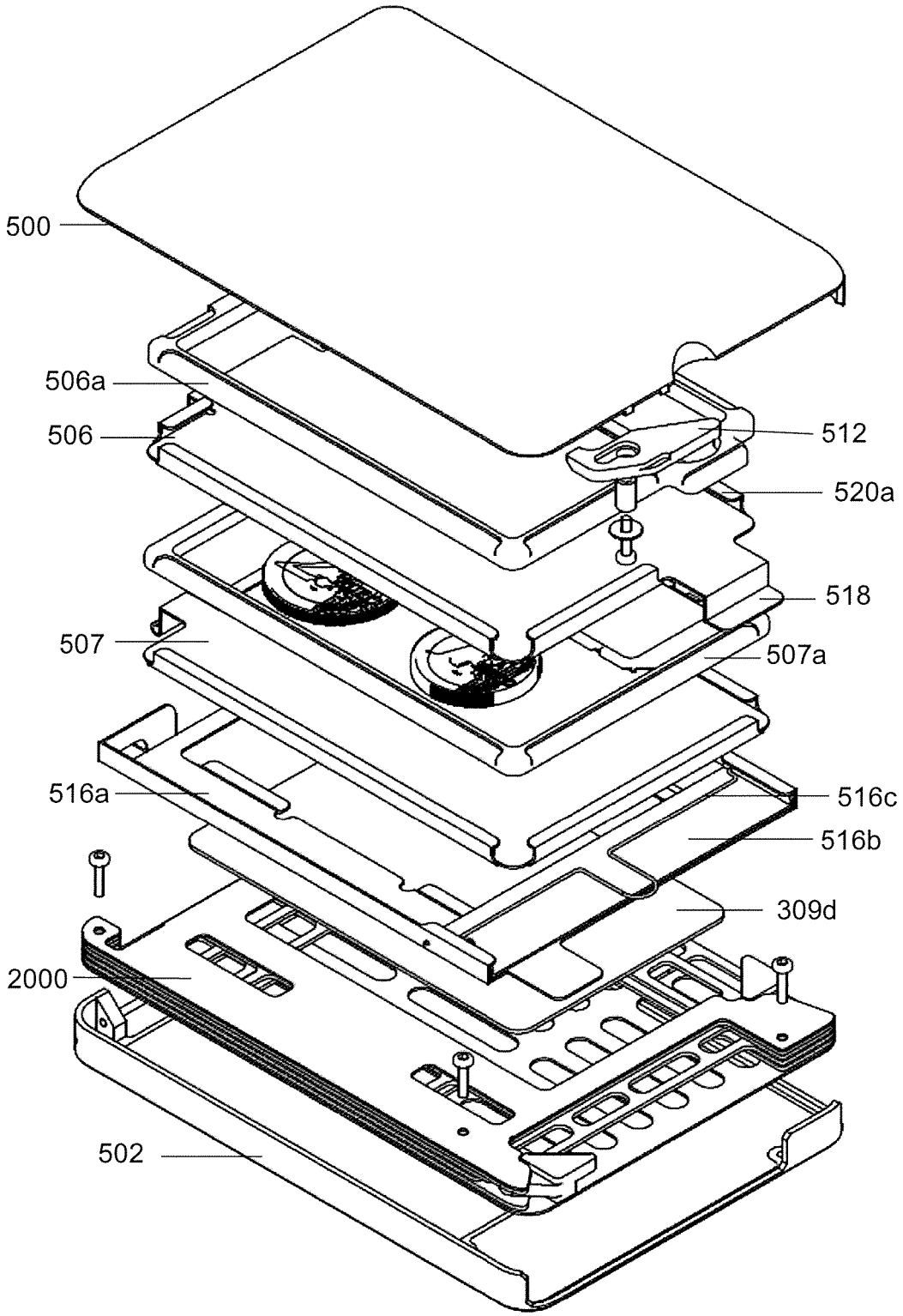
Figure 33:
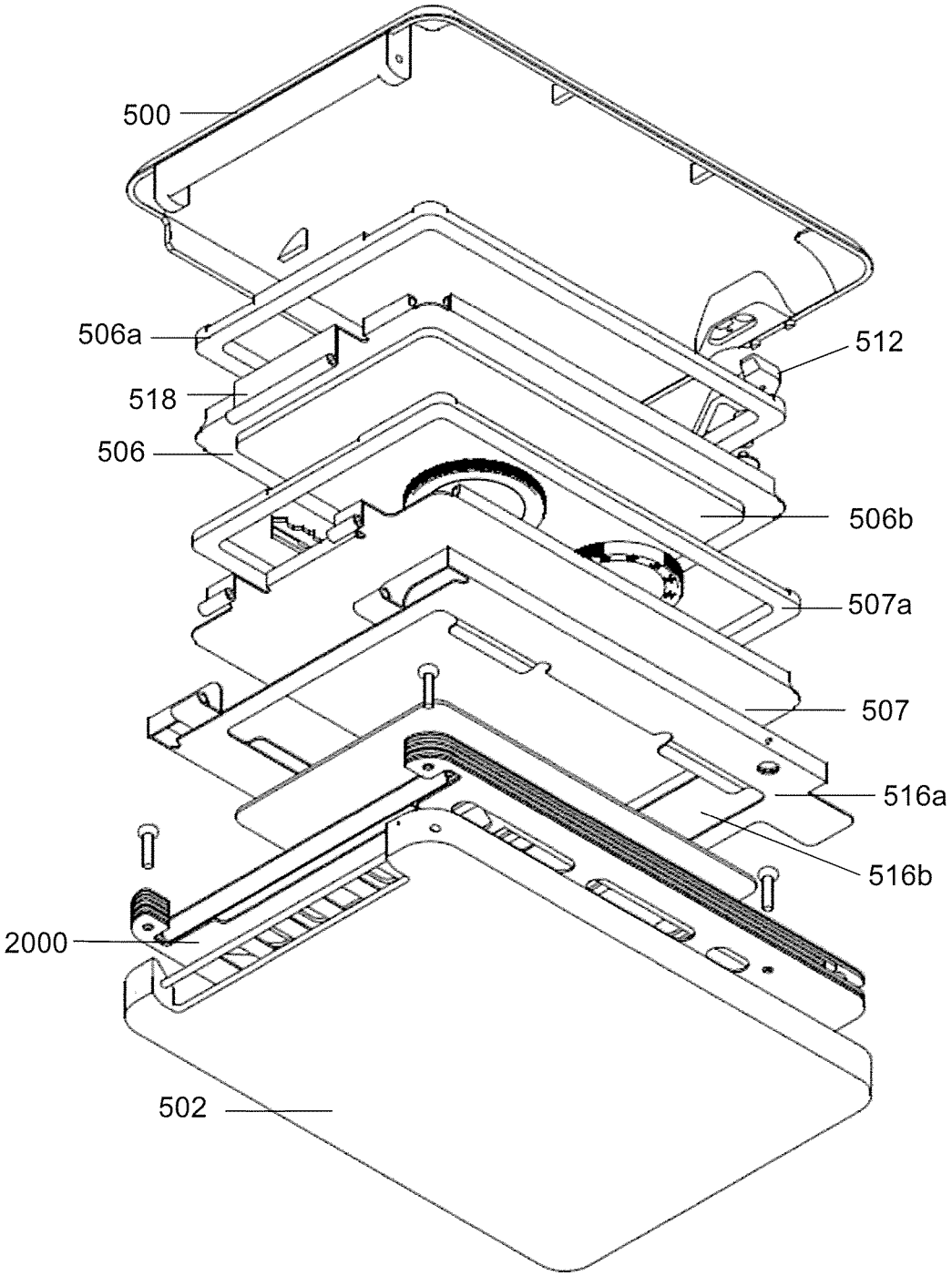
FIG. 33 illustrates an exploded view of the wallet of FIG. 26(*b*) from the bottom.

In various embodiments and as illustrated in FIGS. 32(*a*) and 32(*b*) (collectively known as FIG. 32), the second barrier 507 may further comprise an attachment 507*a* which assists in securing the contents of compartment 508 and/or assists in holding down the padding. In particular, the attachment 507*a* acts as an extension of the partially raised walls of the second barrier 507, such that the partially raised walls curve inwards and towards the compartment 508, thereby securing the contents of compartment 508 and/or the padding.

In various embodiments, the fixed clip 416 may be capable of holding in place the padding in compartment 508.

In various embodiments, the first barrier 506 may further comprise a tab 518 that is capable of allowing the first barrier 506 to be raised together with the first shell cover 500. Consequently, the user may access the compartment 508. In a preferred embodiment, the tab 518 extends towards the compartment 508, such as down a side face of compartment 508 to the bottom edge of compartment 508 (FIGS. 29 and 32), and out to just beneath, but not beyond the edge, such as the outer edge (FIGS. 29 and 32), of the first shell cover 500. Advantageously, the tab 518 may be positioned such that it does not take up significant space in the wallet 5000. Additional tabs may be added depending on the number of barriers, and accordingly, the number of compartments. In a preferred embodiment, each tab does not overlap another and occupies only a portion of the edge of a barrier. The tab(s) may allow the user to selectively access the various compartments.

Figure 25:
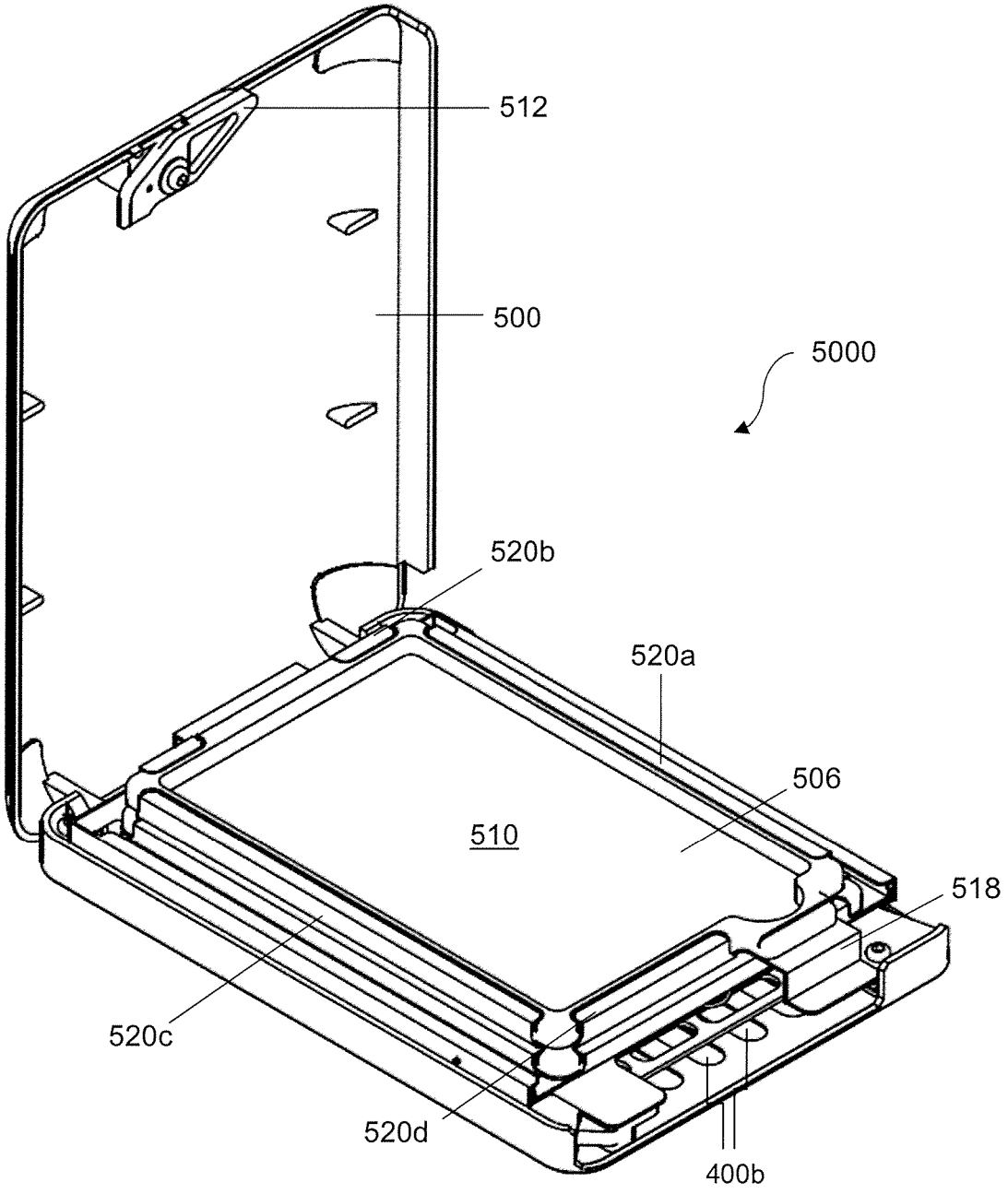
FIG. 25 illustrates a perspective view of the wallet of FIG. 24 in an open position, showing one of the compartments between the first shell cover and the second shell cover.

In a preferred embodiment and as shown in FIG. 25, compartment 510 may have partially raised walls 520*a*, 520*b*, 520*c* and 520*d* extending from first barrier 506, which are capable of securing the contents of compartment 510. In an embodiment, one of the partially raised walls may be absent. The absence of a partially raised wall on a fourth side may allow the user to slide the contents of compartment 510 with ease and improved accessibility.

In various embodiments, the first barrier 506 may further comprise an attachment 506*a* which assists in securing the contents of compartment 510 and/or assists in holding down the padding. In particular, the attachment 506*a* acts as an extension of the partially raised walls 520*a*, 520*b*, 520*c* and 520*d*, such that the partially raised walls 520*a*, 520*b*, 520*c* and 520*d* curve inwards and towards the compartment 510, thereby securing the contents of compartment 510 and/or the padding.

In a preferred embodiment and as shown in FIGS. 24(*a*) and 24(*b*), the first shell cover 500 may have rounded edges, which may advantageously reduce wear and tear of a material in direct contact with the wallet 5000. For instance, the material may be a cloth used to make the back pocket or any other pocket containing the wallet 5000. Furthermore, the rounded edges may facilitate the insertion of the wallet 5000 into a back pocket or any other pocket. The first shell cover 500 may have one or more rounded edges.

In various embodiments, each component of the wallet 5000 may be made from a material that is independent of each other. Such a material may comprise at least one of plastic, plastic composite, metal, metal alloy, wood, leather or fabric. In a preferred embodiment, the metal is aluminium. In particular, the first shell cover 500, the second shell cover 502, the first barrier 506 and the second barrier 507 are made of aluminium. When aluminium is used to make, for instance, barriers 506 and 507, there would be minimal or no radiofrequency interference between cards with embedded RF devices that have the aluminium barriers (506, 507) between them. Advantageously, an aluminium shell cover (such as first shell cover 500 and second shell cover 502) would also protect RF devices in a closed wallet 5000 from being scanned by an external RF device against the user's will or knowledge. Depending on the material used for the particular component, the component may have desirable characteristics such as being lightweight, durable and/or stiff. Consequently, the wallet 5000 may have desirable characteristics such as being lightweight, durable and slim. Advantageously, the user can use the wallet 5000 for a prolonged period of time and can carry objects such as cards, coins and bank notes in a convenient and comfortable manner.

Figure 35:
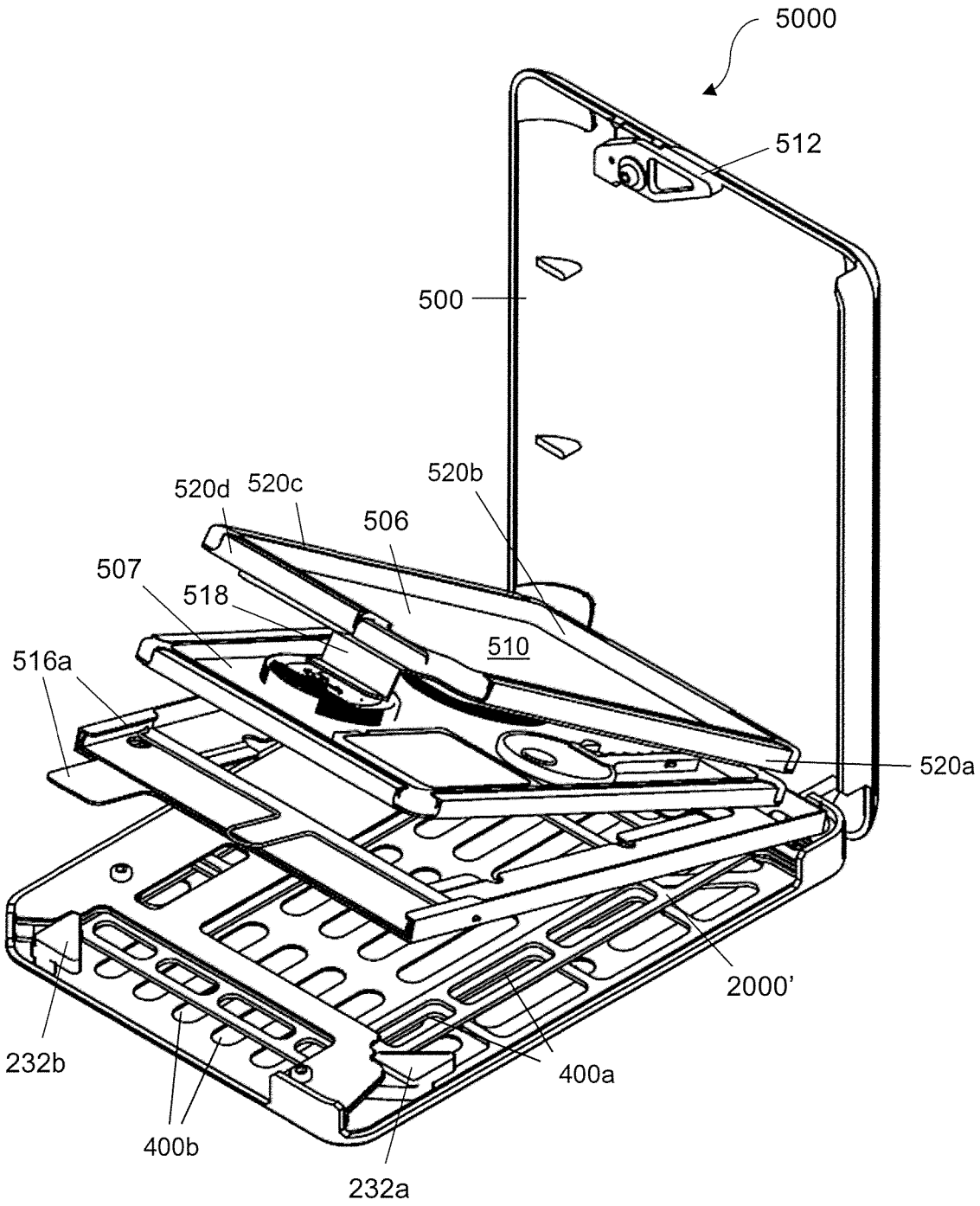
FIG. 35 illustrates a perspective view of a wallet in accordance with another embodiment of the invention in an open position, showing the various compartments between the first shell cover and the second shell cover and wherein a card is capable of being retained using a hinged clip.

In various embodiments, at least one component of the wallet may comprise a plurality of holes or a plurality of perforations. This is illustrated, for instance, in wallet 5000 (FIG. 35). As shown in FIG. 35, wallet 5000 may comprise a first shell cover 500, a second shell cover 502, a first barrier 506 and a second barrier 507 connected to the first shell cover 500. The first barrier 506 and the second barrier 507 is connected to the first shell cover 500 such that two compartments (508, 510) are introduced into the space between a device 2000' and the first shell cover 500. A plurality of holes or plurality of perforations (400*a*) may be found on at least one surface of a device 2000', such that less material is used to make the device 2000'. Device 2000' may comprise the embodiments of device 1000 or device 2000, and will not be elaborated further. In various embodiments, a plurality of holes or a plurality of perforations (400*b*) may be introduced to the second shell cover 502. In various embodiments, a plurality of holes or a plurality of perforations may be introduced to the first shell cover 500 (not shown). The presence of the holes or perforations (e.g. 400*a*, 400*b*) may result in the use of less material, and consequently reduce the weight and/or cost to manufacture wallet 5000. In addition, the plurality of holes or the plurality of perforations may increase the surface area of the component of the wallet, which may advantageously lead to better grip.

Exemplary, non-limiting embodiments of a method of forming a device for holding objects will now be disclosed.

In accordance with an embodiment, the method of forming a device 1000 for holding at least one object comprises the steps of: a) providing a first frame 100*a* comprising a first opening 104*a* leading to a space for receiving a first planar object 102*a*; b) providing a second frame 100*b* comprising a second opening 104*b* leading to a space for receiving a second planar object 102*b;* c) attaching the first frame 100*a* to the second frame 100*b* such that the first frame 100*a* and the second frame 100*b* are located adjacent one another, wherein the first frame 100*a* further comprises an object retaining member for maintaining the second planar object 102*b* in the space of second frame 100*b,* such as third side 113 which is adjacent to the space of second frame 100*b,* and wherein the first opening 104*a* is aligned in a different direction from the second opening 104*b*.

The method may further comprise the step of cutting sheets of material into the desired shape by laser or stamping to provide the frames (100*a,* 100*b*). In a preferred embodiment, the material may be stiff so that it can provide support and protection to the objects. The material may be a plastic, plastic composite, metal, metal alloy, leather or fabric.

The method may further comprise the step of attaching a third frame 100*c* to the second frame 100*b,* such that the third frame 100*c* and the second frame 100*b* are located adjacent one another and the third opening 104*c* is aligned in a different direction from the second opening 104*b*.

The method may further comprise the step of attaching a fourth frame 100*d* to the third frame 100*c,* such that the fourth frame 100*d* and the third frame 100*c* are located adjacent one another and the fourth opening 104*d* is aligned in a different direction from the third opening 104*c*.

The method may further comprise the step of attaching a front frame 206 to the first frame 100*a*.

The method may further comprise the step of attaching a backing 208 to the fourth frame 100*d*.

The method may further comprise the steps of: a) providing a first shell cover 300 and a second shell cover 302; b) attaching the first shell cover 300 to the second shell cover 302; c) attaching the device as described herein to the second shell cover 302.

The method may further comprise the step of cutting sheets of material into the desired shape by laser or stamping to provide the frames of the device for holding objects as described herein. In a preferred embodiment, the material may be stiff so that it can provide support and protection to the objects. The material may be a plastic, plastic composite, metal, metal alloy, leather or fabric.

The step of attaching the frames of the device for holding objects as described herein may be achieved by using adhesives, fasteners or other means.

The method may further comprise the step of cutting and optionally bending sheets of material to form a locking means 312, hinged clip 316 or any other component of the wallet 3000. Alternatively, the method may further comprise the step of milling a single piece of material into shape or moulding to form a locking means 312, a hinged clip 316 or any other component of the wallet 3000.

The method of forming the wallet 3000' and 5000 similarly comprises the steps outlined above for forming the wallet 3000.

It is to be appreciated that while the device is described in the context of a device for holding objects such as cards, coins, keys and bank notes, the advantageous features associated with the device make it suitable for holding other objects. Consequently, the device may be applied to other applications and should not be limited to incorporation into a wallet.

It will be apparent that various other modifications and adaptations of the invention will be apparent to the person skilled in the art after reading the foregoing disclosure without departing from the spirit and scope of the invention. It is intended that all such modifications and adaptations come within the scope of the appended claims.

Further, it is to be appreciated that features from various embodiment(s), may be combined to form one or more additional embodiments.

The invention claimed is:

1. A device for holding cards and other planar objects, the device comprising at least two planar frames located adjacent one another, each planar frame comprising:

an opening leading to a space; and an object retaining member for maintaining an object when received in a space of an adjacent planar frame;

wherein the object retaining member is formed of a side of the planar frame adjacent to the space of the adjacent planar frame;

wherein the opening of the planar frame is aligned in a different direction from an opening of the adjacent planar frame; and wherein each planar frame is configured to only contact a periphery of a received object such that at least a portion of the object when received in the space of the planar frame is capable of being in direct contact with at least a portion of another object when received in the space of the adjacent planar frame.

2. The device according to claim 1, wherein the opening of the planar frame is substantially orthogonal to the opening of the adjacent planar frame.

3. The device according to claim 1, wherein each planar frame is configured such that when an object is received in the space of each planar frame, at least a portion of the object in the space of each planar frame is visible.

4. The device according to claim 1, wherein the thickness of the object retaining member of the planar frame is different from the thickness of an object retaining member of the adjacent planar frame.

5. The device according to claim 1, wherein each planar frame further comprises a second side and a third side, and wherein the thickness of the second side and the thickness of the third side of the planar frame are different from the thickness of the second side and the thickness of the third side of the adjacent planar frame, respectively.

6. The device according to claim 1, further comprising a front frame, a backing and a locking mechanism, wherein the locking mechanism is positioned between the front frame and the backing and wherein the locking mechanism is capable of retaining the received object.

7. The device according to claim 6, wherein the locking mechanism comprises at least one lever between the front frame and the backing.

8. The device according to claim 1, wherein the device is releasably attachable to a first shell cover and a second shell cover, wherein the second shell cover forms a compartment with the device, and wherein the first shell cover further comprises a locking means.

9. The device according to claim 1, wherein the device is releasably attachable to a first shell cover and a second shell cover, wherein the first shell cover further comprises a first barrier and a second barrier connected to the first shell cover, wherein the first barrier and the second barrier form a compartment, wherein the compartment comprises padding along its edges, and wherein the first barrier further comprises a tab capable of allowing a user to raise the first barrier.

10. The device according to claim 9, wherein the device further comprises an object retaining means capable of pressing an object against a side of the second barrier, and wherein the object retaining means is capable of being in a form of a hinged clip or a fixed clip.

11. The device according to claim 1, wherein the device is releasably attachable to a first shell cover and a second shell cover, wherein the first shell cover further comprises a first barrier and a second barrier connected to the first shell cover, and wherein the first barrier and the first shell cover form a compartment.

* * * * *